US012528523B2

(12) United States Patent
Hamilton et al.

(10) Patent No.: US 12,528,523 B2
(45) Date of Patent: Jan. 20, 2026

(54) SYSTEMS AND METHODS FOR RAILWAY EQUIPMENT CONTROL

(71) Applicant: MOW Equipment Solutions, Inc., Linwood, KS (US)

(72) Inventors: William Michael Hamilton, Linwood, KS (US); Ryan Jay Koci, Stilwell, KS (US); Justin Wynne Tomac, Bonner Springs, KS (US)

(73) Assignee: MOW Equipment Solutions, Inc., Linwood, KS (US)

( * ) Notice: Subject to any disclaimer, the term of this patent is extended or adjusted under 35 U.S.C. 154(b) by 0 days.

(21) Appl. No.: 18/628,435

(22) Filed: Apr. 5, 2024

(65) Prior Publication Data

US 2024/0351622 A1 Oct. 24, 2024

Related U.S. Application Data

(63) Continuation of application No. 17/115,886, filed on Dec. 9, 2020, now Pat. No. 11,952,021.

(60) Provisional application No. 62/946,220, filed on Dec. 10, 2019.

(51) Int. Cl.
*B61K 9/08* (2006.01)
*B61L 23/04* (2006.01)

(52) U.S. Cl.
CPC ..... *B61K 9/08* (2013.01); *B61L 23/042* (2013.01)

(58) Field of Classification Search
CPC ..... B61K 9/08; B61L 27/53; B61L 23/042
See application file for complete search history.

(56) References Cited

U.S. PATENT DOCUMENTS 308,421 A 11/1884 Meyenberg
4,457,060 A 7/1984 Parks et al.
4,534,297 A * 8/1985 Johnson, Sr. ..... B61D 15/00 105/72.2

(Continued)

FOREIGN PATENT DOCUMENTS

CA 2994083 8/2018
CA 2994132 8/2018

OTHER PUBLICATIONS

Sakai, JP H09136287 A—English Translation (Year: 1997).*

(Continued)

*Primary Examiner* — Michael J Dalbo
(74) *Attorney, Agent, or Firm* — Kilpatrick Townsend & Stockton LLP

(57) ABSTRACT

System, methods, and machine-readable media to facilitate monitoring and control of a railway maintenance assembly are disclosed. A railway workhead component monitor may be adapted to be disposed at a railway maintenance assembly. The railway workhead component monitor may be configured to perform one or a combination of the following. One or more conditions of at least a portion of the railway maintenance assembly may be monitored. Based at least in part on the monitoring, a plurality of monitoring data corresponding to operations of the railway maintenance assembly may be stored. Reporting data may be generated based at least in part on the stored plurality of monitoring data. A wireless communication may be transmitted toward a railway device controller that is remote from the railway maintenance assembly, the wireless communication including the reporting data.

17 Claims, 17 Drawing Sheets

(56) References Cited

U.S. PATENT DOCUMENTS

| | | | | |
|---|---|---|---|---|
| 4,890,558 | A | 1/1990 | Quella et al. | |
| 4,903,611 | A | 2/1990 | Holley | |
| 5,074,219 | A | 12/1991 | Theurer et al. | |
| 5,117,760 | A | 6/1992 | Almaraz et al. | |
| 5,277,122 | A | 1/1994 | Almaraz et al. | |
| 5,331,899 | A | 7/1994 | Holley | |
| 5,438,931 | A | 8/1995 | Becker et al. | |
| 5,577,447 | A | 11/1996 | Weber et al. | |
| 5,586,502 | A | 12/1996 | Weber | |
| 5,694,856 | A | 12/1997 | Theurer | |
| 5,730,060 | A | 3/1998 | Straub et al. | |
| 5,915,744 | A | 6/1999 | Cotsford | |
| 6,138,573 | A | 10/2000 | Brenny et al. | |
| 6,324,659 | B1 | 11/2001 | Pierro | |
| 6,662,729 | B1 | 12/2003 | Madison | |
| 7,104,200 | B2 | 9/2006 | Hosking et al. | |
| 7,574,961 | B2 | 8/2009 | Barezzani et al. | |
| 7,677,177 | B2 | 3/2010 | Ganz | |
| 8,485,103 | B2 | 7/2013 | Miller et al. | |
| 8,522,688 | B2 | 9/2013 | Pritzl | |
| 8,739,704 | B2 | 6/2014 | Wickman et al. | |
| 9,841,287 | B1 | 12/2017 | Hayward | |
| 10,190,264 | B2 | 1/2019 | Hamilton et al. | |
| 10,526,753 | B2 | 1/2020 | Hamilton et al. | |
| 10,781,559 | B2 | 9/2020 | Hamilton et al. | |
| 10,781,560 | B2 | 9/2020 | Hamilton et al. | |
| 11,268,247 | B2 | 3/2022 | Hamilton et al. | |
| 11,952,021 | B2 | 4/2024 | Hamilton et al. | |
| 12,006,637 | B2 | 6/2024 | Hamilton et al. | |
| 2004/0006413 | A1 | 1/2004 | Kane et al. | |
| 2005/0067381 | A1* | 3/2005 | Coomer | B23K 9/0026 219/54 |
| 2007/0156311 | A1* | 7/2007 | Elcock | G07C 5/008 701/31.4 |
| 2011/0072998 | A1 | 3/2011 | Noll et al. | |
| 2011/0308421 | A1 | 12/2011 | Pritzl | |
| 2012/0199037 | A1 | 8/2012 | Miller et al. | |
| 2012/0296562 | A1 | 11/2012 | Carlson et al. | |
| 2013/0276278 | A1 | 10/2013 | Barezzani et al. | |
| 2013/0300551 | A1 | 11/2013 | Weber et al. | |
| 2015/0053449 | A1 | 2/2015 | Henke | |
| 2016/0153151 | A1 | 6/2016 | Irion | |
| 2016/0159380 | A1 | 6/2016 | Le-Corre et al. | |
| 2016/0289899 | A1 | 10/2016 | Hamilton | |
| 2016/0298299 | A1 | 10/2016 | Hamilton et al. | |
| 2018/0223482 | A1 | 8/2018 | Hamilton et al. | |
| 2018/0223483 | A1 | 8/2018 | Hamilton et al. | |
| 2019/0130669 | A1 | 5/2019 | Boggio | |
| 2019/0154453 | A1* | 5/2019 | Leone | B60W 30/188 |
| 2019/0194878 | A1 | 6/2019 | Hamilton et al. | |
| 2022/0122004 | A1 | 4/2022 | Takahara et al. | |

OTHER PUBLICATIONS

U.S. Appl. No. 15/090,428, Notice of Allowance, mailed on Sep. 14, 2018, 5 pages.
U.S. Appl. No. 15/886,957, Notice of Allowance, mailed on May 19, 2020, 7 pages.
U.S. Appl. No. 15/889,562, "Corrected Notice of Allowability", filed Jun. 15, 2020, 2 pages.
U.S. Appl. No. 15/889,562, Notice of Allowance, mailed on May 20, 2020, 10 pages.
U.S. Appl. No. 16/219,150, Notice of Allowance, mailed on Sep. 5, 2019, 9 pages.
U.S. Appl. No. 16/230,476, "Corrected Notice of Allowability", filed Dec. 14, 2021, 2 pages.
U.S. Appl. No. 16/230,476, Notice of Allowance, mailed on Oct. 27, 2021, 12 pages.
U.S. Appl. No. 17/025,841, Notice of Allowance, mailed on Feb. 7, 2024, 5 pages.
U.S. Appl. No. 17/115,886, Notice of Allowance, mailed on Jan. 31, 2024, 10 pages.
Application No. CA2,994,083, Notice of Allowance, mailed on Sep. 16, 2022, 1 page.
Application No. CA2,994,132, Notice of Allowance, mailed on Mar. 20, 2023, 4 pages.
Application No. CA3,028,637, Notice of Allowance, mailed on Sep. 14, 2022, 1 page.

* cited by examiner

SYSTEMS AND METHODS FOR RAILWAY EQUIPMENT CONTROL

CROSS-REFERENCE TO RELATED APPLICATION

The present application is a continuation of U.S. Non-Provisional patent application Ser. No. 17/115,886, filed Dec. 9, 2020, which claims benefit under 35 USC 119 (e) of U.S. Provisional Application No. 62/946,220, filed on Dec. 10, 2019, the entire disclosure of which is incorporated herein by reference for all purposes.

BACKGROUND

Disclosed embodiments according to the present disclosure relate generally to railways, and in particular to maintenance of way with systems, apparatuses, and methods for railway equipment control.

With the hundreds of thousands of miles of railroad track traversing the United States alone, in addition to the great lengths throughout other countries of the world, maintenance of way is a tremendous and important effort. One aspect of maintenance of way is railway tie maintenance. Railway ties are typically made of wood or other materials that age and deteriorate over time due to railway use and environmental conditions. As a result, railway ties eventually require replacement with new railway ties.

There are multiple steps in a process of railway tie replacement. Rails of railroad tracks are typically fastened to railway ties with a combination of railway spikes, tie plates fastened to the railway ties with the railway spikes, and railway anchors attached to undersides of the rails to anchor the rails to sides of the railway ties. Under current work practices, a typical tie replacement gang comprises several unique machines, in some cases 20 and more, forming a long line and arranged in the necessary order to perform sequential tasks for removing an old, worn railway tie and replacing it with a new railway tie. The trend is toward shorter and shorter work windows, with a desire for more output. To that end, maintaining the machines in optimal condition and avoiding breakdowns is essential, particularly because underperformance and breakdowns with respect to one machine can negatively impact the output of other machines in the gang due to the sequential nature of the work.

Thus, there is a need to solve these problems and provide for systems, apparatuses, and methods for railway equipment control. These and other needs are addressed by the present disclosure.

BRIEF SUMMARY

Certain embodiments of the present disclosure relate in general to railways and, more specifically, but not by way of limitation, to maintenance of way with systems, apparatuses, and methods for railway equipment control.

In one aspect, a system to facilitate monitoring and control of a railway maintenance assembly is disclosed. The system may include one or a combination of the following. A railway workhead component monitor may be adapted to be disposed at a railway maintenance assembly. The railway workhead component monitor may be configured to perform one or a combination of the following. One or more conditions of at least a portion of the railway maintenance assembly may be monitored. Based at least in part on the monitoring, a plurality of monitoring data corresponding to operations of the railway maintenance assembly may be stored. Reporting data may be generated based at least in part on the stored plurality of monitoring data. A wireless communication may be transmitted toward a railway device controller that is remote from the railway maintenance assembly, the wireless communication including the reporting data.

In another aspect, a method to facilitate monitoring and control of a railway maintenance assembly is disclosed. The method may include one or a combination of the following. One or more conditions of at least a portion of the railway maintenance assembly may be monitored with a railway workhead component monitor adapted to be disposed at a railway maintenance assembly. Based at least in part on the monitoring, a plurality of monitoring data corresponding to operations of the railway maintenance assembly may be stored by the railway workhead component monitor. Reporting data may be generated, by the railway workhead component monitor, based at least in part on the stored plurality of monitoring data. A wireless communication may be communicated, by the railway workhead component monitor, to a railway device controller that is remote from the railway maintenance assembly, the wireless communication including the reporting data.

In yet another aspect, one or more non-transitory, machine-readable media comprising machine-readable instructions, which, when executed by one or more processing devices, causes the one or more processing devices to perform operations to facilitate monitoring and control of a railway maintenance assembly. The operations may include one or a combination of the following. One or more conditions of at least a portion of a railway maintenance assembly may be monitored via a railway workhead component monitor. Based at least in part on the monitoring, a plurality of monitoring data corresponding to operations of the railway maintenance assembly may be stored via the railway workhead component monitor. Reporting data based at least in part on the stored plurality of monitoring may be data generated via the railway workhead component monitor. Communication of a wireless communication to a railway device controller that is remote from the railway maintenance assembly may be caused via the railway workhead component monitor, the wireless communication including the reporting data.

In various embodiments, the railway workhead component monitor may be further configured to monitor operations of an assembly component of the railway maintenance assembly. In various embodiments, the railway device controller may be further configured to determine an operational condition of an assembly component of the railway maintenance assembly based at least in part on the reporting data and cause one or more maintenance actions based at least in part on the operational condition. In various embodiments, the railway device controller may be further configured to generate adaptive interface elements that indicate the one or more maintenance actions. In various embodiments, the railway device controller may be further configured to generate a profile of the railway maintenance assembly based at least in part on the reporting data, where the profile includes operational metrics for the railway maintenance assembly. In various embodiments, the railway device controller may be further configured to generate a profile of an operator of the railway maintenance assembly based at least in part on the reporting data, where the profile includes operator metrics for the operator. In various embodiments, the railway device controller may be further configured to communicate with a set of component monitors that monitor a plurality of railway maintenance assemblies, the set of component monitors including the component monitor, and the plurality of railway maintenance assemblies including the railway maintenance assembly. In various embodiments, the railway device controller may be further configured to generate a profile of a gang comprising the plurality of railway maintenance assemblies based at least in part on communications from the set of component monitors, where the profile includes gang metrics for the gang.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the following appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Various embodiments will now be discussed in greater detail with reference to the accompanying figures, beginning with FIG. 1.

Figure 1:
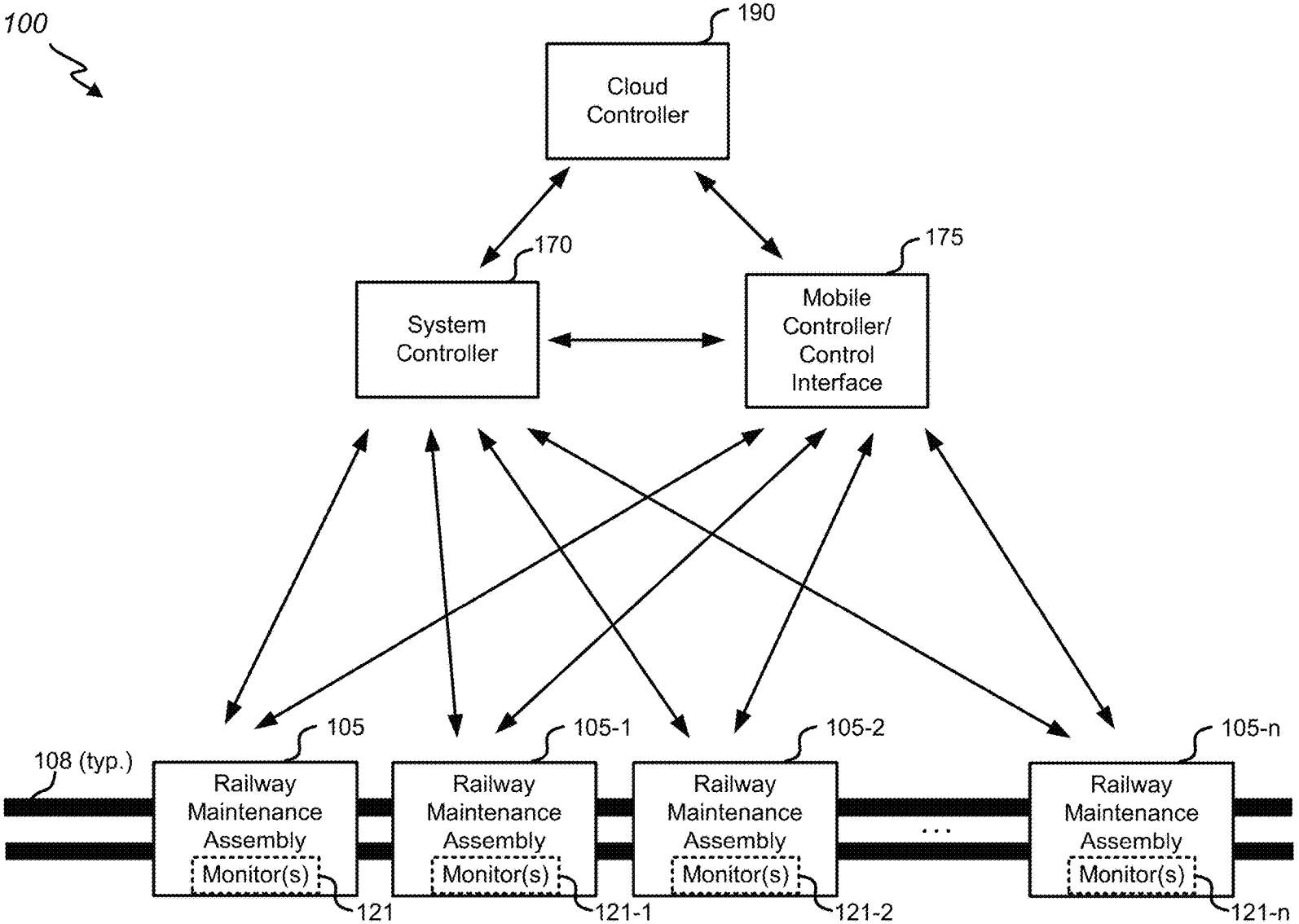
FIG. 1 illustrates a diagram of an overview of a system to facilitate railway maintenance assembly control, in accordance with disclosed embodiments of present disclosure.

FIG. 1 illustrates a diagram of an overview of a system 100 to facilitate railway maintenance assembly control, in accordance with disclosed embodiments of present disclosure. For brevity, system 100 is depicted in a simplified and conceptual form, and may generally include more or fewer systems, devices, networks, and/or other components as desired. Further, the number and types of features or elements incorporated within the system 100 may or may not be implementation-specific. The system 100 may correspond to a railway maintenance system.

The system 100 may include one or more railway maintenance assemblies 105 adapted for performing maintenance operations on a railway. The system 100 may further include one or a combination of a system controller 170, one or more mobile controllers/control interfaces 175, and/or a remote cloud controller 190 configured to manage the one or more railway maintenance assemblies 105. The illustration of FIG. 1 depicts a plurality of railway maintenance assemblies 105 along a railway. The railway, as is typical, comprises a pair of rails 108 (though only one rail 108 is depicted in various views herein) supported by a plurality of railway ties. As used herein, the term "gage side" or "gauge side" is used to indicate an association with a space between the pair of rails 108 and/or a side of a rail 108 or other component exposed to, facing, and/or oriented toward the space between the pair of rails 108. The term "field side" is used to indicate an association with a space external to the pair of rails 108 and/or a side of a rail 108 or other component exposed to, facing, and/or oriented toward the space external to the pair of rails 108.

Various embodiments may be directed to various types of railway maintenance devices. In various embodiments, various railway maintenance assemblies 105 may be adapted for conjunction with a variety of railway machinery and railway workheads. One or more of the railway maintenance assemblies 105 may include, for example, spike-extracting workheads, railway anchor spreading and/or removing workheads, and/or any other suitable type of railway adjustment instance and/or maintenance machinery. One or more of the railway maintenance assemblies 105 may include or otherwise be coupled to a motorized railway maintenance vehicle. The railway maintenance vehicle may include an engine, a chassis, wheels for traversing along one or more of the rails 108, and other suitable components known to a person of ordinary skill in the art. Accordingly, the railway maintenance vehicle may include an operator cab, station, or other area with control elements of a control system 401 (disclosed further herein) that allow for control of the railway maintenance vehicle, including acceleration of the vehicle, braking, and railway component adjustments disclosed herein. The railway maintenance vehicle may be any suitable vehicle adapted for coupling with the railway workheads. Some embodiments of a railway maintenance vehicle may correspond to a self-driving vehicle and/or a remote-controlled vehicle as disclosed herein.

Figure 2:
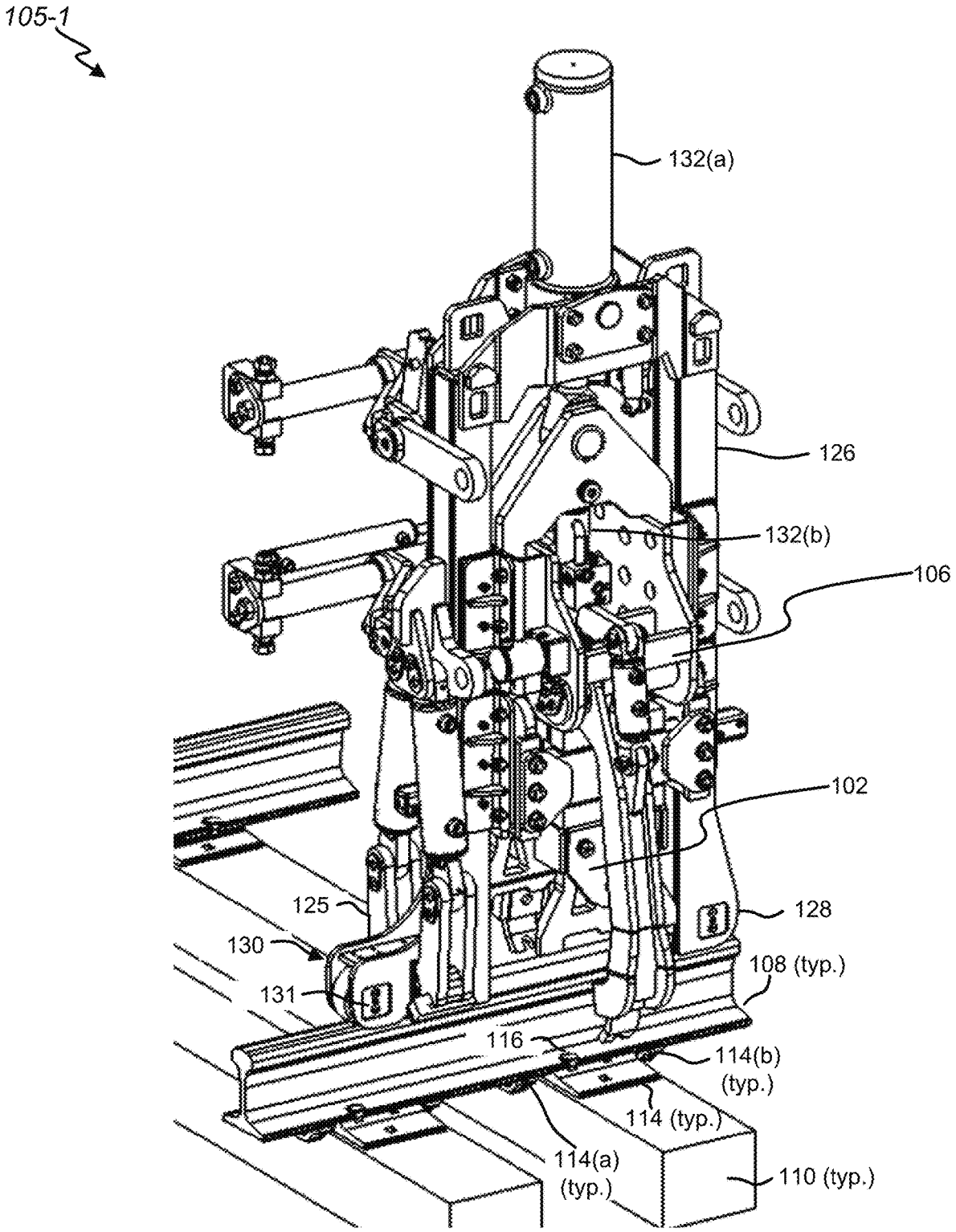
FIG. 2 depicts a partial perspective view of a single-plane multi-functional railway component handling system from a field side of a rail, in accordance with disclosed embodiments of the present disclosure.
Figure 2A:
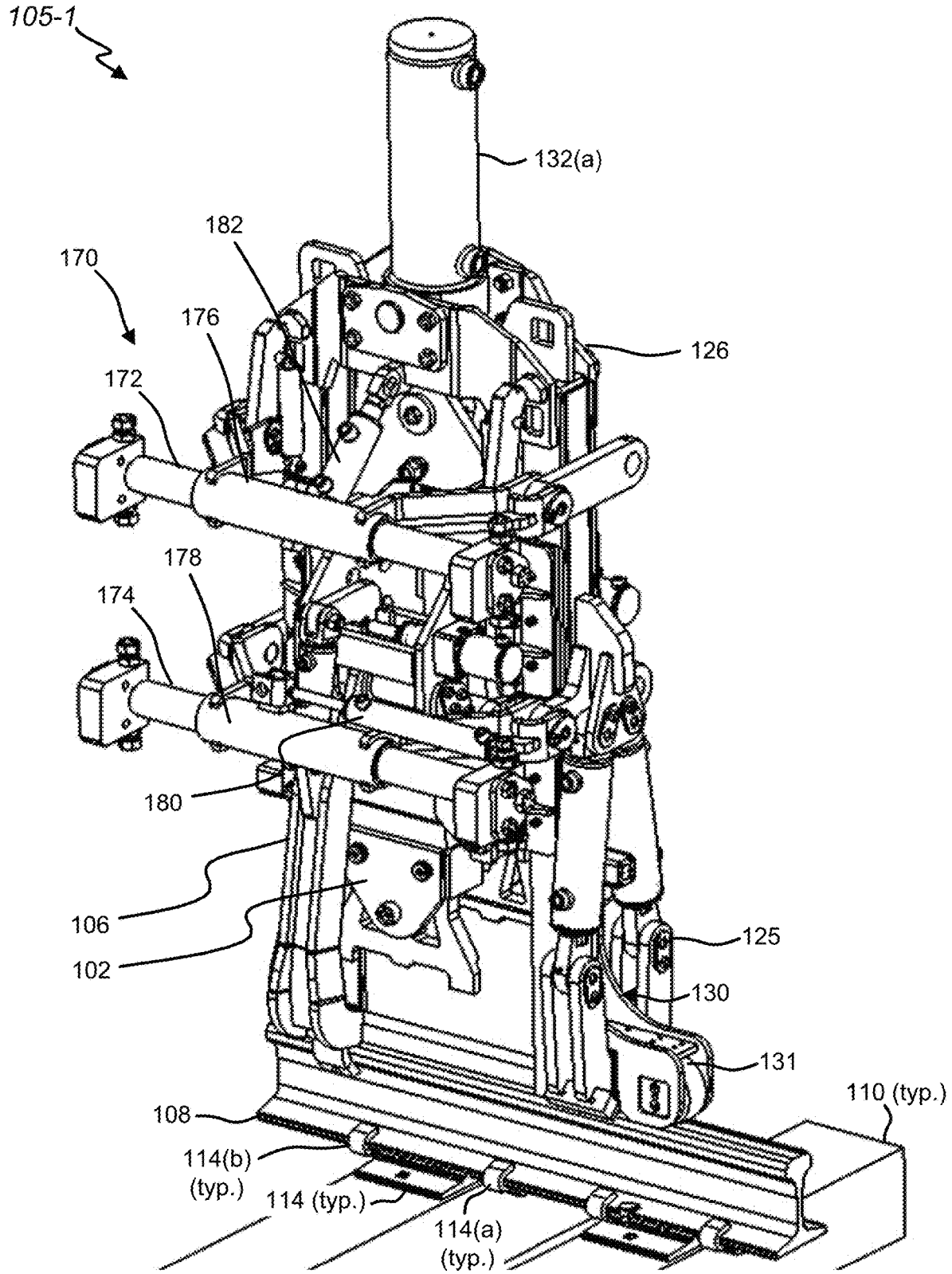
FIG. 2A depicts a partial perspective view of the single-plane multi-functional railway component handling system from a gage side of the rail, in accordance with disclosed embodiments of the present disclosure.

By way of example, one or more of the railway maintenance assemblies 105 may include a single-plane, multi-functional railway component handling system 105-1. FIG. 2 depicts a partial perspective view of a single-plane multi-functional railway component handling system 105-1 from a field side of a rail 108, in accordance with disclosed embodiments of the present disclosure. FIG. 2A depicts a partial perspective view of the single-plane multi-functional railway component handling system 105-1 from a gage side of the rail 108, in accordance with disclosed embodiments of the present disclosure. The railway, as is typical, comprises a pair of rails 108 supported by a plurality of railway ties 110 and fastened to the railway ties 110 with a combination of railway fasteners 116, tie plates 114 fastened to the railway ties 110 with the railway fasteners 116 driven through fastener holes of the tie plates 114, and railway anchors 114(*a*), 114(*b*) attached to undersides of the rails 108 to anchor the rails to sides the railway ties 110. In some instances, a railway fastener 116 may be a railway spike. In other instances, a railway fastener 116 may be a lag screw or another type of fastener. The depicted examples herein show the railway fastener 116 as a railway spike.

In some embodiments, the component handling system 105-1 may include over-under railway component handling system that includes a tie plate manipulation subsystem 102 (sometimes referenced herein as tie plate manipulator 102) and a fastener-extracting subsystem 106 (sometimes referenced herein as fastener extractor 106). The tie plate manipulation subsystem 102 and the fastener-extracting subsystem 106 may be configured in an over-under arrangement such that the tie plate manipulation subsystem 102 is disposed generally under the fastener-extracting subsystem 106. This configuration may allow tandem operation of the tie plate manipulation subsystem 102 and the fastener extractor 106. As such, the tie plate manipulation subsystem 102 and the fastener extractor 106 may operate in a single plane such that the tie plate manipulation subsystem 102 and the fastener-extracting subsystem 106 may have the same or substantially the same centerline. In operation, the component handling system 105-1, once positioned over a given railway tie 110, may utilize the fastener extractor 106 to extract one or more railway fasteners 116 from the railway tie 110. Then, without any repositioning or without significant repositioning along the rail 108—and with minimal transition time—the component handling system 105-1 may utilize the tie plate manipulator 102 to manipulate the tie plate 114. Specifically, the tie plate manipulator 102 may be lowered to engage the tie plate 114. Further, the tie plate manipulator 102 may then adjust the railway anchors 114(*a*), 114(*b*)—again, without any or without significant repositioning along the rail 108 and with minimal transition time to perform the adjustment operations. Such positioning, along with any other positioning, faster-removal, anchor adjusting, and fastener driving operations disclosed herein, may be directed by an operator and/or may be directed by the control system 401 based at least in part on the sensor feedback described herein.

Materials for various structural components of the component handling system 105-1 may be selected such that the structural components can generate necessary forces to move railway components in accordance with various embodiments disclosed herein, while safely withstanding stresses imparted to the structural elements of the system from those aforementioned forces. Said materials may include structural quality alloy steels with medium to high carbon content and may involve certain heat treatment and tempering to produce components with the necessary strength.

While disclosed embodiments of the component handling system 105-1 are illustrated as an example, the component handling system 105-1 may include other types of railway machinery and workheads not shown. Other embodiments, for example, may include spike-driving workheads, railway anchor installation workheads, and/or any other suitable type of railway installation and/or maintenance machinery. In various embodiments, the component handling system 105-1 may be adapted for conjunction with a variety of railway workheads.

The component handling system 105-1 may be coupled to a motorized railway maintenance vehicle. The railway maintenance vehicle may include an engine, a chassis, wheels for traversing along one or more of the rails 108, and other suitable components known to a person of ordinary skill in the art. Accordingly, the railway maintenance vehicle may include an operator cab, station, or other area with control elements of a control system that allow for control of the railway maintenance vehicle. The railway maintenance vehicle may be any suitable vehicle adapted for coupling to the component handling system 105-1.

The component handling system 105-1 may be configured to mechanically connect to other equipment not shown, such as a railway maintenance vehicle or other intermediary components such as a frame coupling the workhead of the component handling system 105-1 to the railway maintenance vehicle, via a dual-shaft support assembly 170. As depicted, for example, the dual-shaft support assembly 170 may include two, parallel support shafts 172, 174. Each support shaft 172, 174 may be configured for attachment at each end of the shaft to the other equipment not shown. The rest of the workhead may be pivotably coupled with the support shaft 172, 174 by way of dual slidable frame couplings 176, 178. For example, in some embodiments, bracket arms of the dual slidable frame couplings 176, 178 may be pivotably coupled with the frame assembly 126 by way of suitable pin-and-bore couplings. The dual slidable frame couplings 176, 178 may be adapted to allow the rest of the workhead to be slidably coupled with the support shafts 172, 174.

One or more support shaft cylinders 180 may be coupled with one or both of the support shafts 172, 174 and the other equipment not shown. The depicted example illustrates a single lateral adjustment cylinder 180 coupled with the support shaft 174 at one end of the lateral adjustment cylinder 180, with the other end of the lateral adjustment cylinder 180 configured for attachment to the other equipment not shown. The lateral adjustment cylinder 180 may be adapted to selectively extend and retract in order to selectively push or pull to move the slidable frame couplings 176, 178 along the support shafts 172, 174 by direction of the control system 401 based at least in part on the sensor feedback described herein. With such action, all the workhead components coupled to the slidable frame couplings 176, 178, including the tie plate manipulator 102 and the fastener extractor 106, may be positioned along a plane that is parallel or substantially parallel to the rail 108. In operation, once the workhead is positioned generally over a given railway tie 110 with other equipment by direction of the control system 401 based at least in part on the sensor feedback described herein, the lateral adjustment cylinder 180 may be actuated to further refine the positioning of the workhead that is supported by the slidable frame couplings 176, 178. Such positioning may be directed by an operator and/or may be directed by control system 401 based at least in part on the sensor feedback described herein.

Such lateral positioning may also be relegated to one or more initial positioning refinement stages. Further lateral positioning of the tie plate manipulator 102 and the fastener extractor 106 may be effected by way of other actuators disclosed further herein, such as a double-rod cylinder 152 and actuators of an adjuster cylinder subassembly 124. However, some embodiments may utilize the lateral adjustment cylinder 180 in conjunction with the double-rod cylinder 152 and actuators of an adjuster cylinder subassembly 124 during adjustment operations even after the initial positioning of structure supported by the slidable frame couplings 176, 178. The various positioning operations may provide an extended range of movement for the adjustment operations and may be directed by control system 401 based at least in part on the sensor feedback.

The component handling system 105-1 may include a rigid, metal frame assembly 126. As depicted, the frame assembly 126 may be an assembly of components. Other frame configurations may be included in other embodiments. The component handling system 105-1, including the frame assembly 126, its forward leg 128, rear leg 130, and linkages, may be fabricated to possess material strength and overall structural strength to generate and accommodate the forces involved to adjust tie plates 114, railway anchors 114(*a*), 114(*b*), and to extract railway fasteners 116 from railway ties 110.

In addition to facilitating lateral movement of the workhead, the dual-shaft support assembly 170 may facilitate vertical movement of the workhead. One or more workhead lift cylinders 182 may be pivotably coupled with one or both of the support shafts 172, 174 and the frame assembly 126. The depicted example illustrates a single workhead lift cylinder 182 coupled with the slidable frame coupling 176 at one end of the workhead lift cylinder 182, with the other end of the workhead lift cylinder 182 coupled to the frame assembly 126.

The workhead lift cylinder 182 may be adapted to selectively extend and retract in order to selectively push or pull to move the frame assembly 126 and the rest of the workhead via the slidable frame couplings 176, 178, which may correspond to dual pivotable linkages, by direction of the control system 401 based at least in part on the sensor feedback described herein. The workhead lift cylinder 182 may be oriented to have a line of action such that actuation of the workhead lift cylinder 182 forces the slidable frame couplings 176, 178 to pivot with respect to the support shafts 172, 174. In some embodiments, the bracket arms of the slidable frame couplings 176, 178 may be maintained in parallel orientation or substantially parallel orientation with respect to one another throughout the movements. Additionally, the vertical orientation of the workhead may be maintained throughout the movements.

The tie plate manipulator 102 and the fastener extractor 106 may be slidably coupled to the frame assembly 126. As in the depicted example, the frame assembly 126 may include a forward leg 128 that is connected to a roller assembly that is disposed in a forward position. The references to forward are with respect to one direction of travel of the component handling system 105-1 along the rail 108, however the component handling system 105-1 is moveable in the reverse direction. The frame assembly 126 may further include a rear leg 130 that is connected to a roller assembly 131 that follows the forward leg 128 along the direction of travel.

Figure 2B:
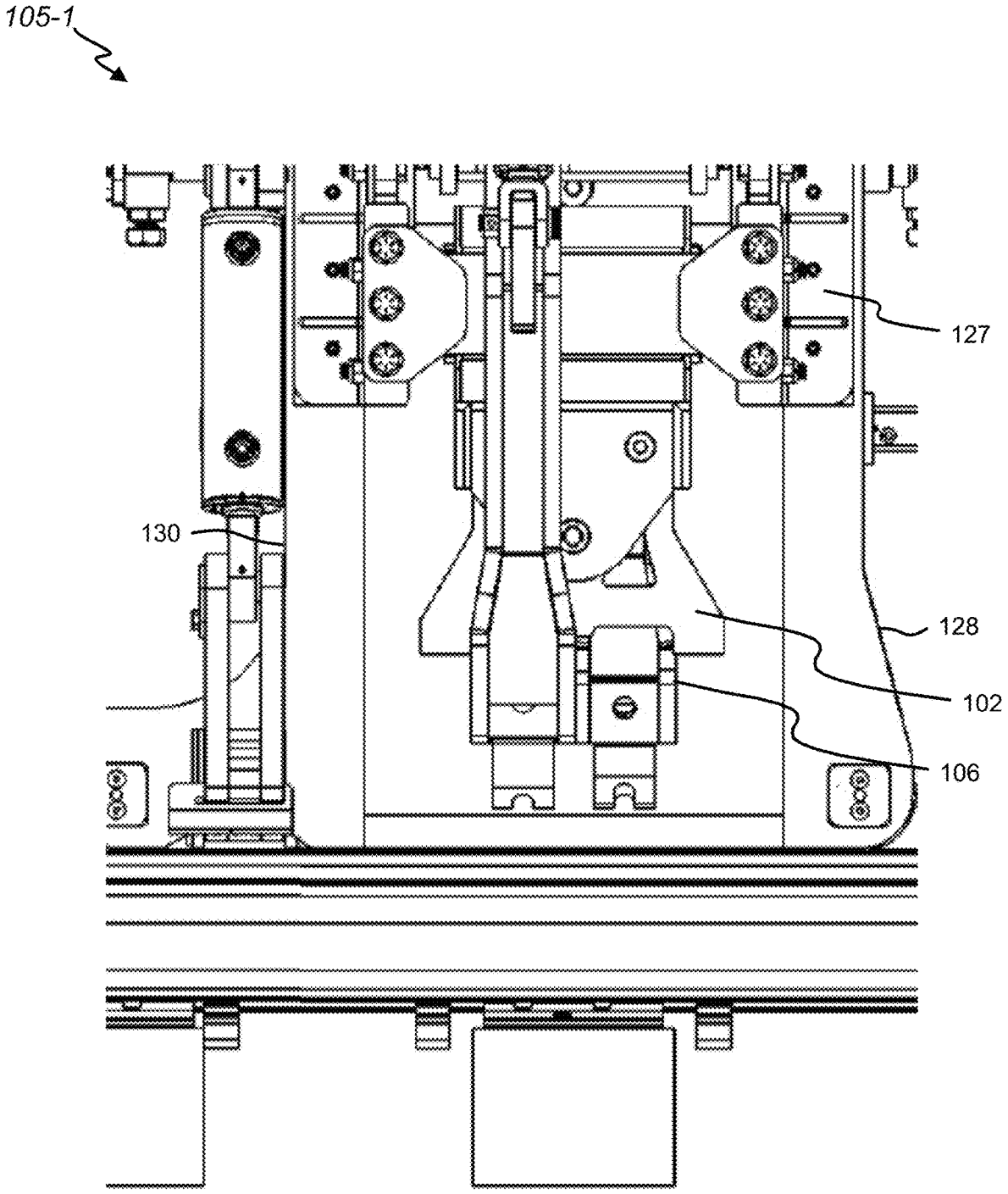
FIG. 2B depicts a partial side view of the single-plane multi-functional railway component handling system with the tie plate manipulation subsystem and the fastener extractor in stowed positions, in accordance with disclosed embodiments of the present disclosure.

FIG. 2B depicts a partial side view of the single-plane multi-functional railway component handling system 105-1 with the tie plate manipulation subsystem 102 and the fastener extractor 106 in stowed positions, in accordance with disclosed embodiments of the present disclosure. As in the depicted example, the tie plate manipulator 102 may be slidably connected to the frame assembly 126 via a dual-slide frame coupling 127. The dual-slide frame coupling 127 may allow the tie plate manipulator 102 to slide along the rear leg 130 and the forward leg 128 when raised and lowered by actuation of one or more lift cylinders coupled to the tie plate manipulator 102.

The rearward position of the rear leg 130 may accommodate a rail clamp assembly 125 of the workhead that is integrated into the rear leg 130. The roller assembly 131 may include a roller to contact the rail 108 and facilitate movement of the component handling system 105-1 along the rail 108. Thus, the frame assembly 126, including the forward leg 128 and the rear leg 130 may provide a rigid guide structure for the tie plate manipulator 102 and the fastener extractor 106 to slide vertically for various operations and for housing the roller which allows the frame assembly 126 to roll along the top of the rail head of the rail 108 during use.

Figure 2C:
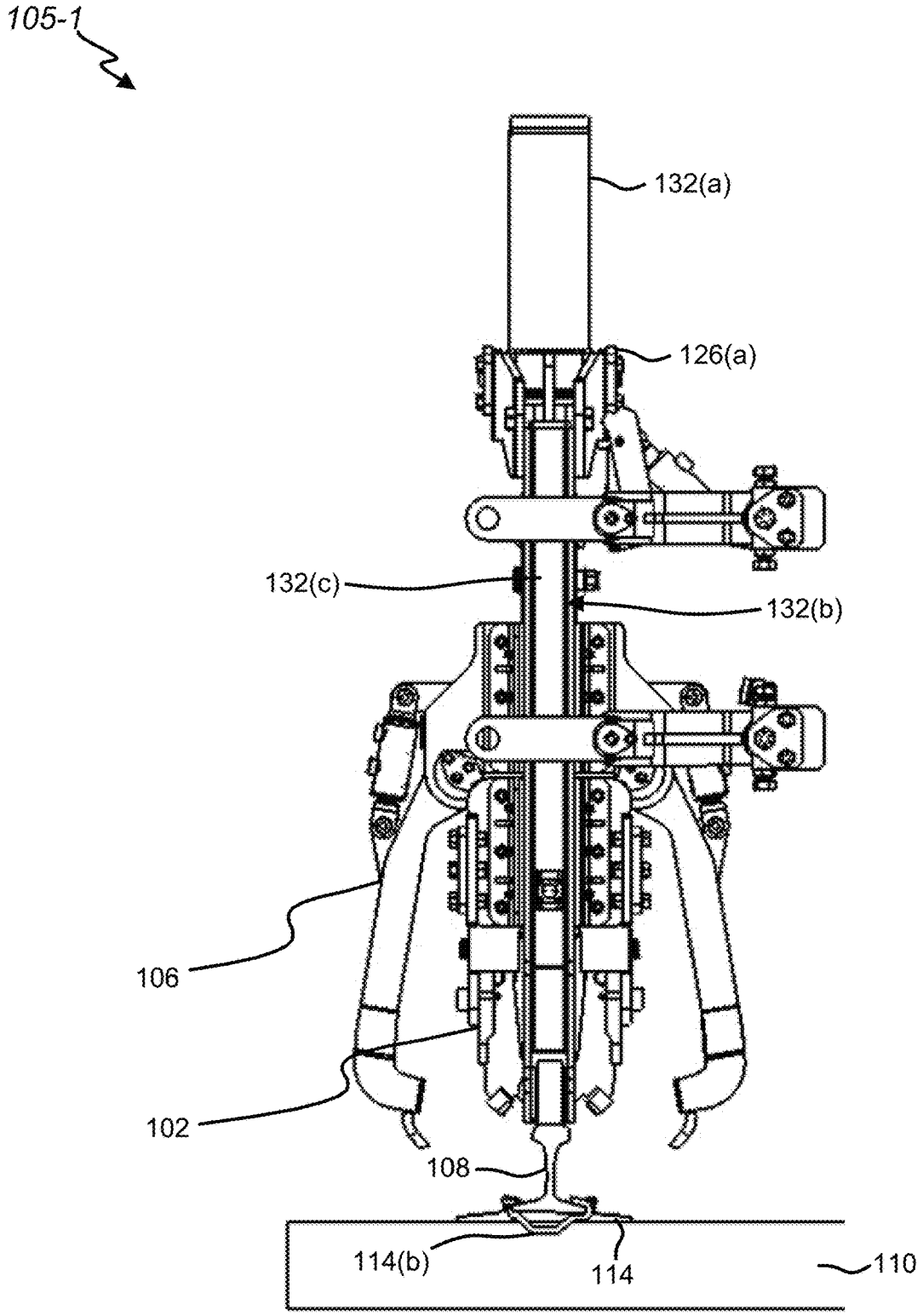
FIG. 2C depicts a partial end view of the single-plane multi-functional railway component handling system with the tie plate manipulation subsystem in a stowed position and the fastener extractor in a ready position, in accordance with disclosed embodiments of the present disclosure.
Figure 2D:
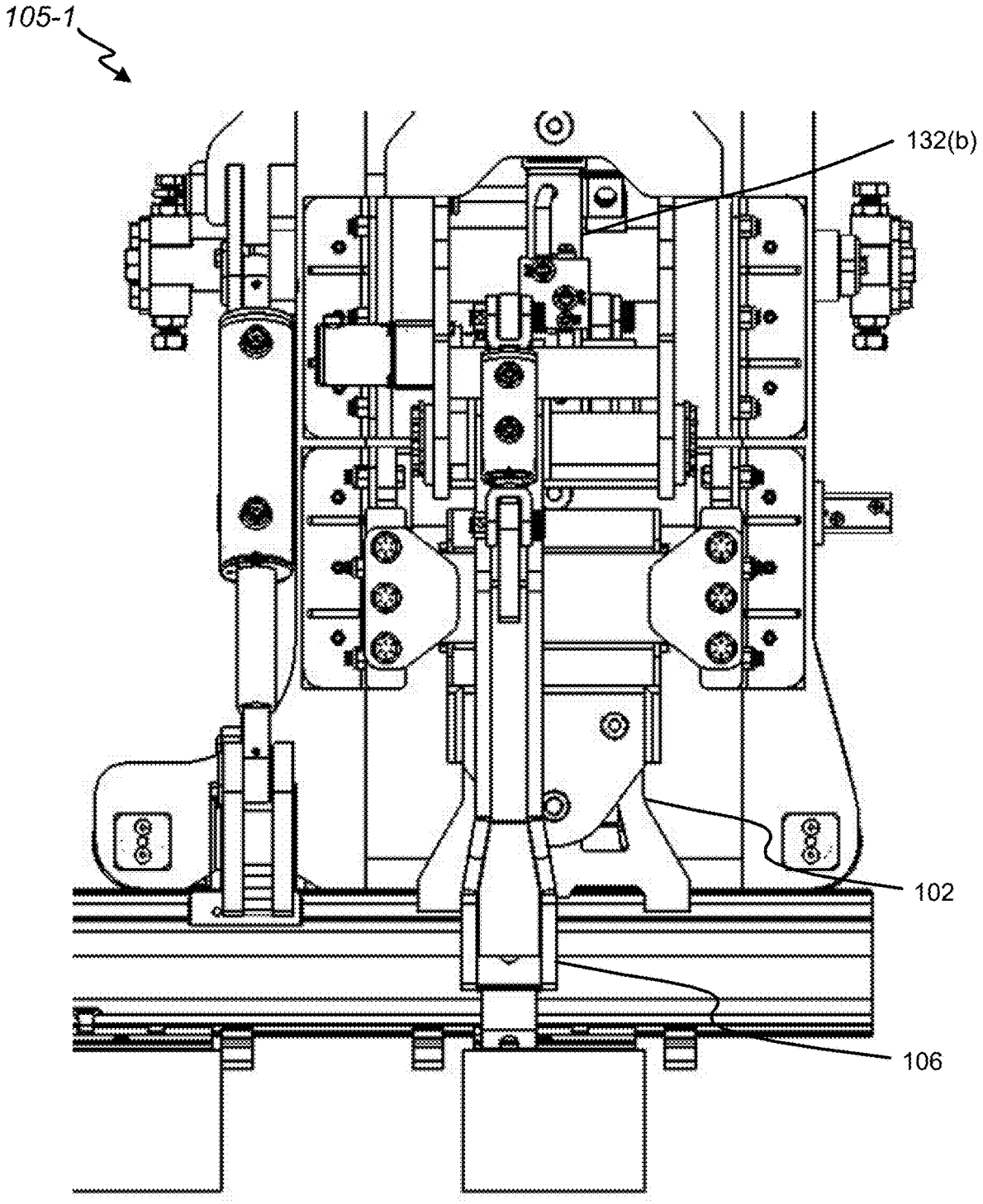
FIG. 2D depicts a partial side view of the single-plane multi-functional railway component handling system with the fastener extractor in a deployed position while the tie plate manipulation subsystem remains in a ready position, in accordance with disclosed embodiments of the present disclosure.

FIG. 2C depicts a partial end view of the single-plane multi-functional railway component handling system 105-1 with the tie plate manipulation subsystem 102 in a stowed position and the fastener extractor 106 in a ready position, in accordance with disclosed embodiments of the present disclosure. FIG. 2D depicts a partial side view of the single-plane multi-functional railway component handling system 105-1 with the fastener extractor 106 in a deployed position while the tie plate manipulation subsystem 102 remains in a ready position, in accordance with disclosed embodiments of the present disclosure. Other embodiments may be configured to utilize other stowed positions and/or other ready positions.

By direction of the control system 401 based at least in part on the sensor feedback described herein, the tie plate manipulation subsystem 102 and/or the fastener extractor 106 may be lowered to a working position with each set of one or more components associated with each railway tie 110, and may be raised to a stowed position or another position suitable for transition between railway ties 110 to create or increase clearance with respect to railway components. Such embodiments may allow for increased adaptability to a variety of working conditions. However, disclosed embodiments may allow for the tie plate manipulator 102 to remain in a lowered working position or to be partially raised as the component adjustment system 105-1 transitions between railway ties 110 to make component adjustments associated with a plurality of railway ties 110. Such embodiments may allow for increased speed and efficiency in making component adjustments with respect to a large number of railway ties 110. Some of such embodiments may include adjusting fastener-extracting arms 120 to an outward state away from the rail 108 to create or increase clearance with respect to railway components to accommodate transitions between railway ties 110 while the fastener extractor 106 remains in a lowered working position.

The system 105-1 may include a multiple actuator system, which may correspond to a multiple cylinder system. The multiple cylinder system may include one or more lift cylinders coupled in tandem. For example, one or more lift cylinders 132 (*a*) may be arranged to raise and lower the tie plate manipulator 102 and the fastener extractor 106 together, such that the tie plate manipulator 102 and the fastener extractor 106 selectively slide with respect to the frame assembly 126 toward and away from the rail 108. Accordingly, the tie plate manipulator 102 and the fastener extractor 106 may be raised and lowered through a range of retracted and extended positions to allow vertical positioning of the tie plate manipulator 102 and the fastener extractor 106 with respect to the frame assembly 126 toward and the rail 108. In some embodiments, the housing of the lift cylinder 132 (*a*) may be fixedly attached to an upper portion 126 (*a*) of the workhead frame assembly 126. The rod of the lift cylinder 132 (*a*) may be fixedly attached to an extractor frame assembly 106 (*a*) of the fastener extractor 106. For example, the rod may be anchored to a pin of the extractor frame assembly 106 (*a*). Additionally, the multiple cylinder system may include one or more additional lift cylinders 132 (*b*) adapted to extend and retract to raise and lower the tie plate manipulator 102 independently of the fastener extractor 106 through a range of retracted and extended positions. The depicted example includes one lift cylinder 132 (*a*) coupled with an additional lift cylinder 132 (*b*) in tandem such that each shares a longitudinal axis. Hence, the multiple cylinder system 142 may include a tandem cylinder system.

One end of the lift cylinder 132(*b*) may be coupled to the extractor frame assembly 106 (*a*). In some embodiments, the lift cylinder 132(*b*) may be coupled to the extractor frame assembly 106 (*a*) by way of suitable pin-and-bore couplings. The other end of the lift cylinder 132(*b*) may be coupled to the tie plate manipulator 102. For example, the lift cylinder 132(*b*) may be coupled to brackets of the frame assembly of the tie plate manipulator 102. In some embodiments, the lift cylinder 132(*b*) may be coupled to the frame assembly of the extractor frame assembly 106 (*a*) by way of suitable pin-and-bore couplings.

In some embodiments, the system 105-1 may include, for example, slide components with one or more attachments. In various embodiments, the tie plate manipulator 102 may be attachable to a variety of equipment, frames, workheads, and/or the like, for example, at least in part via an attachment of the lift cylinder 132 (*a*) and one or more attachments of the slide components. The lift cylinders 132 (*a*), 132 (*b*) and/or other cylinders/actuators in various embodiments described herein may correspond to any one or combination of hydraulic actuators, pneumatic actuators, electric actuators, and/or the like to extend and retract in accordance with disclosed embodiments, and may be referenced herein as power cylinders or actuators. The actuators/cylinders of the system 105-1 may each include control ports for connection to control lines (hydraulic, pneumatic, electrical, etc., in various embodiments) and connection to the control system 401. In some embodiments, control valves with solenoids and electrical connections may connect to one or more main processors of the control system 401 that may be located at the operator station or at any suitable place.

In some embodiments, when transitioning from and to the stowed or undeployed state, the tie plate manipulator 102 and the fastener extractor 106 may be coupled such that the tie plate manipulator 102 and the fastener extractor 106 move together, being lowered or raised together. For example, when the fastener extractor 106 moves from a stowed position to a deployed position, the tie plate manipulator 102 may likewise move from a stowed position to an undeployed position. As disclosed above, the one or more additional cylinders 132(*b*) may be further adapted to raise and lower the tie plate manipulator 102 independently from the fastener extractor 106. For example, from the undeployed position, the tie plate manipulator 102 may transition to a deployed position to engage a tie plate 114.

Figure 2E:
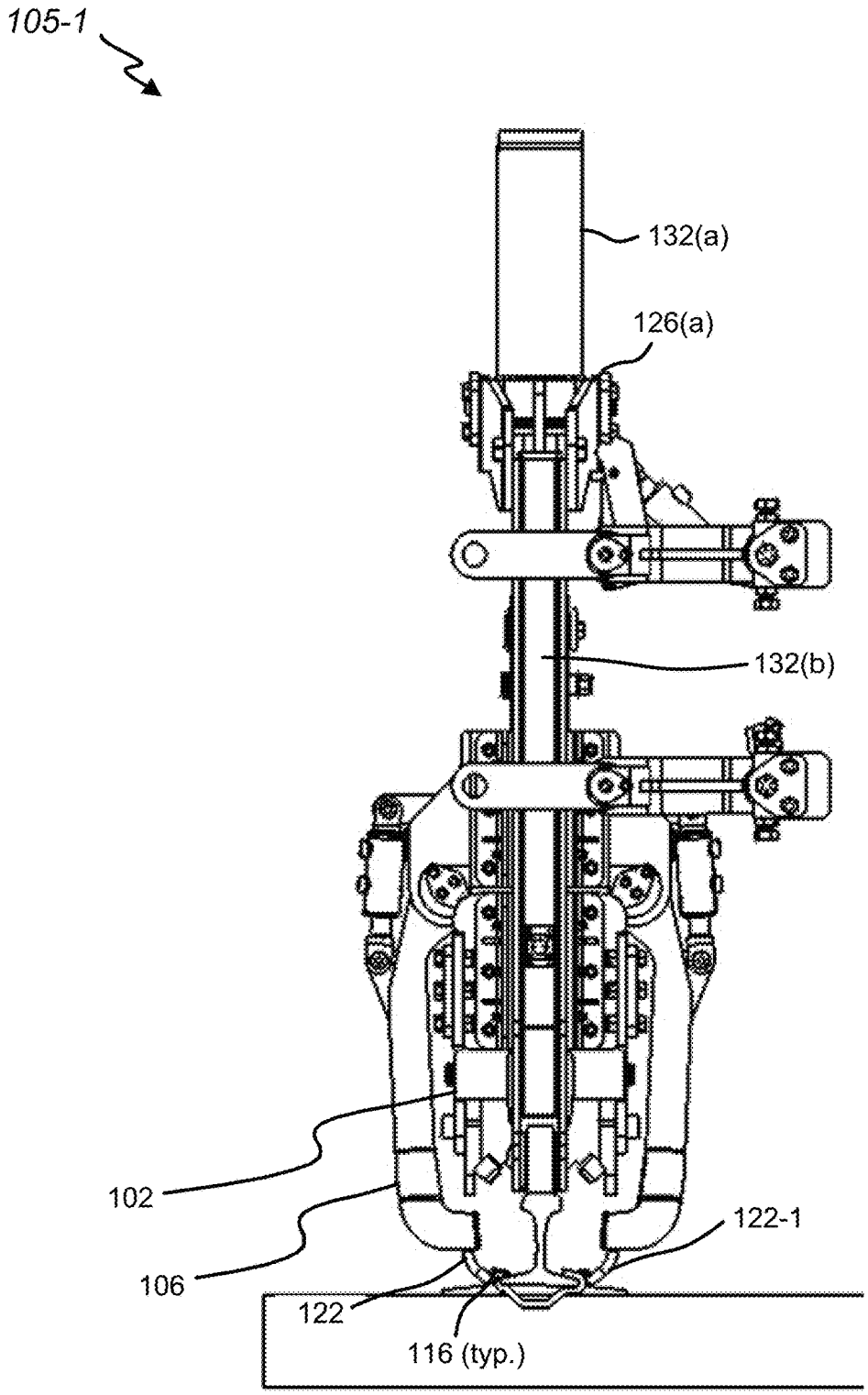
FIG. 2E depicts a partial end view of the single-plane multi-functional railway component handling system with the fastener extractor initially engaging railway fasteners, in accordance with disclosed embodiments of the present disclosure.

FIG. 2E depicts an end view of the single-plane multi-functional railway component handling system 105-1 with the fastener extractor 106 initially engaging railway fasteners 116, in accordance with disclosed embodiments of the present disclosure. The fastener-extracting operations may include steps of lowering fastener extracting heads 122 via operation of one or more of the lift cylinders 132(*a*), 132(*b*) to a level of the fastener 116, closing in toward the rail 108 to engage a head of the fastener 116 with a given fastener extracting head 122, raising the fastener 116 out of its fastener hole, releasing the fastener 116, and readjusting the fastener-extracting arm 120 to allow for a subsequent fastener extracting operation directed to another fastener 116.

In some embodiments, the fastener extraction operations may include the lift cylinder 132(*b*) maintaining the tie plate manipulator 102 in a retracted position. At the same time, the lift cylinder 132(*a*) may extend the tie plate manipulator 102 and the fastener extractor 106 together toward the rail 108 to poise the fastener extractor 106 for closing its arms 120 toward the rail 108. After one or more fasteners 116 are engaged with one or more fastener extracting heads 122, the lift cylinder 132(*a*) may retract the tie plate manipulator 102 and the fastener extractor 106 together away from the rail 108 to facilitate the extraction of the one or more fasteners 116 from the railway tie 110.

Figure 2F:
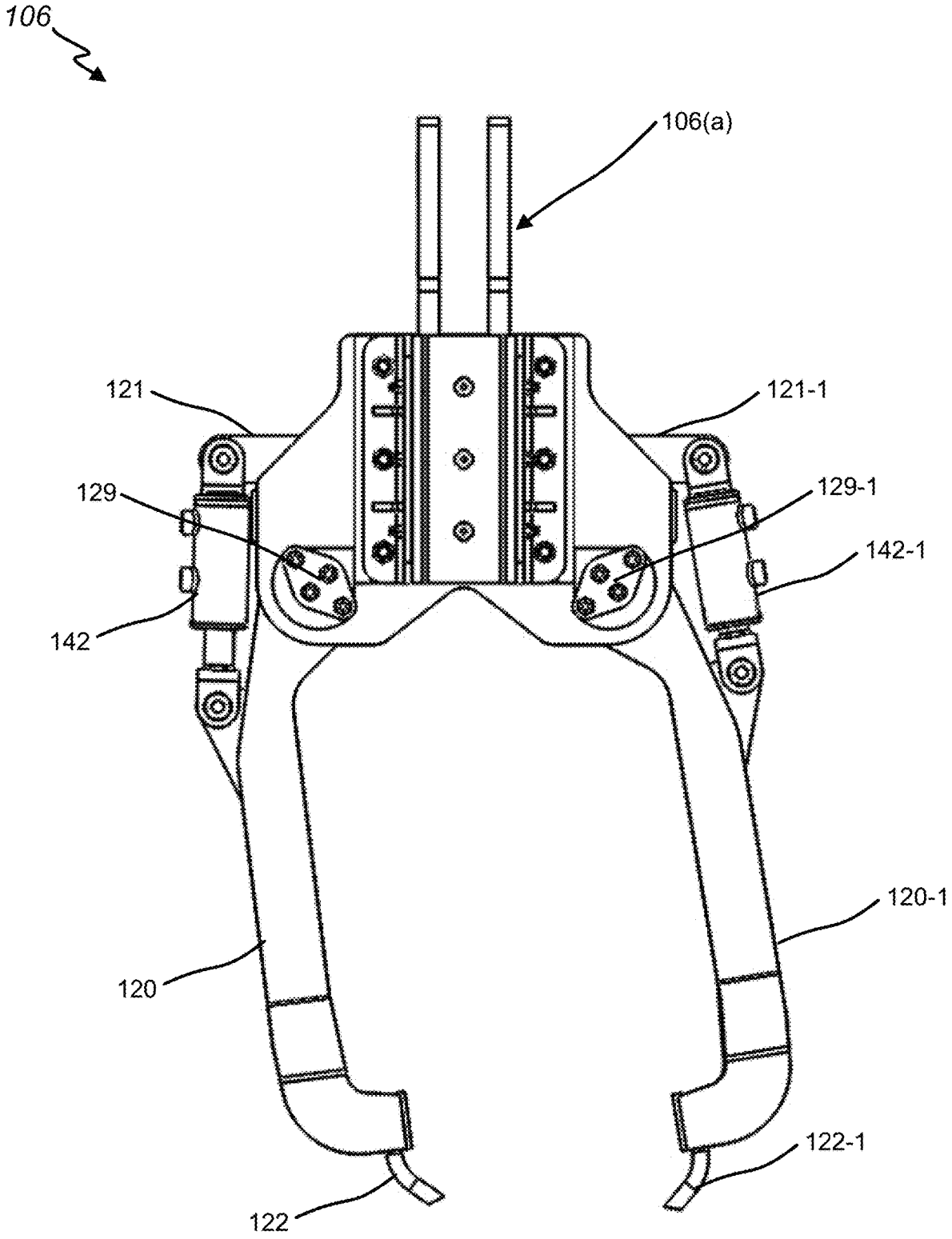
FIG. 2F depicts a partial end view of at least part of the fastener extractor separated from the single-plane multi-functional railway component handling system, in accordance with disclosed embodiments of the present disclosure.
Figure 2G:
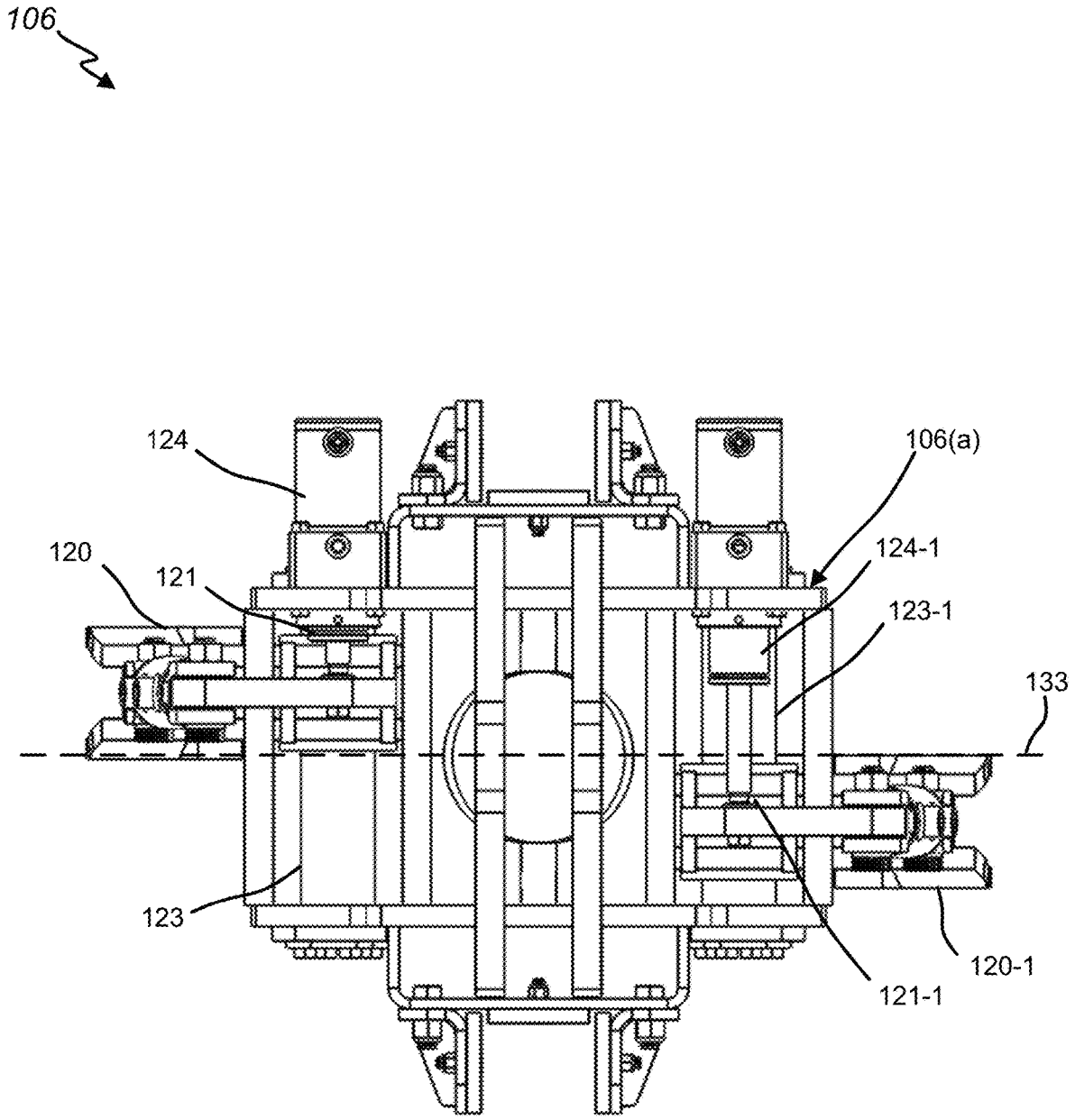
FIG. 2G depicts a partial top view of at least part of the fastener extractor separated from the single-plane multi-functional railway component handling system, in accordance with disclosed embodiments of the present disclosure.

FIG. 2F depicts an end view of at least part of the fastener extractor 106 separated from the single-plane multi-functional railway component handling system 105-1, in accordance with disclosed embodiments of the present disclosure. FIG. 2G depicts a top view of at least part of the fastener extractor 106 separated from the single-plane multi-functional railway component handling system 105-1, in accordance with disclosed embodiments of the present disclosure.

As illustrated in those figures and various other figures, the fastener extractor 106 may include a pair of pivotally mounted fastener-extracting arms 120 configured in an opposing arrangement. In a deployed state, the fastener-extracting arms 120 may be disposed on opposite sides of the rail 108. Each fastener-extracting arm 120 may include a fastener extracting head 122 at a lower end, each head 122 adapted to engage railway fastener 116.

The fastener extractor 106 may include one or more arm pivot cylinders 142 arranged to move each fastener-extracting arm 120 about a respective pivot 129 into a number of different positions. Each pivot 129 may correspond to a pivot joint connected to a sliding arm bracket 121. Each arm pivot cylinder 142 (which may be a short-stroke cylinder in some embodiments) may adapted to selectively extend and retract in order to selectively push or pull the fastener-extracting arm 120 and pivot the fastener-extracting arm 120 about the corresponding pivot point 129. With that pivoting action, the fastener-extracting arm 120 may move along a plane that is perpendicular or substantially perpendicular to the rail 108.

Each fastener-extracting arm 120 may be articulated via a tri-pivot configuration. As illustrated in the depicted example, each arm pivot cylinder 142 may be pivotably coupled with one of the fastener-extracting arms 120 at one end of the arm pivot cylinder 142. Additionally, each arm pivot cylinder 142 may be pivotably coupled with one slidable arm bracket 121 of a pair of slidable arm brackets 121. For example, in some embodiments, the arm pivot cylinders 142 may be pivotably coupled with the fastener-extracting arms 120 and the slidable arm brackets 121 by way of suitable pin-and-bore couplings.

Each arm pivot cylinder 142 may be configured with a separate circuit so that the arm pivot cylinder 142 may move independently of the other arm pivot cylinder 142 of the pair. Thus, each fastener-extracting arm 120 may selectively move independently from the other fastener-extracting arm 120, which may include moving at a different rate than the other fastener-extracting arm 120, as well as simultaneously as the other, which may include each moving at different rates or equivalent rates. With some embodiments, each fastener-extracting arm 120 may be independently directed by the control system 401 to perform fastener extraction according to different patterns of fastener installation in the tie plates 114, which may be different for field-side fasteners 116 and gage-side fasteners 116, from tie plate 114 to tie plate 114, and from track to track.

Further, as illustrated, each fastener-extracting arm 120 may be coupled with a rod subassembly 123 and an adjuster cylinder subassembly 124. Each adjuster cylinder subassembly 124 may include an adjuster cylinder configured to operate to selectively push or pull to slide the corresponding fastener-extracting arm 120 via the slidable arm bracket 121 along a rod of the subassembly 123. In this manner, the fastener-extracting arm 120, the slidable arm bracket 121, and the arm pivot cylinder 142 may be selectively adjusted such that each arm 120 is aligned with each other or offset with respect to each other. This movement may be along planes that are parallel or substantially parallel to the rail 108. In various embodiments, the slidable arm brackets 121 and/or other slidable couplings disclosed herein may include bearings to facilitate movement along respective rods/shafts, in which instances, the movement may correspond to rolling movement rather than sliding movement.

Accordingly, such sliding actions of the fastener-extracting arms 120 in conjunction with the pivoting actions of the fastener-extracting arms 120 may allow for the fastener-extracting arms 120 to perform efficient and substantially simultaneous fastener extraction with respect to multiple fasteners 116 installed in a variety of hole in tie plates 114, which extraction operation, as disclosed herein, may be performed under control of the control system 401. Compound, multi-axial movement of the fastener-extracting arms 120 may be effected with simultaneous actuation of adjuster cylinder subassembly 124, as well as of the arm pivot cylinders 142. Actuation of the adjuster cylinder subassembly 124 and the arm pivot cylinders 142 may move each fastener-extracting arm 120 into a number of different positions to perform fastener extraction in various positions under control of the control system 401 based at least in part on the sensor feedback described herein, which may range, for example, from up against the foot of the rail 108 to several inches away from the rail 108. Such compound, multi-axial movement to adjust to various positions during fastener extraction operations may advantageously increase the speed and efficiency of the process.

Such selective operations may advantageously adapt to a variety of different fastener patterns that may be encountered in the field. Such selective operations, as with all adjustments/operations of the component handling system 105-1, may be autonomously performed by the system 105-1 by direction of the control system 401 based at least in part on the sensor feedback described herein, and/or initiated remotely by an operator. With the autonomous mode, the system 105-1 may automatically detect a given fastener pattern with one or more sensors and operate the arms 120 to match the fastener patterns and perform fastener extraction. The control system 401 may independently direct each fastener-extracting arm 120 to adjust and perform fastener extraction according to the most efficient pattern for the particular fastener layout detected.

Various embodiments may include a plurality of sensors (e.g., one or a combination of position sensors, measurement sensors, distance sensors, proximity sensors, cameras for optical recognition, image analysis, metrics, and recognition, motion sensors, light sensors, ambient light photo sensors, photodiode photo sensors, optical detectors, photo detectors, color sensors, and/or the like) in order to facilitate operations, such as automatic alignment of the fastener-extracting arms 120 and the tie plate manipulator 102 with railway components (e.g., fasteners, anchors, tie plates, and/or railway ties), automatic fastener extraction, automatic tie plate and anchor adjustment, and other adjustment operations disclosed herein, any one or combination of which operations may be performed under control of the control system 401. One or more of the sensors may be attached to any suitable element of the component handling system 105-1 and disposed to capture data indicative of the positioning and/or other characteristics of aspects of the fastener-extracting arms 120, the tie plate manipulator 102, the fasteners 116 and fastener patterns, the tie plates 114, holes in the tie plates 114, the anchors 114(*a*), 114(*b*), the ties 110, and/or the rail 108. By way of example, one or more sensors (e.g., a linear variable differential transformer (LVDT) sensor) may be coupled to the cylinders of the adjuster cylinder subassembly 124 and arm pivot cylinders 142 to detect positioning of the respective cylinders. Likewise, one or more sensors (e.g., LVDT sensors) may be coupled to each of the other cylinders of the component handling system 105-1, such as cylinders 132(*a*), 132(*b*), to detect positioning of the respective cylinders. Disclosed embodiments may learn and infer positions of fasteners 116 in tie plates 114 based at least in part on the detected positions of the cylinders, with sensors having sensor sensitivity within a few thousandths of an inch. Additional disclosed embodiments may utilize such position sensors in conjunction with other types of sensors, such as one or a combination of the sensor types above, to learn and detect positions of fasteners 116, as well as other aspects described further herein. In alternative embodiments not depicted, one or more of the cylinders of the system 105-1 may correspond to trunnion-mounted cylinders. One or more of the sensors may be coupled to base ends of the trunnion-mounted cylinders to facilitate serviceability. This may allow for ease of maintenance, such that one or more of the sensors may be replaced without having to replace entire cylinders.

One or more sensors may be disposed on the workhead to have various fields of view to detect various features such as positions, surfaces, edges, contours, relative distances, and/or any other suitable indicia of the elements of the system 105-1 (e.g., the fastener-extracting arms 120 and the tie plate manipulator 102) and/or railway components (e.g., fasteners, anchors, tie plates, and/or railway ties). For example, the one or more sensors may include one or more cameras attached to the frame assembly 126 to have fields of view and capture images and/or other indicia of various aspects of the railway ties 110, the tie plates 114, the holes of the tie plates 114, and/or the rail 108. The one or more sensors may be attached to the forward leg 128, the rear leg 130, and/or a component of the upper structure of another part of the workhead.

Each of the sensors of disclosed embodiments may be communicatively coupled to a receiver of the control system 401 via wired or wireless communication channels. The sensors, receiver, and/or control system 401 may include any suitable sensors, controller(s), processor(s), memory, communication interface(s), and other components to facilitate various embodiments disclosed herein. The sensors, receiver, and/or control system 401 may include any sensor circuitry necessary to facilitate the various embodiments, including without limitation any one or combination of analog-to-digital converter circuitry, multiplexer circuitry, amplification circuitry, signal conditioning/translation circuitry, and/or the like. The data captured by the one or more sensors may be used by the control system 401 to detect positioning and facilitate system-directed positioning, extraction, and adjustment operations of the fastener extractor 106 and the tie plate manipulator 102.

Further, some embodiments may provide for automatic balancing or rebalancing of load with respect to the fastener-extracting arms 120 by direction of the control system 401 based at least in part on the sensor feedback described herein. In such embodiments, the system 105-1 may detect, with one or more sensors such position, torque, load sensors, or other sensors disclosed herein, an off-balance loading situation caused by positions of the fastener-extracting arms 120. For example, an off-balance loading situation may occur when both fastener-extracting arms 120 are positioned too much toward the same side. If such an off-balance load is detected, the system 401 may override previous positioning directions and rebalance the fastener-extracting arms 120 by repositioning one or both arms 120 until a satisfactory balance threshold is satisfied. In some embodiments, off-balance loads may be preemptively avoided by the system 105-1. For example, when one arm 120 is positioned beyond a certain distance (absolute distance from a reference point of the fastener extractor 106 or a relative distance with respect to the other arm 120), the system 105-1 may automatically move one or both arms to avoid an off-balance load.

Such independent operation may be advantageous in a number of ways. For example, some railway fasteners 116 may not be symmetrically installed on each side of a rail 108 such that symmetrical operation of the arms is not necessary. Moreover, the asymmetrical operation of the fastener-extracting arms 120 may adapt to asymmetrical installations of railway fasteners 116, while efficiently avoiding unnecessary operations and adjustments. Further, in some instances, the obstructions such as railway components, electrical boxes, or other obstructions may create tight working spaces. Advantageously, the fastener-extracting arms 120 may asymmetrically adapt to avoid such obstructions and/or maneuver within such tight spaces.

In some embodiments, the fastener extractor 106 may operate in a mode where the fastener-extracting arms 120 always move simultaneously in a manner that maintains a balanced state. With that mode of operation, when one arm 120 moves one direction at a particular rate, the other arm 120 may move in the same or opposite direction at the same rate. The simultaneous movement of the arms 120 may maintain positional symmetry with respect to a distance between centerlines of the arms 120 and a centerline 133 of the fastener extractor 106. Stated otherwise, the centerlines of the arms 120 may be maintained at the same distance from the centerline 133 of the fastener extractor 106, even though the arms 120 may be on opposite sides of the centerline 133. To facilitate such an operational mode, some embodiments may employ a shared fluid configuration, where the two adjuster cylinder subassemblies 124 share the same volume of hydraulic fluid. Advantageously, when the system 105-1 is positioned over a particular railway tie plate 114, the fastener extractor 106 and the tie plate manipulator 102 may be adapted to share the same centerline 133 so that each are efficiently aligned with the tie plate 114, thereby eliminating or at least minimizing any need for modifying alignment between operations of the fastener extractor 106 and the tie plate manipulator 102. Thus, when the fastener extractor 106 has completed extraction operations over the particular tie plate 114, the tie plate manipulator 102 may be already aligned with the tie plate 114 so that the tie plate manipulator 102 may be lowered straight down to engage the tie plate 114 without any additional adjustment to the alignment. Such a mode of operation may be selectable in disclosed embodiments. To further illustrate that advantageous auto-alignment, the centerline 133 is depicted. Accordingly, in some embodiments, the centerline 133 may be shared by the fastener extractor 106 and the tie plate manipulator 102. In the deployed position, the tie plate manipulator 102 may be engaging, or may be positioned to engage, the tie plate 114. As illustrated, one or more tie plate tools 140 of the tie plate manipulator 102 may be formed to straddle the tie plate 114.

The tie plate tools 140 may be designed to directly contact/engage surfaces of the railway anchors 114(*a*), 114(*b*) and the tie plate 112 in order to transmit force to and move the railway anchors 114(*a*), 114(*b*) and/or the tie plate 112 along the underside of the rail 108 away from a vertical face of the railway tie 110. A set of the tie plate tools 140 may correspond to a pair of the tie plate tools 140 connected to act as one: one tie plate tool 140 of the pair may be positioned on the gage side of the rail 108 and the other tie plate tool 140 of the pair may be positioned on the field side of the rail 108. The tie plate manipulator 102 may perform a sequence of operations to move the tie plate 114 and thereby move the railway anchors 114(*a*), 114(*b*) attached to the rail 108.

Such embodiments may solve the problem of how to move the railway anchors 114(*a*), 114(*b*) when there is little or no gap between the railway anchors 114(*a*), 114(*b*) and the railway tie 110. With the tie plate manipulator 102, precise placement of tool portions need not be placed in that small or absent gap in order to make adjustments. One advantage of disclosed embodiments according to the present disclosure is that the embodiments facilitate railway component adjustments regardless of the size of the gap.

More specifically, movement of the rail anchors in this method may be accomplished using the tie plate 112 by pushing the tie plate 112 till the tie plate 112 makes contact with one of the railway anchors 114(*a*), 114(*b*), then pushing the tie plate 112 a small distance further in order to displace the railway anchors 114(*a*), 114(*b*) away from the tie faces a prescribed distance (e.g., approximately up to one to two inches, or more). Forward and rear railway anchors 114(*a*), 114(*b*) may be moved in succession using the tie plate 112, in that order and/or in reverse order in various embodiments.

With such a method, the tie plate 112 may be initially present in its original position between the railway anchors 114(*a*), 114(*b*) because the railway tie 110 has not been disturbed. The tie plate tool 140 may be depicted in one example addressing position to engage the tie plate 112 when the tie plate 112 is initially present in its original position. From that addressing position with the tie plate tool 140 engaging the tie plate 112, the tie plate manipulator 102 may push the tie plate 112 and the railway anchor 114(*a*) rearward.

Figure 2H:
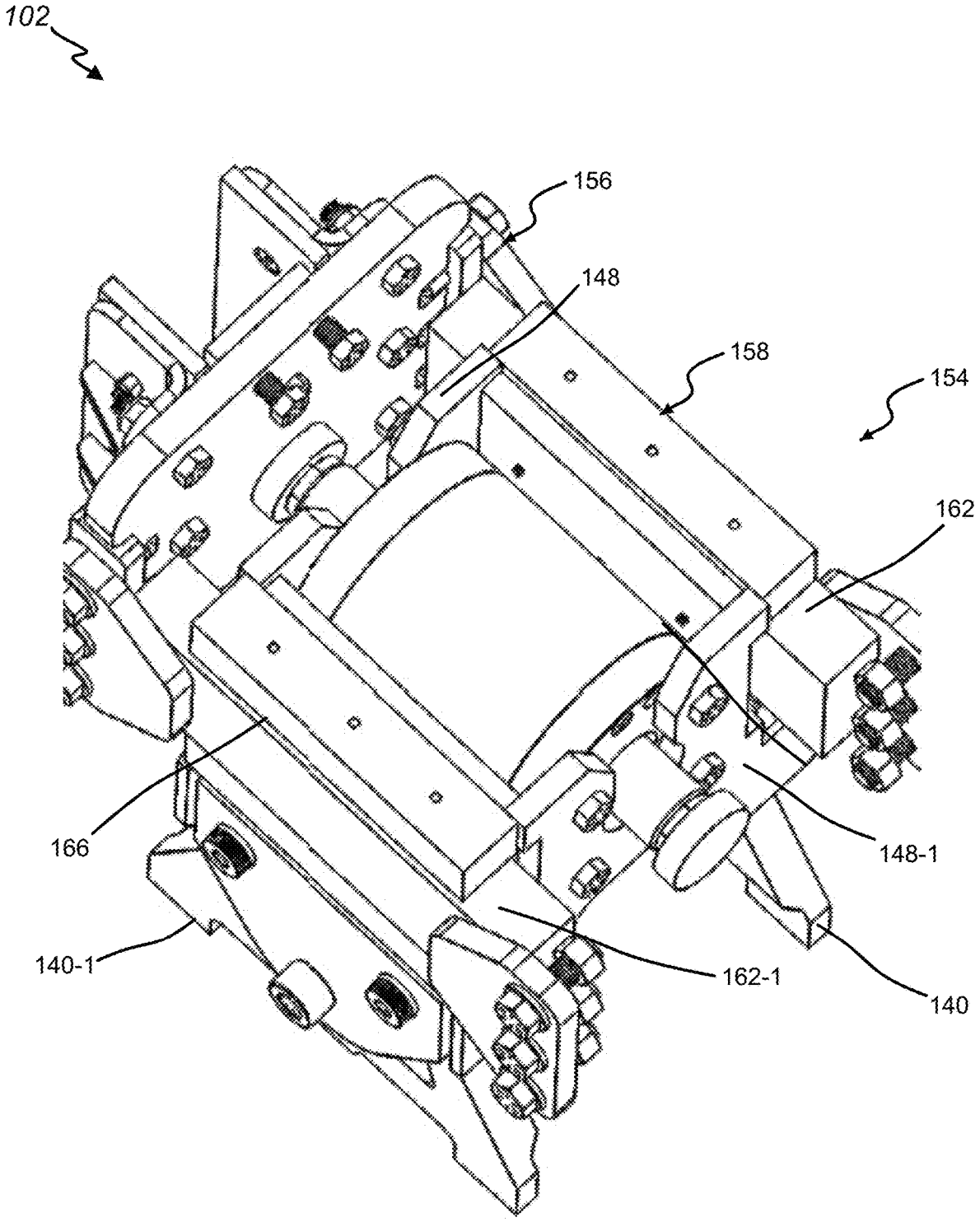
FIG. 2H depicts a partial perspective view of at least part of the tie plate manipulator separated from the single-plane multi-functional railway component handling system, in accordance with disclosed embodiments of the present disclosure.
Figure 2I:
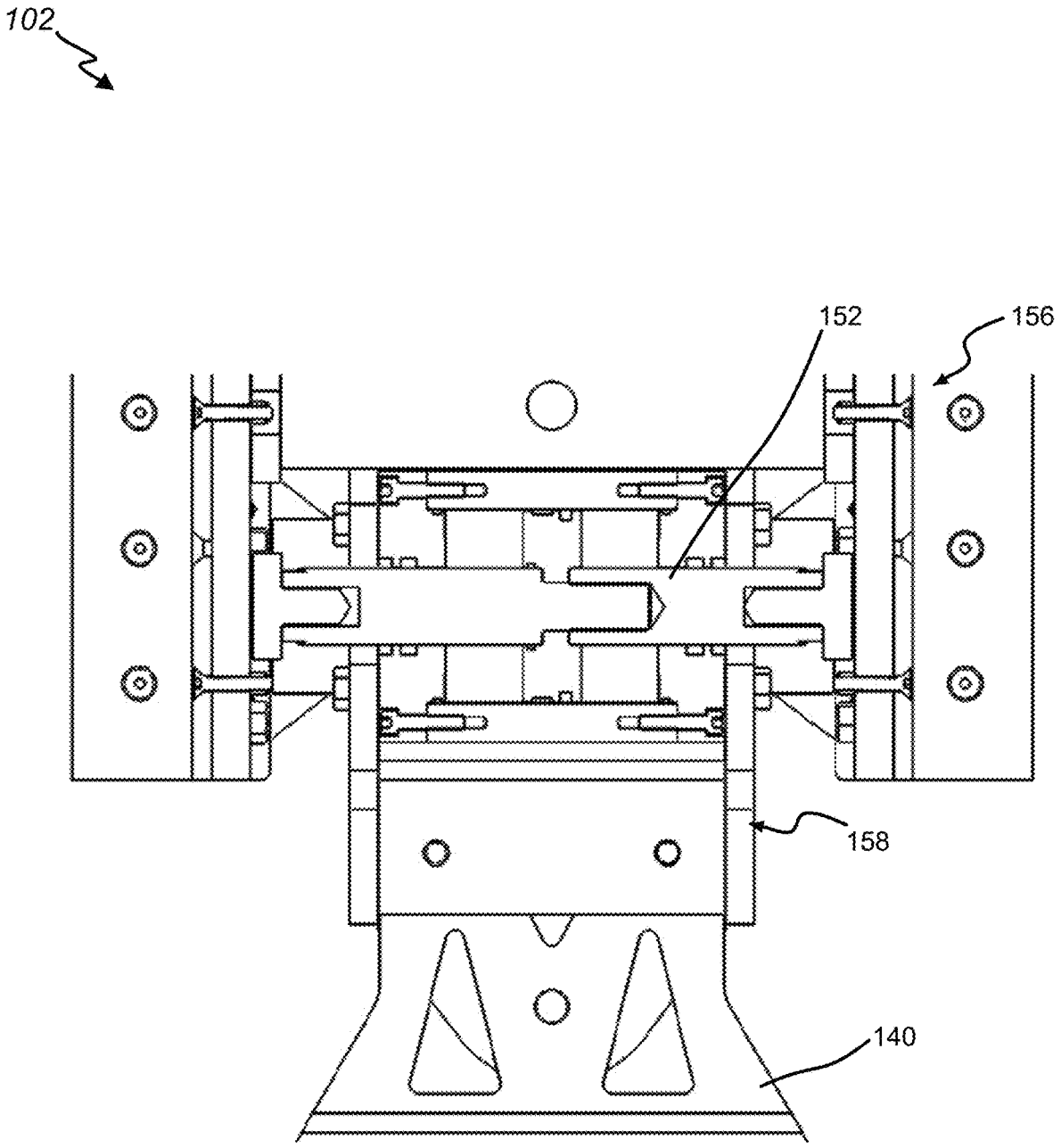
FIG. 2I depicts a side of a partial cross-section of at least part of the tie plate manipulator, in accordance with disclosed embodiments of the present disclosure.

FIG. 2H depicts a partial perspective view of the tie plate manipulator 102 separated from the single-plane multi-functional railway component handling system 100, in accordance with disclosed embodiments of the present disclosure. FIG. 2I depicts a side of a partial cross-section of at least part of the tie plate manipulator 102, in accordance with disclosed embodiments of the present disclosure. The tie plate manipulator 102 may include a slide assembly 154 that includes a support framework 156 arranged to provide guidance and support to a slide subassembly 158 while allowing travel of the slide subassembly 158 with respect to the support framework 156. The support framework 156 may include one or more beams 162. The depicted embodiment includes a pair of opposing beams 162. The beams 162 may trap the slide subassembly 158 while allowing travel of the slide subassembly 158 along the beams 162. The slide subassembly 158 may include slide pads 166 to contact the beams 162 and allow for sliding movement with respect to the beams 162. In some embodiments, the slide assembly 154 may be supported so that the slide pads 166 make light contact with the beams 162 under no-load conditions. The slide pads 166 may be formed to provide significant wear areas due to an elongated form in order to have extensive usable life spans. Further, the beams 162 may be connected to an exterior of the framework with fastener to allow case of assembly, access, and serviceability, e.g., in order to eventually replace the slide pads 166. In some embodiments, the slide subassembly 158 may include one or more slidable brackets 148 that directly or indirectly couple the slide pads 166. The embodiment depicted includes two slidable brackets 148 in opposing arrangement.

The tie plate manipulator 102 may include one or more double-rod cylinders 152 connected to the slide subassembly 158. In the embodiment depicted, a single double-rod cylinder 152 is connected to the slide subassembly 158. The double-rod cylinder 152 may be adapted to extend and retract in order to selectively push or pull the slide subassembly 158 along the beams 162. In some embodiments, the double-rod cylinder 152 may be connected to the slide subassembly 158 by way of the slidable brackets 148.

The slide subassembly 158 may include one or more tie plate tools 140 that extend from the slide subassembly 158. The embodiment depicted includes a pair of tie plate tools 140 configured in opposing and parallel arrangement. The tie plate tools 140 may be specially adapted to engage railway tie plates 114 in a number of different ways in order to facilitate a number of different railway component adjustments in accordance with various embodiments disclosed herein. In some embodiments, as depicted, the slide subassembly 158 may fixedly couple the tie plate tools 140 together such that both tools 140 move together. Other embodiments (not shown) may adapt the slide subassembly 158 so that the tie plate tools 140 may move independently, each being moved by an independent double-rod cylinders 152.

Additional details regarding the component handling 105-1 are provided via U.S. application Ser. No. 15/889,562, filed Aug. 9, 2018, the entire contents of which are hereby incorporated by reference for all purposes as if fully set forth herein. Further, in various embodiments, the component handling system 105-1 may be adapted for conjunction with a variety of railway workheads. While disclosed embodiments of the component handling system 105-1 are illustrated as an example, the component handling system 105-1 may include other types of railway machinery and workheads not shown. Other embodiments of railway maintenance assemblies may include, for example, railway anchor squeezing and/or adjusting workheads, spike-installing workheads, and/or any other suitable type of railway install instance and/or maintenance machinery. Additional details regarding some of such railway maintenance assemblies are provided via U.S. application Ser. No. 16/230,476, filed Dec. 21, 2018; U.S. application Ser. No. 15/090,428, filed Apr. 4, 2016; U.S. application Ser. No. 15/886,957, filed Feb. 2, 2018; the entire contents of each of which are hereby incorporated by reference for all purposes as if fully set forth herein.

Referring again more generally to the system 100 of FIG. 1, each railway maintenance assembly 105 may be configured to be self-driving and/or remotely controlled by way of the control system 401 such that no operator is needed to be in an operator's cab or otherwise in or on the railway maintenance assembly 105 in order for the railway maintenance assembly 105 to operate. Accordingly, each railway maintenance assembly 105 may operate in a remote-controlled driving mode or in an autonomous self-driving mode. In a remote-controlled driving mode, a railway maintenance assembly 105 may be controlled by one or combination of the system controller 170, mobile controller 175, and/or cloud controller 190 in conjunction with the control system 401 to, as disclosed herein, traverse the railway 108, to stop over a railway tie 110, and/or to perform one or more railway component adjustment operations (e.g., fastener removal operations, anchor adjustment operations, tie replacement operations, and/or spiker operations disclosed in the applications incorporated by reference).

In an autonomous driving mode, a railway maintenance assembly 105 may be directed to a particular railway tie 110, then the railway maintenance assembly 105 may automatically drive itself by way of the control system 401 to the target railway tie 110, stop over the railway tie 110, and perform one or more railway component adjustment operations. The railway maintenance assembly 105 may be directed to the target railway tie 110 by input from one or combination of the system controller 170, mobile controller 175, and/or cloud controller 190. Each railway maintenance assembly 105 may be configured with reference tie mapping information for particular railway ties 110. The reference mapping information may include unique location data for each railway tie 110 along the railway 108. The location data may include one or a combination of latitude and longitude coordinates, GPS coordinates, geographic information system coordinates, railway tie numbers/identifiers, railway tie and/or proximate area image information captured via satellite and/or ground-level image capture processes, and/or the like. In some instances, reference mapping information may be gathered in whole or in part from one or more remote data source systems. Each railway maintenance assembly 105 may be location-aware such that it can detect its current location and can detect when it is located over a target railway tie 110. In some embodiments, as disclosed herein, each railway maintenance assembly 105 may include a GPS receiver to facilitate its detection of current locations. In some embodiments, additionally or alternatively, the railway maintenance assembly 105 may be configured to detect its relative current location based at least in part on counting railway ties 110 over which it has traveled until it reaches a target railway tie 110. In some embodiments, additionally or alternatively, the railway maintenance assembly 105 may be configured to detect when it reaches a target railway tie 110 based at least in part on matching captured image data and/or other sensor data of railway ties 110 two reference data for the target railway tie 110 until it determines that it has reached the target railway 110 based on currently captured image/sensor data being determined by the assembly 105 to match the reference image/sensor data for the target railway tie 110.

Figure 6A:
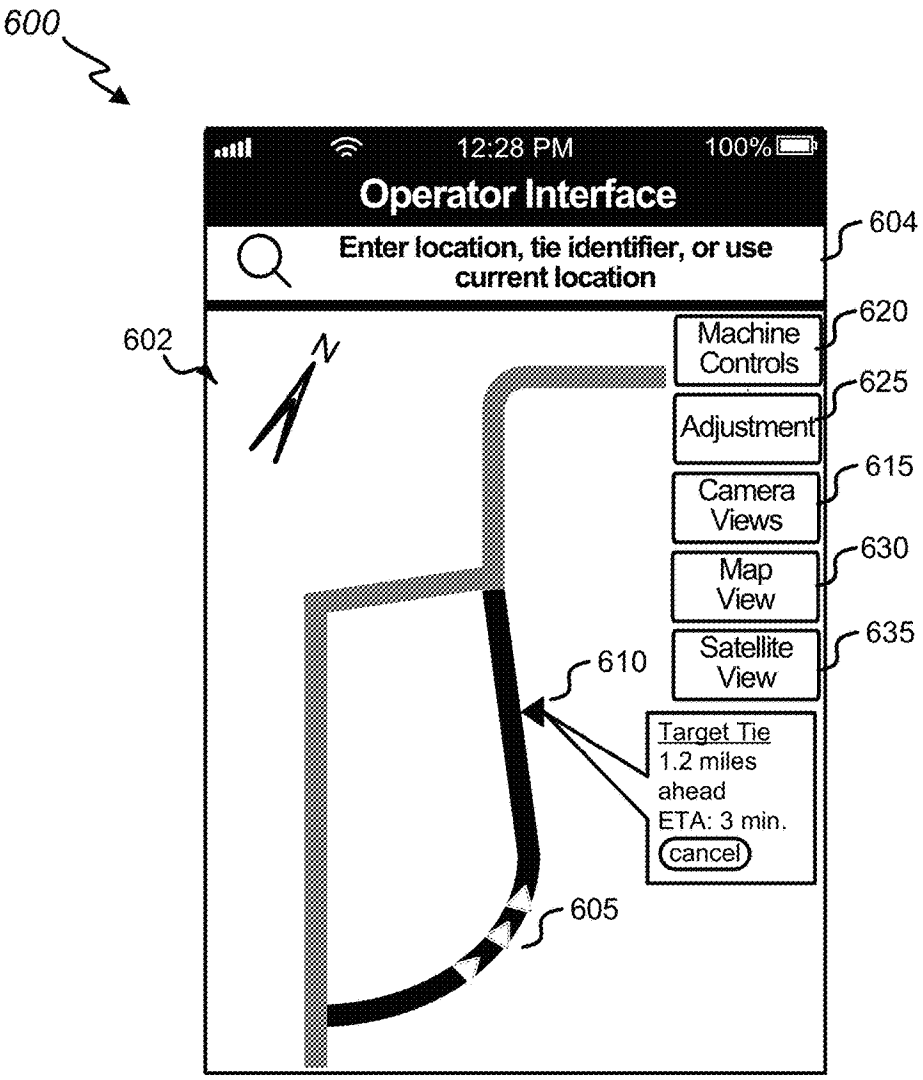
FIG. 6A illustrates a simplified graphical user interface that may be presented via a mobile controller, in accordance with certain embodiments of the present disclosure.
Figure 6B:
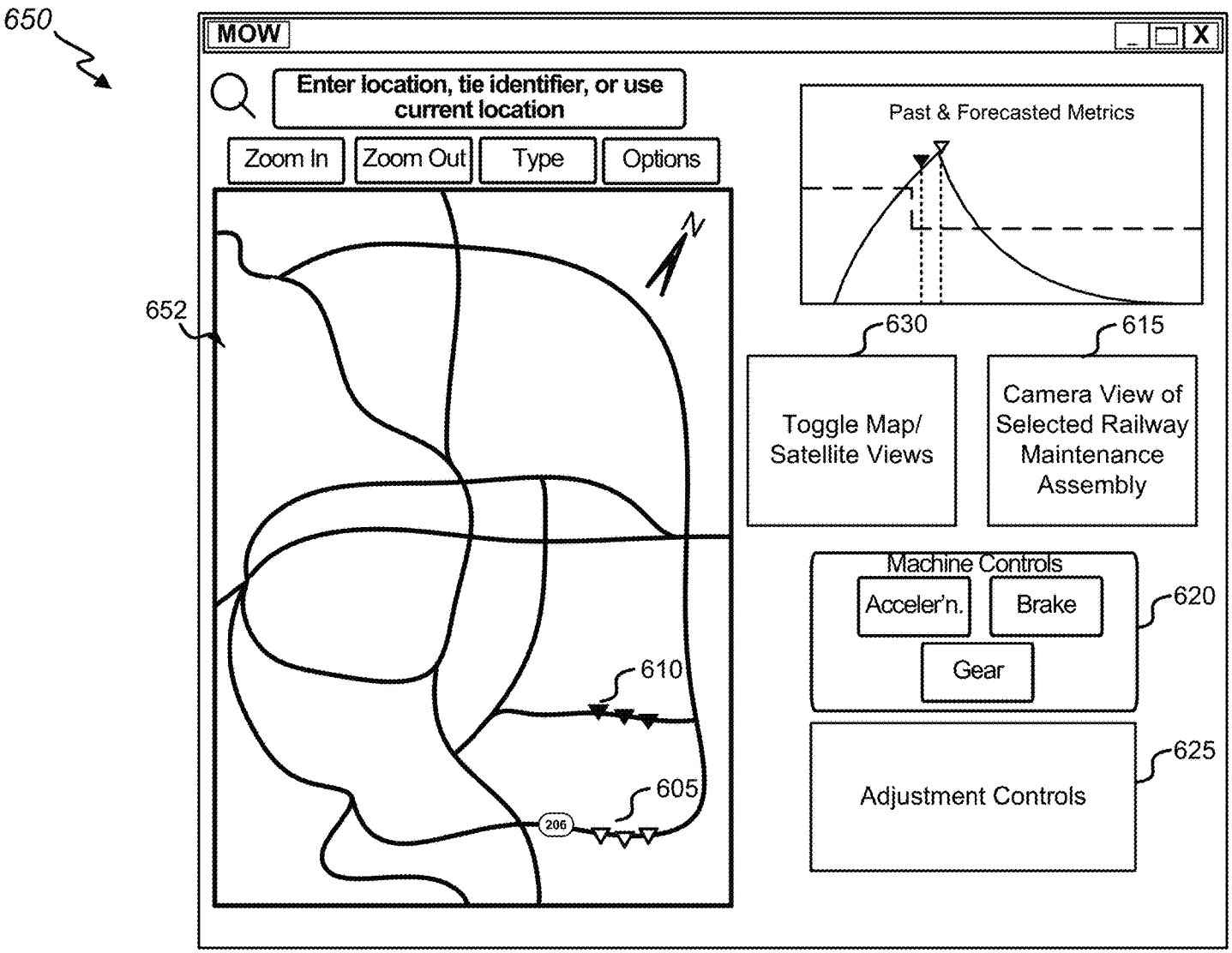
FIG. 6B illustrates a simplified graphical user interface that may be presented via a system controller and/or a cloud controller, in accordance with certain embodiments of the present disclosure.

An operator interface may be presented with the system controller 170, mobile controller 175, and/or cloud controller 190. The system controller 170, mobile controller 175, and/or cloud controller 190 may provide for the selection, generation, and provision of content objects to one or more operator interfaces. With an operator interface, a graphical user interface (GUI) may display a map of a railway 108 and a surrounding vicinity corresponding to any suitable location. By way of simplified example, FIG. 6A illustrates a simplified graphical user interface 600 that may be presented via a mobile controller 175, in accordance with certain embodiments of the present disclosure. The GUI 600 displays a map 602 of a railway 108 and a surrounding vicinity corresponding to a location 604, which may be a detected current location of the device by default or a different user-entered location. As another example, FIG. 6B illustrates a simplified graphical user interface 650 that may be presented via a system controller 170 and/or a cloud controller 190, in accordance with certain embodiments of the present disclosure. The GUI 650 displays a map 652 of a particular vicinity corresponding to the location 604, which may be a detected current location of the device by default or a different user-entered location. One or both of a map view and a satellite view could be shown, with interface elements 630, 635 to select a map view and a satellite view.

With the reference mapping information, railway tie data may be used to display railway tie information on the map display. In the depicted examples, a user may zoom into the map display to review graphical indications of the railway ties and railway tie data, or the user may enter railway tie numbers/identifiers via a user input field of the interfaces. Options may be provided to enable the user to select a user-selectable option to select a target railway tie 110, which could be indicated on the map display. The interfaces may display graphical indications 605 in any suitable form of locations of the current locations of particular railway maintenance assembles 105. The interfaces may likewise display graphical indications 610 in any suitable form of locations of the one or more target railway ties 110, along with relative distances, estimated times of arrival (ETAs), and/or the like. Each graphical indicator 605, 610 of the interfaces may be user-selectable to reveal machine-specific details or tie-specific details. For example, machine identifiers and metrics may be revealed with hover-over-to-reveal functions on an individual graphic basis (e.g., revealing machine identifier, location, configuration data, metrics data for a particular machine in response to a mouse-over event directing a cursor or other selection tool of the GUI to hover over the particular graphical representation of the particular machine). Similarly, tie-specific information (e.g., tie identifier, tie location data, distance of the tie from one or more machines or other reference points, estimated time of arrival (ETA) of a machine with respect to the tie, tie condition, maintenance actions performed on the tie, etc.) may be revealed with hover-over-to-reveal functions. Additionally or alternatively, machine-specific details or tie-specific details may be revealed with actual selection of the graphical representations (e.g., touching a touchscreen, right clicking, etc.).

Upon selection of one or more target railway ties 110, each railway maintenance assembly 105 may be initiated to operate in a remote-controlled driving mode or in an autonomous self-driving mode. To facilitate the remote-controlled driving mode and optional controls for the autonomous self-driving mode, the interfaces may provide interface elements 615 to allow a user to select camera views of particular railway maintenance assemblies 105 to show the video data captured by cameras of the particular machines in real time, interface elements 620 to allow a user to remotely control particular railway maintenance assemblies 105 (e.g., automatic acceleration, automatic braking, reverse, etc.) through the control system 401 in real time, and interface elements 625 to allow a user to remotely control particular railway component adjustment operations in real time.

As disclosed herein, the controllers 170, 175, and/or 190 may provide operator user interfaces to allow for output of information to a user and for input from a user with one or more selectable interface options. To facilitate operational maintenance actions, various embodiments of the controllers 170, 175, and/or 190 may provide one or more interfaces that: receive electronic communications from one or more railway maintenance assemblies, transmit electronic communications to one or more railway maintenance assemblies, transmit electronic communications to one or more end-user devices, receive electronic communications from one or more end-user devices, transmit electronic communications to one or more resource-controlling systems, receive electronic communications from one or more resource-controlling systems, and/or the like. In various embodiments, an end-user interface of the controllers 170, 175, and/or 190 may include providing one or more display screens that may each include one or more user interface elements. An end-user interface may include any text, image, and/or device that can be displayed on a display screen for providing information to a user and/or for receiving user input. An end-user interface may include one or more widgets, windows, dashboards, text, text boxes, text fields, tables, grids, hyperlinks, buttons, lists, combo boxes, checkboxes, radio buttons, and/or the like.

In various embodiments, the interfaces may include one or more suitable input/output modules and/or other system/devices operable to facilitate communication over the one or more networks using any suitable transmission protocol and/or standard. In various embodiments, the cloud controller 190 and/or mobile interface 175 may include, provide, and/or be configured for operation with interfaces to facilitate access by client devices, for example, by communicating with one or more of a website, a web page, a web portal, a web application or other web interface, a mobile application, enterprise software, and/or any suitable application software. In some embodiments, the interfaces may include an API to facilitate interaction with the server system of the cloud controller 190. In some embodiments, the interfaces may include or cooperate with an application of a client device, such as a mobile application. In some embodiments, the interfaces may cause a web page to be displayed on a browser of a client device. The web page(s) may display output and receive input from a user of a client device (e.g., by using Web-based forms, via hyperlinks, electronic buttons, etc.). A variety of techniques can be used to create the web pages and/or display/receive information, such as JavaScript, Java applications or applets, dynamic HTML and/or AJAX technologies.

In various embodiments, the client devices may be configured to operate a client application such as a web browser, a proprietary client application, a web-based application, an entity portal, a mobile application, a widget, or some other application, which may be used by a user of the client device to interact with the controllers 170, 175, and/or 190 to use services provided by the controllers 170, 175, and/or 190. In various embodiments, the client devices may be portable handheld devices (e.g., an iPhone®, cellular telephone, an iPad®, computing tablet, a personal digital assistant (PDA)) or wearable devices (e.g., smart glasses, smart watches), running software such as Microsoft Windows Mobile®, and/or a variety of mobile operating systems such as iOS, Windows Phone, Android, and/or the like, and being Internet, email, short message service (SMS), and/or other communication protocol enabled. In some embodiments, one or more of the client devices can be general purpose personal computers including, by way of example, personal computers and/or laptop computers running various versions of Microsoft Windows®, Apple Macintosh®, and/or Linux operating systems. In some embodiments, one or more of the client devices can be workstation computers running any of a variety of available UNIX® or UNIX-like operating systems, including without limitation the variety of GNU/Linux operating systems, such as for example, Google Chrome OS. In some embodiments, one or more of the client devices can be computing and communication devices integrated with or otherwise installed in a vehicle. Alternatively, or in addition, one or more of the client devices may be any other electronic device, such as a thin-client computer and/or a personal messaging device, capable of communicating over network(s).

Additionally, each railway maintenance assembly 105 may be configured to be self-aware. For example, each railway maintenance assembly 105 may provide for component monitoring so that the railway maintenance assembly 105 may be self-aware with respect to its own operational condition (e.g., health). Referring again more particularly to FIGS. 1 and 1A, each railway maintenance assembly 105 may include one or more railway workhead component monitors 121 adapted to be disposed in the railway maintenance assembly 105. With a component monitor 121, the railway maintenance assembly 105 may monitor sensor data with respect to operations of the railway maintenance assembly 105. Based at least in part on monitoring the sensor data, the railway maintenance assembly 105 may monitor one or more conditions of at least a portion of the railway maintenance assembly 105. The railway maintenance assembly 105 may be configured to store data recordings corresponding to monitoring/observation data of its operations over a period of time. Additionally, the railway maintenance assembly 105 may be configured to create reporting data based at least in part on the stored data recordings. The railway maintenance assembly 105 may be further configured to wirelessly transmit communications toward one or more remote devices and/or systems. Such communications may include the reporting data in some embodiments.

The system controller 170 may provide a link, if necessary, between the communication protocol used by a component monitor 121 and the communication protocol used by any mobile controller 175. In some embodiments, this may be a bridge, for example, between two or more of ZigBee, Z-Wave, RF4CE, Bluetooth, CAN bus, I2C bus, Wi-Fi, and/or the like. In various embodiments, the system controller 170 may be integrated within a controller and/or control engine 421, and may be implemented with any suitable device, such as a computing device, a standalone system controller device, a system controller device integrated with another device, such as operator station control device, etc.

In various embodiments, the mobile controller 175 and/or the system controller 170 may be a mobile computing device. In some embodiments, the mobile computing device may be provided with a mobile application configured to run on the mobile computing device to facilitate various embodiments of this disclosure. In some embodiments, instead of a mobile application, another type of application or instruction set may be configured to run on the mobile computing device to facilitate various embodiments of this disclosure. The mobile computing device may be any portable device suitable for sending and receiving information in accordance with embodiments described herein. For example without limitation, in various embodiments, the computing device may include one or more of a mountable control unit, a mobile phone, a cellular telephone, a smartphone, a handheld mobile device, a tablet computer, a web pad, a personal digital assistant (PDA), a notebook computer, a handheld computer, a laptop computer, and/or the like.

In various embodiments, the component monitors 121 may be communicatively coupled or couplable to one or more networks to communicate with the cloud controller 190, the mobile controller(s) 175, and/or the system controller 170. The one or more networks may be a suitable means to facilitate data transfer in the system 100 and could include multiple networks and/or network components. In various embodiments, the one or more networks may be implemented with, without limitation, one or more of the Internet, a wide area network (WAN), a local area network (LAN) such as one based on Ethernet, Token-Ring and/or the like, a wireless network (e.g., a network operating under Bluetooth®, any of the Institute of Electrical and Electronics (IEEE) 802.11 suite of protocols, and/or any other wireless protocol), a wireless local area network (WLAN), a cellular network, such as through 5G, 4G, 3G, GSM (Global System for Mobile Communications), etc., another wireless network, a gateway, a public switched telephone network (PSTN), and/or any other appropriate architecture or system that facilitates the communication of signals, data, and/or message. In various embodiments, the one or more networks may transmit data using any suitable communication protocol(s), such as, without limitation, TCP/IP, SNA (systems network architecture), IPX (Internet packet exchange), AppleTalk, and/or the like. In various embodiments, the one or more networks and its various components may be implemented using hardware, software, and communications media such wires, optical fibers, microwaves, radio waves, and other electromagnetic and/or optical carriers; and/or any combination of the foregoing and/or the like. In some embodiments, the network may include a telephone network that may be circuit switched, package switched, or partially circuit switched and partially package switched. For example, the telephone network may partially use the Internet to carry phone calls (e.g., through VoIP).

The controllers 170, 175, and/or 190 may communicate with an interaction infrastructure 195 that may correspond to a server system in various embodiments to facilitate various features disclosed herein. For example, the interaction infrastructure 195 that may include or otherwise be communicatively coupled to one or more information repositories that store data from assemblies 105, such as sensor-based data regarding component usage and corresponding operational metrics mapped to identifiers for the assemblies 105 and components. In some embodiments, the controllers 170, 175, and/or 190 may facilitate searching of one or more information repositories (e.g., those of the infrastructure 195) in response to data received over the one or more networks from any one or combination of the interfaces disclosed herein. In some embodiments, the interaction infrastructure 195 may include the cloud controller 190 or otherwise may facilitate the cloud controller 190 and the associated control features. In various embodiments, communications disclosed herein between component monitors 121 and the controllers 170, 175, and/or 190 may be by way of the infrastructure 195.

In various embodiments, the interaction infrastructure 195 may correspond to a set of devices configured to process, transform, encode, translate, send, receive, retrieve, detect, generate, compute, organize, categorize, qualify, store, display, present, handle, or use information and/or data suitable for the embodiments described herein. For example, servers may be used to store software programs and data. Software implementing the systems and methods described herein may be stored on storage media in the interaction infrastructure 195. Thus, the software may be run from the storage media in the interaction infrastructure 195. In some embodiments, software implementing the systems and methods described herein may be stored on storage media of other devices described herein. The systems and methods described herein may be implemented in or with a distributed computing and/or cloud computing environment with a plurality of servers and cloud-implemented resources of the interaction infrastructure 195. The interaction infrastructure 195 may include processing resources communicatively coupled to storage media, random access memory (RAM), read-only memory (ROM), and/or other types of memory. The server system may include various input and output (I/O) devices, network ports, and display devices.

In some embodiments, the server system may include or be communicatively coupled to the control system 401 that may provide functionality when executed by one or more servers to provide the tracking and control features described herein. Thus, in various embodiments, the control system 401 may be implemented in whole or in part by one or more servers of the interaction infrastructure 195. In various embodiments, the control system 401 may be implemented in whole or in part by a computer system that is onboard a railway maintenance assembly 105 and may be communicatively coupled with controls of the railway maintenance assembly 105. In various embodiments, the interaction infrastructure 195 may include one or more computers, specialized server computers (including, by way of example, PC (personal computer) servers, UNIX® servers, mid-range servers, mainframe computers, rack-mounted servers, etc.), server farms, server clusters, or any other appropriate arrangement and/or combination. In various embodiments, the interaction infrastructure 195 may be adapted to run one or more services, operations, processing, or software applications described herein. The interaction infrastructure 195 may run an operating system including any of those discussed herein, as well as any available server operating system. The interaction infrastructure 195 may also run any of a variety of additional server applications and/or mid-tier applications, including HTTP (hypertext transport protocol) servers, FTP (file transfer protocol) servers, CGI (common gateway interface) servers, JAVA® servers, database servers, and the like. Exemplary database servers include without limitation those available from Oracle, Microsoft, Sybase, IBM (International Entity Machines), and the like.

The server system of the interaction infrastructure 195 may include one or more communication servers. Some embodiments may use one type of communication server, such as a web server, to receive service requests and another type of communication server to provide service results. Some embodiments may use different types of communication servers to service different types of client devices corresponding to controllers 170, 175, and/or 190. The web and/or application server(s) may include one or more web servers and/or one or more application servers, such as mobile app servers. In some embodiments, a web may communicate with a client device corresponding to controllers 170, 175, and/or 190 via Hypertext Transfer Protocol (HTTP) and/or other types of communication protocols, such as File Transfer Protocol (FTP), Wireless Application Protocol (WAP), etc. A web and/or application server(s) server may provide static web pages, dynamic web pages, and/or web services. In some embodiments, a web server may provide web applications to a client device corresponding to controllers 170, 175, and/or 190 for execution in a web browser running on the client device; and the web applications may include scripts, such as Java, JavaScript, etc., for execution within an isolated environment in a browser. In some embodiments, the web server may provide rich-client applications to the client device corresponding to controllers 170, 175, and/or 190; and the rich-client application may be programmed in traditional programming languages to have full access to functions of the operating system running on the client device. In some embodiments, the servers provide a user interface for user interaction with content objects. For example, the web servers may provide a user interface via static web pages, dynamic web pages, and/or web services, etc. The web servers may provide rich client applications for execution in the mobile computing device to provide the user interfaces. Any one or combination of the various servers may run on common or separate computers. In some embodiments, there may be one or more layers of application servers between communication servers and the data stores to process the entity logic and data access of the rich client applications.

In some embodiments, the interaction infrastructure 195 may include one or more applications to analyze and consolidate data feeds, event updates, and/or other data pushed, pulled, actively gathered (e.g., by "crawling" various repositories), and/or or otherwise received from various data sources. As an example, data feeds and/or event updates may include, but are not limited to, application updates, Twitter® feeds, Facebook® updates, updates (real-time and/or otherwise) from one or more third-party information sources (e.g., news sources, event information sources, weather information sources, and/or the like) and/or continuous data streams, which may include real-time events related to sensor data applications, and/or the like. The interaction infrastructure 195 may also include one or more applications to display the data feeds and/or real-time events via the client devices.

The interaction infrastructure 195 may also include one or more data stores. The data stores may include various forms of data storage including solid state storage, disk storage, databases (including relational, column, document, key-value and graph type databases) and cache. The data stores may reside in a variety of locations, such as on a non-transitory storage medium local to (and/or resident in) the server system and/or remote from the server system and in communication with the server system via a network-based or dedicated connection. In some embodiments, the data stores may reside in a storage-area network (SAN). Similarly, any necessary files for performing the functions attributed to the server system may be stored locally on the server system and/or remotely, as appropriate. In one set of embodiments, the data stores may include relational databases that are adapted to store, update, and retrieve data in response to SQL-formatted commands. It should be appreciated that information corresponding to the repositories may be stored elsewhere and/or in other ways, or may not be stored, depending on the implementations chosen. Likewise, while various segregations of data corresponding to the repositories are provided herein, it should be appreciated that such examples are non-limiting, and some or all the data may be handled in any suitable manner.

In some embodiments, the interaction infrastructure 195 may be implemented in or with a distributed computing and/or cloud computing environment with a plurality of servers and cloud-implemented processing, memory, and data resources. Thus, with accretion of service information, the system may allow for scaling out with additional processing resources, server resources, data storage resources, data management resources, and the like. Some embodiments may use different types of servers to service different types of client devices.

In various embodiments, the data from the one or more data sources may be retrieved and/or received by the interaction infrastructure 195 via the one or more data acquisition interfaces through network(s) and/or through any other suitable means of transferring data. In some embodiments, the interaction infrastructure 195 and the data sources could use any suitable means for direct communication. According to certain embodiments, data may be actively gathered and/or pulled from one or more data sources, for example, by accessing a third-party repository and/or by "crawling" various repositories (e.g., databases, search engines, server systems, websites, file sharing sources, and/or the like). Certain data pulled and/or pushed from the one or more data sources may be transformed and the transformed data and/or other data generated based thereon may be made available by the interaction infrastructure 195 for users of client devices. Data from the disparate data sources may be transformed from various different data formats into one or more formats compatible with one or more engines of the interaction infrastructure 195. The transformation may further include consolidating data from one or more data sources, filtering out redundant and/or irrelevant data from the incoming data sets, categorizing and classifying the filtered data, and/or adding metadata tags to the filtered data in accordance with the categorization/classification. In alternative embodiments, data from the one or more data sources may be made available directly to client devices.

In some embodiments, the one or more data acquisition interfaces may be implemented in similar manner to the other interfaces. In some embodiments, the interfaces may include one or more application programming interfaces (APIs) that define protocols and routines for interfacing with the data sources. The APIs may specify application programming interface (API) calls to/from data source systems. In some embodiments, the APIs may include a plug-in to integrate with an application of a data source system. The interfaces, in some embodiments, could use a number of API translation profiles configured to allow interface with the one or more additional applications of the data sources to access data (e.g., a database or other data store) of the data sources. The API translation profiles may translate the protocols and routines of the data source system to integrate at least temporarily with the system and allow communication with the system by way of API calls. Data, as referenced herein, may correspond to any one or combination of raw data, unstructured data, structured data, information, and/or content which may include media content, text, documents, files, instructions, code, executable files, images, video, audio, and/or any other suitable content suitable for embodiments of the present disclosure.

As disclosed herein, various embodiments may provide for remote monitoring and control of railway maintenance equipment, and the railway maintenance assemblies 105 may be self-aware. Each railway maintenance assembly 105 may be further configured to wirelessly transmit communications, such as reporting data, video and other sensor data, and/or the like feedback data toward one or more remote devices and/or systems. The electronic communications may be directed toward a controller 170, 175, and/or 190, toward the interaction infrastructure 195, and/or toward a control system 401. In some embodiments, a railway maintenance assembly 105 may be individually controlled from any paired controller 170, 175, and/or 190 with a control application on a controller 170, 175, and/or 190. With some such embodiments, the railway maintenance assembly 105 may wirelessly transmit the communications directly to the controller 170, 175, and/or 190. With other embodiments, the railway maintenance assembly 105 may wirelessly transmit the electronic communications indirectly to the controller 170, 175, and/or 190, via one or more other railway maintenance assemblies and/or one or more other communicably coupled devices. The controller 170, 175, and/or 190 may monitor electronic communications, received via one or more interfaces, from the railway maintenance assemblies 105 to identify machine operation metrics, sensor data, and control feedback data. In some embodiments, the controller 170, 175, and/or 190 may update an operations pattern data store to associate each of the railway maintenance assemblies 105 with operation metrics data based at least partially on one or more of the identified machine operation metrics. Some embodiments of the controller 170, 175, and/or 190 may further associate the identified machine operation metrics with operational condition records for each of the railway maintenance assemblies 105. With some embodiments, the controller 170, 175, and/or 190 may detect a location associated with each electronic communication from one or more railway maintenance assemblies 105 in order to identify a location of each of the one or more railway maintenance assemblies 105. With some embodiments, the electronic communications monitored by the usage monitor of the controller 170, 175, and/or 190 may include sensor data from sensors associated with the railway maintenance assemblies 105. The usage monitor of the controller 170, 175, and/or 190 may update the operations pattern data store at least in part based on the particular type of sensor data detected.

Some embodiments of the controller 170, 175, and/or 190 may further associate one or more action types with the railway maintenance assemblies 105 based at least in part on the identified machine operation metrics. The controller 170, 175, and/or 190 and/or the railway maintenance assembly 105 may evaluate operational condition records of particular railway maintenance assemblies based at least partially on the operations metrics data and a maintenance threshold condition (e.g., a specified number of time values of usage/operating time and/or cycles of particular functions of operating components) that may be component-specific. When it is determined that the maintenance threshold condition is satisfied, a corresponding action may be identified.

Some embodiments may provide for railway maintenance assemblies 105 that facilitate at least partially autonomous maintenance actions. The communications that include the reporting data from one or more railway maintenance assemblies 105 may facilitate at least partially autonomous maintenance actions. For example, the controller 170, 175, and/or 190 may analyze the reporting data with respect to one or more operational thresholds and determine whether one or more one or more maintenance action are to be triggered for one or more railway maintenance assemblies. The controller 170, 175, and/or 190 may in turn transmit a notification to one or more end-user devices previously associated with the controller 170, 175, and/or 190 and/or place an order for one or more replacement parts with a resource-controlling system via one or more networks.

In some embodiments, the notification to the one or more end-user devices may include an action-performance duration. The notification may further facilitate the one or more end-user devices to perform a corresponding action, such as place an order for one or more replacements with a resource-controlling system via one or more networks. To facilitate the action performance, the notification may include a user-selectable option to specify ordering one or more replacements with a resource-controlling system. In some cases, the user-selectable option may include a URL specific to the replacement resource to facilitate ordering of one or more replacements with a resource-controlling system.

Additionally or alternatively, the communications from one or more railway maintenance assemblies 105 may include various commands in various embodiments. For example, in some embodiments, a command may correspond to a request to order one or more replacements for the railway maintenance component after the railway maintenance assembly 105 has analyzed its data recordings with respect to one or more operational thresholds and determined that there is or will be a need for a replacement. The request to order may be directed to a controller 170, 175, and/or 190 in some embodiments. The controller 170, 175, and/or 190 may in turn transmit a notification to one or more end-user devices previously associated with the controller 170, 175, and/or 190 and/or place an order for one or more replacements with a resource-controlling system via one or more networks. With other embodiments, the request to order may be directed to a resource-controlling system via one or more networks, such that the railway maintenance assembly 105 directly places a replacement order.

Accordingly, the one or more railway maintenance assemblies 105 and/or the controller 170, 175, and/or 190 may be configured to be one or more operational maintenance devices for the railway maintenance components. To facilitate such operational maintenance actions, various embodiments may provide one or more interfaces that: receive electronic communications from one or more railway maintenance assemblies 105, transmit electronic communications to one or more railway maintenance assemblies 105, transmit electronic communications to one or more end-user devices, receive electronic communications from one or more end-user devices, transmit electronic communications to one or more resource-controlling systems, receive electronic communications from one or more resource-controlling systems, and/or the like.

Some embodiments may further provide for intelligent timetable management. A timetable monitor may update one or more timetables in a timetable data store. In some embodiments, the timetable monitor may monitor electronic communications, received via one or more interfaces, from one or more railway maintenance assemblies 105, the controller 170, 175, and/or 190, and/or one or more remote resource-controlling systems. The timetable monitor may identify updates to timetables of railway maintenance assemblies 105 and/or replacement orders. The timetables of railway maintenance assemblies 105 may indicate determinations of usage, expected life balance, predicted end of life, and/or the like with respect to particular components of the railway maintenance assemblies 105. The timetables of replacement orders may indicate lead time for replacement orders, buffer time for provisioning after order placement, buffer time for replacement of a railway maintenance assembly 105 component (rather than assuming immediate restoration), and/or the like. The timetable monitor may update the timetables based at least partially on historically monitored actions.

Some embodiments may further provide for replacement availability tracking. The controller 170, 175, and/or 190 and/or the railway maintenance assembly 105 may track quantities of replacements versus replacements used. For example, with embodiments where either the assembly 105 or the controller 170, 175, and/or 190 directly place a replacement order, the quantity of replacement components ordered may be tracked. The tracked quantity of replacement components ordered may be added to a current availability record upon reception of a delivery notification or after an estimated delivery time has passed. Further, nonfunctional components may be logged. Install instances of replacements of the nonfunctional components may be detected. Such install instances may be logged, and the current availability record may be updated to decrement an estimated quantity of on-premise replacements.

Various embodiments of a railway maintenance assembly 105 may include one or more component monitors 121 in and/or attached to various components of the railway maintenance assembly 105. In some embodiments, the railway maintenance component may be any suitable available railway maintenance component, which may be installed in a corresponding maintenance assembly 105 where the install instance is separate from an install instance of one or more component monitors 121, which may be installed in and/or attached to the component in an add-on manner. Yet, in other embodiments, the railway maintenance component may be a railway maintenance component that includes one or more installed component monitors 121 integrated with the component. In some embodiments, a component monitor 121 implemented with an add-on install instance may sit on top of the control system 401 to interact with the control system 401 to facilitate various features disclosed herein.

The component monitors 121 may allow for gangs of railway maintenance assemblies 105 to be communicatively interconnected. With railway maintenance assemblies 105 in a gang being disposed in relative proximity to one another, the component monitors 121 may allow for a local wireless network on a per-gang basis. Each local wireless network may correspond to a subnetwork that is local to the gang, with one or more connection points to controllers 170, 175, and/or 190 and/or the interaction infrastructure 195. Various embodiments of railway maintenance assemblies 105 may be communicatively interconnected by way of the component monitors 121 according to various topologies according to various embodiments. In some embodiments, the plurality of railway maintenance assemblies 105 may be communicatively interconnected by way of the component monitors 121 according to a wireless mesh network topology such that intra-gang communications may allow for the communications and data collection disclosed herein. In some embodiments, the plurality of railway maintenance assemblies 105 may be communicatively interconnected by way of the component monitors 121 according to a wireless central hub/control system topology.

The control system 401, which may include one or a combination of the controllers 170, 175, and/or 190, and/or the railway maintenance assemblies 105 themselves may monitor the operational condition of all the railway maintenance assemblies 105 in the system 100. The component monitoring may include monitoring whether or not one or more railway maintenance assembly 105 component are still functional and/or if the specified number of time values of usage/operating time and/or cycles of particular functions of operating components is being approached, among other operational metrics disclosed herein. When one or more assembly 105 components are in need of replacement, one or more users (e.g., an operator in the operator's cab of the motorized railway vehicle and/or a remote administrative user) may be alerted by the system 100 that a certain number of new replacement components need to be procured. Depending on the level of connectivity or automation of the overall system 100, replacement components could be automatically ordered.

Along with monitoring operations of the railway maintenance assemblies 105 components, the component monitors 121 may wirelessly transmit communications, which may include reporting data, sensor data such as camera feeds, and/or other feedback data, toward one or more remote devices and/or systems. In various embodiments, the electronic communications may be directed toward one or a combination of the controllers 170, 175, and/or 190. With some such embodiments, the component monitors 121 may wirelessly transmit the communications directly to the controllers 170, 175, and/or 190. With other embodiments, the component monitors 121 may wirelessly transmit the electronic communications indirectly to the controllers 170, 175, and/or 190, via one or more other component monitors 121 and/or one or more other communicably coupled devices.

The controllers 170, 175, and/or 190 may monitor electronic communications, received via one or more interfaces, from the component monitors 121 to identify machine operation metrics and associated times. In some embodiments, the controllers 170, 175, and/or 190 may update an operations patterns data store 326 to associate each of the component assemblies 105 with operations metrics data based at least partially on one or more of the identified machine operation metrics. Some embodiments of the controllers 170, 175, and/or 190 may further store the identified machine operation metrics in associated with collected and selected observation data for each of the railway assemblies 105.

The plurality of railway maintenance assemblies 105 may be communicatively interconnected according to various topologies according to various embodiments. FIG. 1 illustrates a diagram of an overview of the system 100 with a plurality of railway maintenance assemblies 105 communicatively interconnected according to a wireless central hub/control system topology, in accordance with a set of disclosed embodiments. Communications from the railway maintenance assemblies 105 in the system 100-2 may be transmitted directly to one or a combination of controllers 170, 175, and/or 190. Likewise, communications from one or a combination of controllers 170, 175, and/or 190 may be transmitted directly to the railway maintenance assemblies 105.

Figure 1A:
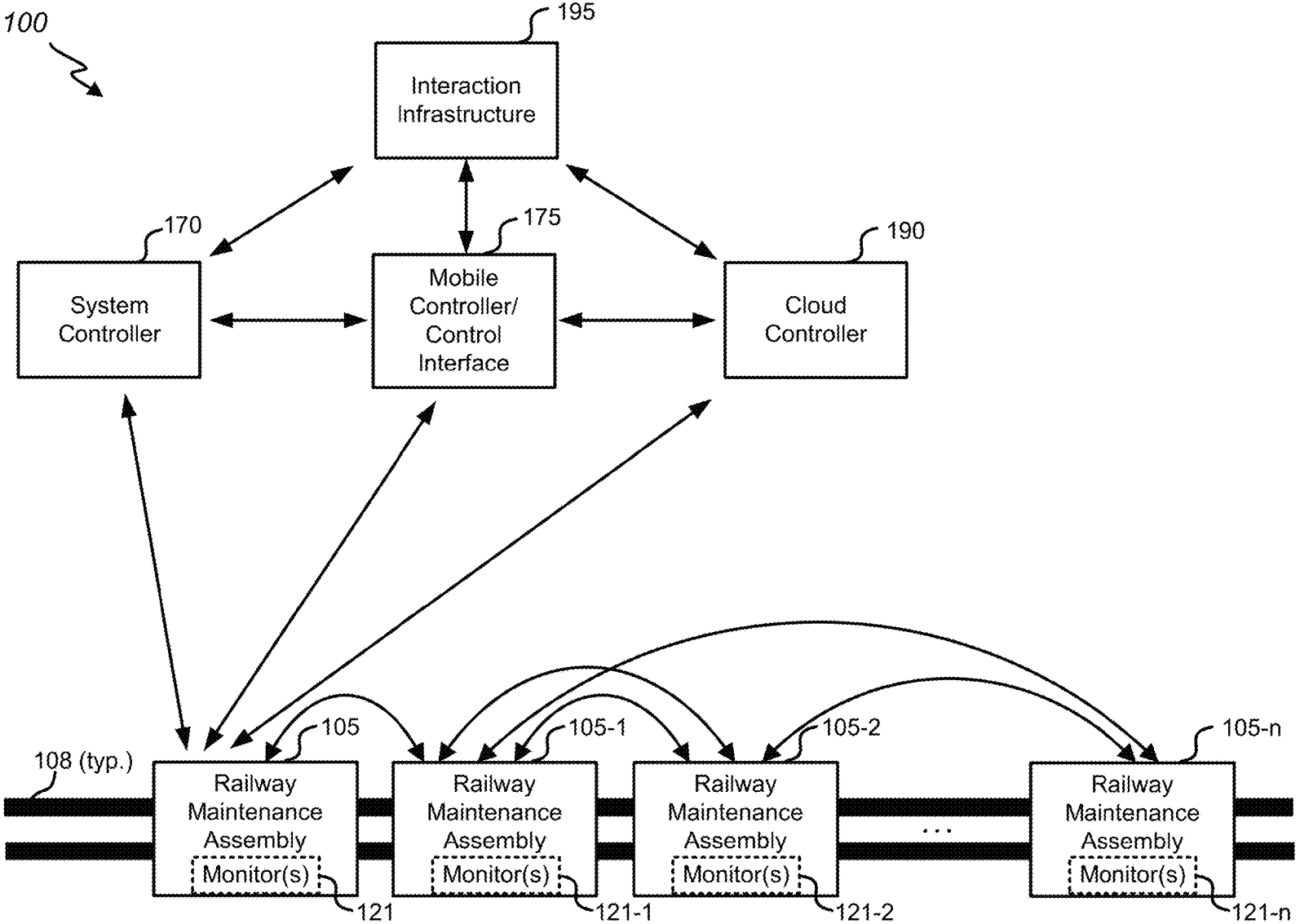
FIG. 1A illustrates a diagram of an overview of the system to facilitate railway maintenance assembly control with a plurality of railway maintenance assemblies communicatively interconnected according to a wireless mesh network topology, in accordance with disclosed embodiments of present disclosure.

However, in some embodiments, the plurality of railway maintenance assemblies 105 may be communicatively interconnected according to a wireless mesh network topology. FIG. 1A illustrates a diagram of an overview of the system 100 to facilitate railway maintenance assembly control with a plurality of railway maintenance assemblies 105 communicatively interconnected according to a wireless mesh network topology, in accordance with disclosed embodiments of present disclosure. Communications from particular railway maintenance assemblies 105 in the system 100 may be transmitted directly to one or more other railway maintenance assemblies 105. Such communications may include communications protocol shifting where multiple, different protocols may be used for communications between railway maintenance assemblies 105 in a gang and for communications from one or more railway maintenance assemblies 105 to controllers 170, 175, and/or 190. The protocols employed by the component monitors 121 may be a function of network access and/or signal strength. When the component monitors 121 do not have sufficient network access (e.g., cellular data access, etc.), communications may be transmitted in piggyback fashion from machine to machine and ultimately to a collector machine. Such communications from machine to machine may employ a communication protocol that may be selected based at least in part on the range (e.g., Bluetooth communications may be limited to a particular distance). Accordingly, in inconsistent cellular signal conditions, relaying communications from machine to machine may be employed as a fallback scheme. Further details are described herein.

The plurality of railway maintenance assemblies 105 may be configured according to a hierarchy, in some embodiments. Such a hierarchy could be a tree hierarchy with some embodiments. Each railway maintenance assembly 105 may be configured as a communication point for a certain number of other railway maintenance assemblies 105. The hierarchy could be explicitly defined by the controller, or the hierarchy could be organically developed by the railway maintenance assemblies 105. For example, a hierarchy may be formed such that each of the railway maintenance assemblies 105 is configured to communicate with its nearest neighbor railway maintenance assembly 105. Communications may be passed, based at least in part on proximity, to one or more nearest neighbor assemblies 105 until communications are passed to controllers 170, 175, and/or 190, such as by way of a router for direction to controllers 170, 175, and/or 190. As another example, a hierarchy may be formed organically based at least in part on when individual railway maintenance assemblies 105 are added to the system 100.

With such node-to-node communications, data (e.g., tracking data disclosed herein) from each node may be accumulated and ultimately transmitted to the controllers 170, 175, and/or 190 and/or the interaction infrastructure 195. For example, data may be accumulated at a mother node, which may transmit the accumulated data to the controllers 170, 175, and/or 190 and/or the interaction infrastructure 195. In some instances, the mother node may be the railway maintenance assembly 105 in the gang that includes a component monitor 121 designated for the upstream reporting.

Some embodiments may employ a hybrid hub-spoke and meshed network topology. The hybrid topology may solve the problem of one or more railway maintenance assemblies 105 being located such that they cannot communicate with the controllers 170, 175, and/or 190 and/or the interaction infrastructure 195. For example, one or more remote railway maintenance assemblies 105 may be located in an area where wireless communications services are unavailable and the one or more railway maintenance assemblies 105 may be remotely located too far away from the system controller 170 and/or the one or more mobile controllers 175 to communicate directly with the controller(s). However, one or more other proximate railway maintenance assemblies 105 may be located such that they have service and/or are closer to the controller(s) such that those railway maintenance assemblies 105 may communicate directly with the controller(s). The rules for some modes of operation may specify that a component monitor 121 transmit data to a nearest railway maintenance assembly 105 when no network access (e.g., cellular signal, Wi-Fi signal, etc. in accordance with various embodiments disclosed herein) is detected by the component monitor 121. The component monitors 121 of remote assemblies 105 may be configured to broadcast or specifically direct communications to component monitors 121 of one or more other proximate assemblies 105 until the communications are either relayed by a proximate assembly 105 or received by a controller 170, 175, and/or 190 and/or the interaction infrastructure 195 by a component monitor 121 having network access. In some embodiments, the controller 170, 175, and/or 190 may receive multiple instances of a communication relayed from a remote assembly 105 and may be configured to ignore redundant instances of the communication from the remote assembly 105.

Similarly, some embodiments may likewise employ such adaptive communications as a function of network signal strength. When the network signal strength values of component monitors 121 of variously located railway maintenance assemblies 105 vary, in some modes of operations, each component monitor 121 may broadcast indications of its current network signal strength. Upon receiving such indications, each component monitor 121 may compare its current signal strength to the signal strength values of other component monitor 121 based on the indications of such that the component monitor 121 received. The one or more reporting nodes may be determined as the one or more railway maintenance assemblies 105 having component monitors 121 with the highest signal strength. For example, each component monitor 121 may pass communications to a proximate assembly only when the proximate assembly has a stronger network signal, else, each component monitor 121 may upload its own communications and data to the controller 170, 175, and/or 190 and/or the interaction infrastructure 195, along with any communications and data received from a component monitor 121 having a weaker signal.

In some modes of operations, instead of broadcasting, each component monitor 121 of remote assemblies 105 may be configured to specifically direct indications of its current network signal strength to component monitors 121 of one or more other proximate assemblies 105. Upon receiving such indications, each component monitor 121 may compare its current signal strength to the signal strength values of other component monitor 121 based on the indications of such that the component monitor 121 received. Then, each component monitor 121 may pass communications to a proximate assembly only when the proximate assembly has a stronger network signal, else, each component monitor 121 may upload its own communications and data to the controller 170, 175, and/or 190 and/or the interaction infrastructure 195, along with any communications and data received from a component monitor 121 having a weaker signal.

A set of communication protocols may facilitate communications between the railway maintenance assemblies 105 and the controllers 170, 175, and/or 190. The communication protocols may be based upon particularized message structures. By way of example, message protocols may apply to notifications from a given railway maintenance assembly 105. A message protocol may include any one or combination of a system identifier field for a system identifier, railway maintenance assembly identifier field for an assembly identifier, a location identifier field for a location identifier of a location corresponding to the particular railway maintenance assembly 105, a component status for a status indicator corresponding to the particular component (e.g., operational status such as on/off, operational condition status such as indications disclosed further herein, and/or the like), a component log field for reporting sensor-based data such as operational metrics disclosed further herein, an operational control field for operational control specifications (e.g., timer schedules, operational condition monitoring thresholds, and/or the like), a notification field for notifications disclosed further herein, and/or the like. In some embodiments, message protocols may apply to commands from the controllers 170, 175, and/or 190. Such a message protocol may include any one or combination of a system identifier field for a system identifier, railway maintenance assembly identifier field for an assembly identifier, a location identifier field for a location identifier of a location corresponding to the particular railway maintenance assembly 105, a query is field for specifying a query command and requested reporting data, log data, status indicator, operational control information, and/or the like, an operational control field for operational control specifications (e.g., operational condition monitoring thresholds and/or the like), and/or the like. In various embodiments, additional commands, response, interrupts, and sequences may be added. Any suitable standardized protocols may be employed in various embodiments. In some embodiments, the protocols may call for assembly 105 identification information, component identification information, and/or component monitor 121-1 identification information with each message.

Figure 3:
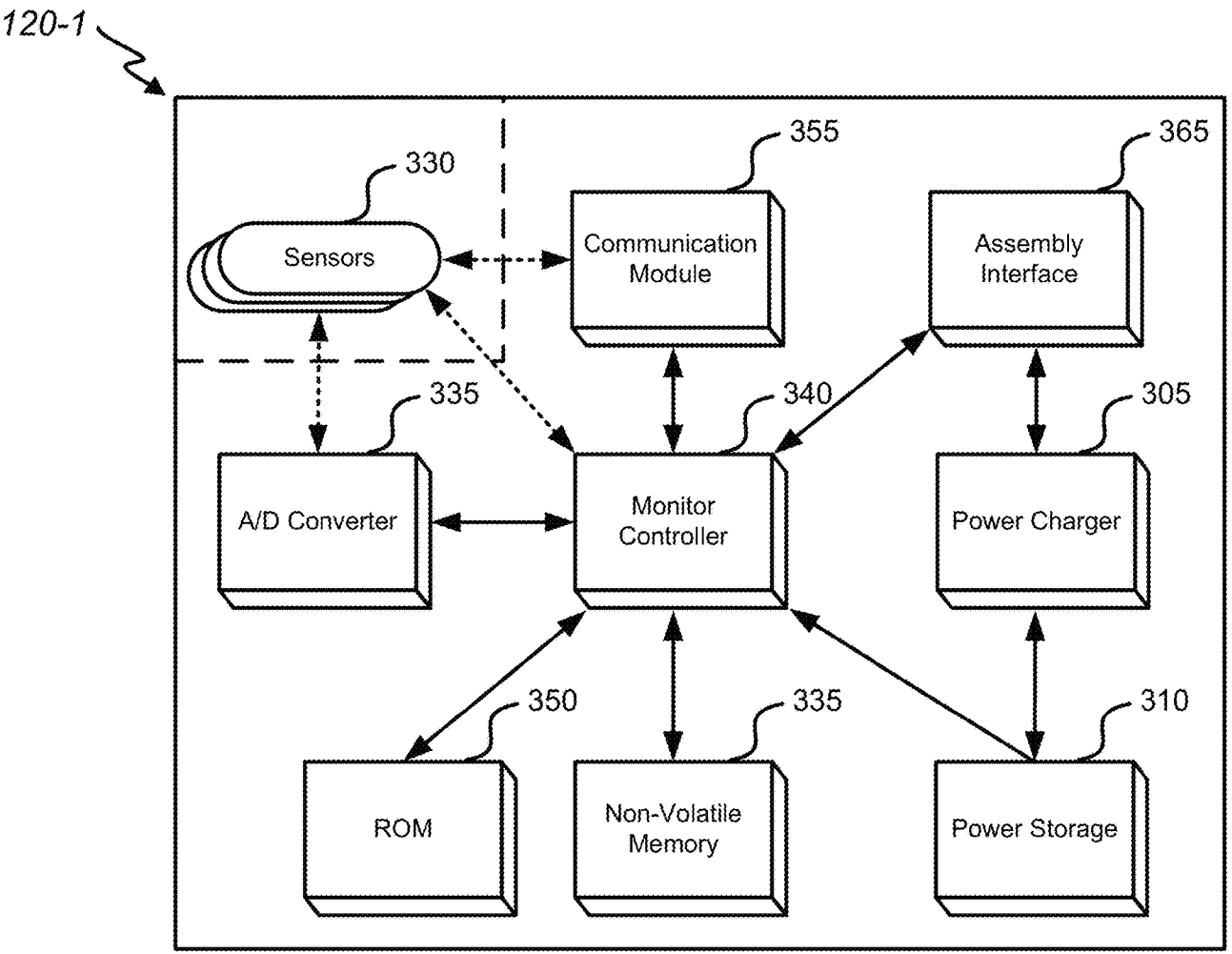
FIG. 3 illustrates a block diagram of a component monitor, in accordance with disclosed embodiments of present disclosure.

FIG. 3 illustrates a block diagram of a component monitor 121-1, in accordance with disclosed embodiments of present disclosure. The component monitor 121-1 may be adapted to be disposed within or otherwise attached to at least one of the various components of the railway maintenance assembly 105, per the various embodiments disclosed herein. The component monitors 121-1 may be configured to operate as operational condition monitors that provide various features disclosed herein.

In various embodiments, the component monitors 121-1 may be implemented with one or more programmable logic controllers (PLCs) or programmable logic devices (PLDs), application specific integrated circuits (ASICs), digital signal processors (DSPs), digital signal processing devices (DSPDs), field programmable gate arrays (FPGAs), image processors, controllers, micro-controllers, microprocessors, other electronic units designed to perform the functions described herein, and/or a combination thereof. The component monitors 121-1 may include or otherwise be communicatively coupled to one or more sensors 330 configured to detect phenomena of the railway maintenance assembly 105 component in order to facilitate monitoring of railway maintenance assemblies 105 and components and control operations with respect to railway maintenance assemblies 105 and components. In some embodiments, each of the component monitors 121-1 may be communicatively coupled to a receiver of the control system 401 via wired or wireless communication channels. The component monitors 121-1, receiver, and/or control system 401 may include any suitable sensors 330, controller(s), processor(s), memory, communication interface(s), and other components to facilitate various embodiments disclosed herein. The sensors 330, receiver, and/or control system 401 may include any sensor circuitry necessary to facilitate the various embodiments, including without limitation any one or combination of analog-to-digital converter circuitry, multiplexer circuitry, amplification circuitry, signal conditioning/translation circuitry, and/or the like. The data captured by the one or more sensors 330 may be used by the control system 401 to detect positioning and facilitate system-directed positioning and fastener removal and anchor adjustment operations of the fastener extractor 106 and the tie plate manipulator 102, as well as the positioning and install operations of the hammer assemblies and the anchor manipulator of an incorporated application.

In some embodiments, the component monitor 121-1 may include one or more substrates, which could be a PCB or any other substrate suitable for carrying certain components of the component monitor 121-1. With some embodiments, the substrate and interior components may be at least partially surrounded by a housing of any suitable material. The component monitor 121-1 may include one or more integrated circuits. The integrated circuit could provide certain functionalities, such as one or more sensing functionalities, data processing functionalities, communication functionalities, and/or the like. The substrate may be connected to terminals that may be electrically connected to conductors of the railway maintenance assembly 105, such as a power connector of the railway maintenance assembly 105.

Various embodiments of the component monitors 121-1 may be configured to be coupled with the railway maintenance assembly 105 by being affixed, bolted on, and/or otherwise attached/fastened by conventional means to various components of the railway maintenance assembly 105. For example, one or more of the component monitors 121-1 may be attached to any suitable element of a railway maintenance assembly 105 and disposed to capture data indicative of the positioning, operations, and/or other characteristics of the railway maintenance assembly 105 components. For example, with respect to the component handling system 105-1, one or more of the component monitors 121-1 may be attached to the component handling system 105-1 and disposed to capture data indicative of the positioning, operations, and/or other characteristics of aspects of the fastener extractor 106, the tie plate manipulator 102, the hammer assemblies, the anchor manipulator, the spikes 116, spike patterns, the tie plates 114, holes in the tie plates 114, the anchors 114(*a*), 114(*b*), the ties 110, and/or the rail 108. Additionally, one or more of the component monitors 121-1 may be disposed to capture data indicative of the location, surrounding vicinity, direction of travel, and/or the like of the railway maintenance assembly 105 in order to facilitate self-driving and remote-controlled driving operations.

In various embodiments, the one or more sensors 330 may include one or a combination of various types of sensors such as current sensors, LVDT sensors, position sensors, measurement sensors, distance sensors, proximity sensors, cameras for optical recognition, image analysis, metrics, and recognition, motion sensors, component sensors, ambient component photo sensors, photodiode photo sensors, optical detectors, photo detectors, color sensors, and/or the like. For example, a current sensor 330 may be configured to monitor the current flow to the railway maintenance assembly 105 component (e.g., one or a combination of the cylinders 132(*a*), 180, 182, 142, 124, 152, and/or the like components). The current sensor 330 may use a low-impedance resistive element which generates a voltage across it proportional to the current flowing. This voltage may be converted using an A/D converter 335 or a similar converter into a digital representation. In addition to providing information relating to the instantaneous current flow, this may also allow synchronization of functionality with AC cycles. The A/D converter 335 may possess a high resolution to accommodate wide variation in load currents and to have fast response time. The output of the A/D converter 335 may be fed to the monitor controller 340.

As another example, the component monitors 121-1 may, for example, include one or more sensors 330 attached to and disposed on the workhead to have various fields of view to detect various features such as positions, surfaces, edges, contours, relative distances, and/or any other suitable indications of the elements of the system 105-1 (e.g., the fastener extractor 106, the tie plate manipulator 102, the anchor manipulator, and/or the installer) and/or railway components (e.g., spikes, anchors, tie plates, and/or railway ties). The component monitors 121 may include one or more cameras 330 mounted and attached in any suitable manner to the frame 104 to have fields of view to capture images and/or other indications of various aspects of the railway ties 110, the tie plates 114, the holes of the tie plates 114, and/or the rail 108, the surrounding vicinity, direction of travel, and/or the like. The one or more sensors 330 may be attached to the forward leg 104(*a*), the rear leg 104(*b*), and/or a component of the upper structure of another part of the workhead.

By way of further example, one or more component monitors 121-1 including one or more sensors 330 (e.g., a linear variable differential transformer (LVDT) sensor) may be coupled to each of one or a combination of the cylinders 132(*a*), 180, 182, 142, 124, 152, and/or the like components to detect positioning, movements, and/or cycles of the respective cylinder and/or other component(s). Various embodiments of the component monitors 121-1 may be integrated with components of the railway maintenance assembly 105. By way of example, one or more of the other cylinders of the system 105-1 may correspond to a trunnion-mounted cylinder, where a component monitor 121-1 may include one or more of the sensors and may be coupled to a base end of the cylinder. In various instances, a component monitor 121-1 may be formed to mate with the cylinder (e.g., screwed into an end portion of a cylinder). This may allow for case of component monitor 121-1 add-on, serviceability, and maintenance, such that a component monitor 121-1 may be replaced without having to replace the entire cylinder. In like manner, one or more of the other cylinders of the component handling system 102 may be trunnion-mounted with the associated component monitors 121-1 to a base end of the respective cylinder. Various embodiments of the component monitor 121-1 may be adapted in size, shape, and/or function to be easily installed and used with existing cylinders and other components of the railway maintenance assembly 105.

Further, embodiments of the component monitor 121-1 may additionally or alternatively include or otherwise be communicatively coupled to one or more various other types of sensors 330, such as any one or combination of thermal sensors, radiation sensors, sound sensors, vibration sensors, proximity sensors, accelerometers, field sensors, electromagnetic sensors, magnetic sensors, pressure sensors, fluid flow sensors, and/or the like. For example, some embodiments may include a thermal sensor 330 configured to sense when and in what condition the railway maintenance assembly 105 component is operating by way of detecting heat emanating therefrom. As another example, some embodiments may include a radiation sensor 330 to sense when and in what condition the railway maintenance assembly 105 component is operating by way of detecting. The detected temperature values may be compared to baseline temperature values. Deltas between the baseline readings and the subsequent readings may be evaluated with respect to threshold ranges in order to assess component operational condition, predict remaining component lifespan, and match the determinations and predictions to one or more categories disclosed herein which may trigger maintenance actions. An impending component failure state, for example, could be detected if the temperature values for the component start to deviate from baseline temperature values suddenly or over time.

The baseline values may be observed values established using the sensor-based data, where the observed values correspond to an observed normal operating baseline for the particular machine and/or particular component(s). Alternatively, the baseline values may be predetermined values that correspond to rated values for the particular machine and/or component(s). In some embodiments, the baseline values may correspond to a combination of such predetermined values modified with observed values for the particular machine and/or particular component(s) and/or normalized values derived from previously observed patterns of baseline values for machines/component(s) of similar type or the same type.

As yet another example, some embodiments may include a sound sensor 330 may include configured to sense when and in what condition the railway maintenance assembly 105 component is operating by way of detecting acoustics (e.g., volumes, durations, directions, etc. and corresponding changes over time) emanating therefrom. As still another example, some embodiments may include a vibration sensor 330 configured to sense when and in what condition the railway maintenance assembly 105 component is operating by way of detecting vibratory motions generated and emanating therefrom. Likewise, various embodiments may include other types of sensors 330 configured to sense when and in what condition the railway maintenance assembly 105 component is operating by way of detecting pump case drain flow, hydraulic pressures, and/or the like to determine when and in what condition the railway maintenance assembly 105 component is operating (e.g., to monitor for indications of pump failure, imminent pump failure, and the like conditions and categories).

Again, baseline readings and subsequent readings may be evaluated in a manner similar to the above, but with respect to detected acoustics, vibratory motions generated, etc. In some embodiments, the determinations of component operational condition may be a function of a combination of the different types of operational metrics that are monitored based on sensor-based data (e.g., the metrics corresponding to temperatures, acoustics, vibratory motions generated, usage time values, cycles, etc.). Thus, deltas between the baseline readings and the subsequent readings may be evaluated with respect to threshold ranges for multiple types of detected phenomena, which may be factored into the determination of component operational condition and the prediction of component lifespan. Each delta may be scored and may add to an additive or overall score for the determination. Accordingly, for example, while the delta corresponding to a single factor may not on its own indicate an impending component failure state (or other category/state) in some instances, the multiplicity of contributing factors may correspond to an overall score that satisfies a threshold that does indicate an impending component failure state (or other category/state).

The monitor controller 340 may be the main intelligence responsible for monitoring and controlling actions of the component monitor 121-1. In some embodiments, the monitor controller 340 may be powered by the power storage 310. In some embodiments, the monitor controller 340 may include a microprocessor with programming instructions stored in any suitable form of non-volatile memory 345. The monitor controller 340 may include dedicated logic circuits programmed to detect and respond to defined input conditions. The monitor controller 340 may be configured to read the digital input values to determine the instantaneous sensor-based data. The monitor controller 340 may gather data and send communications to the controllers 170, 175, and/or 190 and/or the control system 401, in accordance with various embodiments disclosed herein. The non-volatile memory 345 may retain recordings of the sensor-based data. In some embodiments, the data may be stored for a sufficient time to allow for uploading of the data to the 170, 175, and/or 190 and/or the control system 401 via a communication module 355.

The monitor controller 330 may send notifications to the controllers 170, 175, and/or 190 and/or the control system 401, which may include sending notifications to the control system 401, according to various embodiments disclosed herein. To do so, the monitor controller 330 may utilize the communication module 355. The communication module 355 may facilitate communications with the control system 401 via one or more serial, bus, or wireless protocols and technologies which may include, for example, Wi-Fi, CAN bus, Bluetooth, I2C bus, ZigBee, Z-Wave, and/or the like. Thus, in some embodiments, communication module 355 may connect to a CAN bus of the control system 401 for the one or more railway maintenance assemblies 105. In some embodiments, the communication module 355 may include any one or combination of ZigBee, Bluetooth, Z-Wave, Wi-Fi, and/or the like RF communication modules which allow the component monitor 121-1 to communicate wirelessly with a central control point.

The component monitor 121-1 may include one or more antennae that may include a cellular antenna (e.g., for sending and receiving cellular voice and data communication, such as through a cellular network such as a 3G, 4G, 5G, or GSM network) data per disclosed embodiments. In some embodiments, the component monitor 121-1 may include a cellular modem to communicate data per disclosed embodiments. In addition, the component monitor 121-1 may include one or more interfaces in addition to the one or more antennae, e.g., a wireless interface coupled to an antenna. In some embodiments, the component monitor 121-1 may include a gateway or communicate with a gateway on another component monitor 121-1 that may bridge RF signals and other networks.

The component monitor 121-1 may be capable of communicating with a Global Positioning System (GPS) in order to determine to location of the component monitor 121-1. The component monitor 121-1 may include an antenna that may be a GPS receiver, or the component monitor 121-1 may otherwise include a GPS receiver. In various embodiments, communication with the component monitor 121-1 may be conducted with a single antenna configured for multiple purposes (e.g., cellular, communications, GPS, etc.), or with further interfaces (e.g., three, four, or more separate interfaces) such multiple antennae. The component monitor 121-1 may cooperate with the controllers 170, 175, and/or 190 and/or the control system 401 to facilitate tracking locations, speeds, time moving along a railway, distance moving along a railway, and location histories of component monitors 121-1 and coupled railway maintenance assembly 105 components and, hence, assemblies 105.

The component monitor 121-1 may access the one or more networks through a wireless link to an access point. For example, a component monitor 121-1 may access the one or more networks through one or more access points that may be of any suitable type or types. For example, an access point may be a cellular base station, an access point for wireless local area network (e.g., a Wi-Fi access point), an access point for wireless personal area network (e.g., a Bluetooth access point), etc. The access point may connect the component monitor 121-1 to the one or more networks, which may include the Internet, an intranet, a local area network, a public switched telephone network (PSTN), private communication networks, etc. In some embodiments, access point(s) may be used in obtaining location information for the component monitor 121-1. In various embodiments, the component monitor 121-1 and/or control system 401 may use GPS coordinates, cellular tower triangulation techniques, Wi-Fi-based location information, carrier-provided location information, and/or other location determination systems to identify a location of the component monitor 121-1 and coupled railway maintenance assembly 105 component.

In various embodiments, in order to reduce the amount of data that must be sent, the values could be averaged over a period of time and/or otherwise statistically represented with any suitable statistical calculations performed by the monitor controller 330. If the detected values for the railway maintenance assembly 105 component correspond to repeated values over a time period, the frequency of reporting may be further reduced, in some embodiments. For example, reporting could be directed to instances when a change occurs. In the case of a microcontroller-based system, the non-volatile memory 345 may also retain operating instructions, and/or they may be programmed in a read-only memory 350.

In addition, some embodiments the component monitor 121-1 may include an assembly interface 365. The assembly interface 365 may include terminals that may be electrically connected to conductors of the railway maintenance assembly 105, such as a power connector of the railway maintenance assembly 105. For example, the terminals may be in series with line conductors of the railway maintenance assembly 105, where the line conductors provide power from a power source. As another example, the terminals may be in parallel with line conductors of the railway maintenance assembly 105. The assembly interface 365 may include one or more switches coupled to at least one terminal for electrical coupling to the railway maintenance assembly 105 component. In some embodiments, the assembly interface 365 may include switches such as a suitable relay, semiconductor switch (e.g., a thyristor or TRIAC), and/or the like, and one or more resistive elements, and, in conjunction with a power charger 305, may be configured with power generation and transformer circuitry to charge a power storage 310 when power is available from the railway maintenance assembly 105 via the assembly interface 365. The power storage 310 may include one or more battery cells, one or more capacitors, and/or a similar charge storage device that can power the component monitor 121-1 and allow for communications when power from the railway maintenance assembly 105 becomes unavailable.

The component monitor 121-1 may be individually identifiable. For example, a unique identifier of the component monitor 121-1 may allow the component monitor 121-1 to be uniquely identified on the system 100. The unique identifier may facilitate pairing the component monitor 121-1 with the controllers 170, 175, and/or 190 and/or the control system 401. Any one or combination of several methods (e.g., bar code, QR code, serial number, device reader connected to computer, etc.) could be employed to provide the unique identifier.

Figure 4:
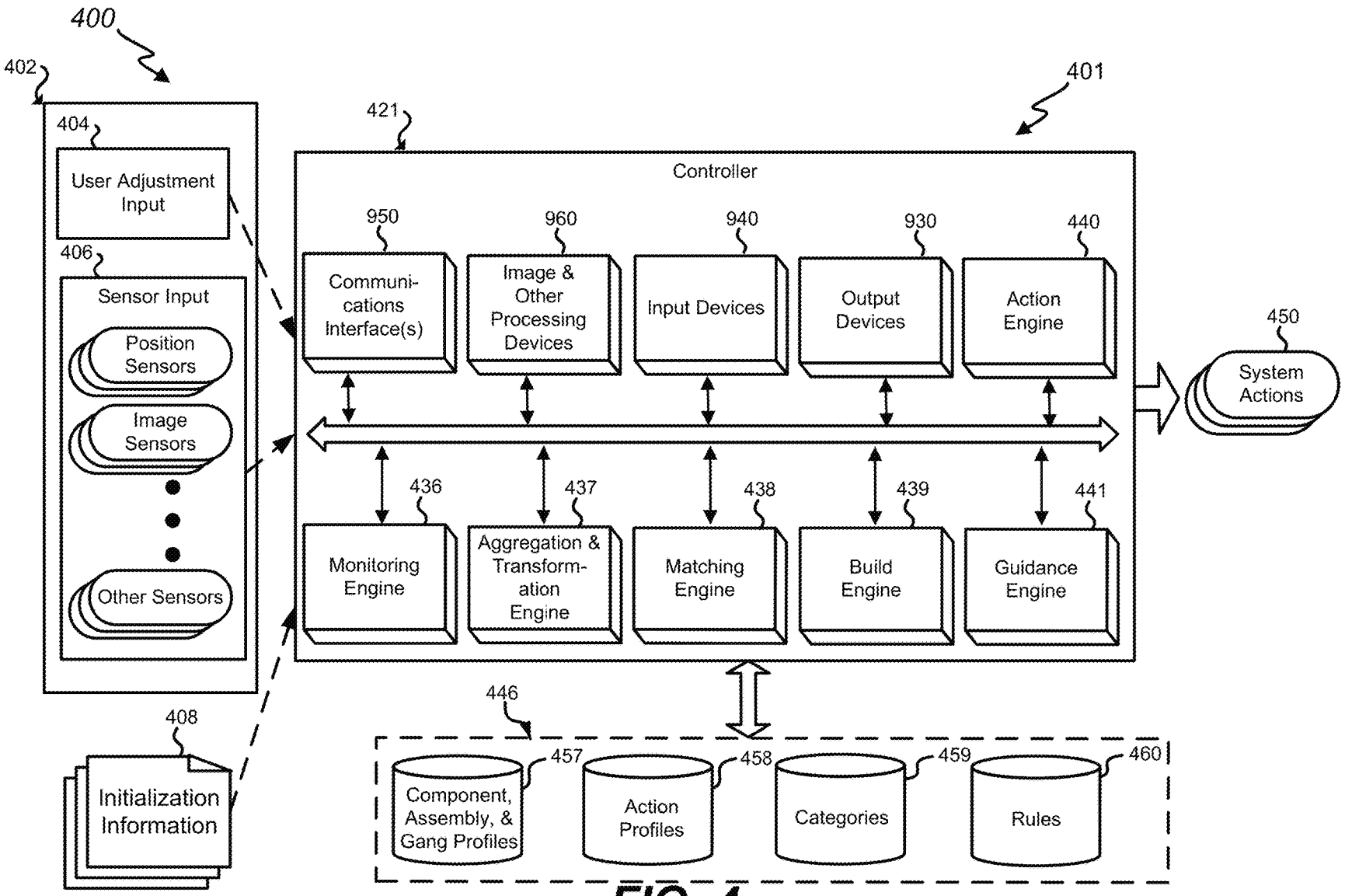
FIG. 4 illustrates a subsystem corresponding to a control system to facilitate component handling system automation control, in accordance with disclosed embodiments of the present disclosure.

FIG. 4 illustrates a subsystem 400 corresponding to the control system 401 to facilitate component handling system 105 automation control, in accordance with disclosed embodiments of the present disclosure. While the subsystem 400 is illustrated as being composed of a number of components, it should be understood that the subsystem 400 may be broken into a greater number of components or collapsed into fewer components. In various embodiments, each component may include any one or combination of computerized hardware, software, and/or firmware. In various embodiments, the subsystem 400 may include a controller and/or control engine 421, executed by one or more processors and may be implemented with any suitable device, such as a computing device, a standalone system controller device, a system controller device integrated with another device, such as operator station control device, an onboard computer of a railway maintenance assembly 105, etc.

In various embodiments, the subsystem 400 may correspond to aspects of the controllers 170, 175, and/or 190 in conjunction with the one or more component monitors 121 coupled to one or more railway maintenance assemblies 105. In various embodiments, the controller 421 may correspond to one or a combination of the controllers 170, 175, and/or 190 and may be referenced as a railway device controller. For example, the controllers 170, 175, and/or 190 may include the controller 421, in whole or in part. In some embodiments, various features of the controller 421 may be distributed between the two or more of the controllers 170, 175, and/or 190. While not all components of the subsystem 400 are shown, the subsystem 400 may include one or a combination of such components. In some embodiments, the controller 421 may be located in or about the operator's cab. In various embodiments, the controller 421 may be integrated with or otherwise communicatively coupled to controls of a railway maintenance assembly 105 (e.g., to control operations of the railway maintenance assembly 105 such as drive operations with an accelerator, shift mechanism, etc.).

The controller 421 may include communications interfaces 950, image processing and other processing devices 960, input devices 940, output devices 930, and other components disclosed herein. Some of such components are discussed further in reference to FIG. 5. As illustrated in FIG. 4, the controller 421 may be communicatively coupled with interface components and communication channels (which may take various forms in various embodiments as disclosed herein) configured to receive component monitor input 402 via the communications interfaces 950 and/or input devices 940. As depicted, the component monitor input 402 may include user adjustment input 404. The user input 404 may include real-time user control via a user interface—e.g., one or more interfaces provided via the operator station. User input may be provided by way of one or more user input devices, such as a touchscreen, a mouse, a track ball, a keyboard, buttons, switches, control handles, and/or the like.

The component monitor input 402 may further include sensor-based input 406 disclosed herein. The sensor-based input 406 may be captured by the sensor devices of the component monitors 121 disclosed herein. As described above, disclosed embodiments of the component monitors 121 may include a plurality of sensors 330 attached to any suitable structural element of the component handling system 105. In various embodiments, as disclosed herein, the one or more sensors 330 may be disposed to capture sensor data that facilitates sensing when and in what condition the railway maintenance assembly 105 components are operating. For example, one or more sensors 330 included in or otherwise communicatively coupled to one or more component monitors 121 may be attached to one or more of the cylinders, pumps, and/or the frame 104. For example, in disclosed embodiments, signals from component monitors 121 may correspond to signals from a plurality of sensors 330 that may be utilized by the control system 401 to detect movement, operations, and/or conditions of the workhead components, such as the components of the fastener extractor 106, the tie plate manipulator 102, the anchor manipulator, and the installer, and/or the assembly 105 itself (e.g., movement, speed, direction down the railway 108).

In various embodiments, the sensors 330, the component monitors 121, and the control system 401 may communicate by way of the one or more networks disclosed herein. In various embodiments, the sensors 330 and/or component monitors 121 may be coupled and connected in a serial, parallel, star, hierarchical, and/or the like topologies and may communicate to the control system 401 via one or more serial, bus, or wireless protocols and technologies which may include, for example, Wi-Fi, CAN bus, Bluetooth, I2C bus, ZigBee, Z-Wave and/or the like. For instance, one or more sensors and/or component monitors 121 may use a ZigBee® communication protocol while one or more other sensors and/or component monitors 121 communicate with the control system 401 using a Z-Wave® communication protocol. Other forms of wireless communication may be used by sensors 330, component monitors 121, and the control system 401. For instance, sensors 330, component monitors 121, and the control system 401 may be configured to communicate using a wireless local area network, which may use a communication protocol such as 802.11. The component monitors 121 may be connected with the control system 401 and/or the operator's station to enable communication with railway component adjustment devices. The component monitors 121 may be configured to allow for Zigbec®, Z-Wave®, and/or other forms of wireless communication. In some embodiments, the control system 401 and/or the operator's station may be enabled to communicate with a local wireless network and may use a separate communication device in order to communicate with sensors and component monitors 121.

Utilizing the processing devices 960, the subsystem 400 may process the component monitor input 402 and analyze the component monitor input 402 to facilitate at least partially autonomous or fully autonomous maintenance actions. The controller 421 may include a monitoring engine 436 configured to monitor the component monitor input 402 for any suitable aspects pertaining to the one or more railway maintenance assemblies 105. For example, the monitoring engine 436 may process reporting data, notifications, and/or other information enabling unique identification of railway maintenance assemblies 105 and component states, operational metrics, locations, and characteristics disclosed herein. Accordingly, in various embodiments, the controllers 170, 175, and/or 190 themselves may monitor the operational condition of all the railway maintenance assembly 105 components in the various system 100 instances. The operational condition monitoring may include monitoring whether or not a particular railway maintenance assembly 105 component is still functional, monitoring if one or more thresholds of usage (e.g., numbers of time values usage, cycles of operating components such as cylinder cycles, and/or the like) are being approached and/or satisfied, and/or monitoring other aspects as disclosed further herein.

In some embodiments, a monitoring engine 436 may gather and process component monitor input 402 to facilitate creation, development, and/or use of component profiles 457. The railway component profiles 457 may include railway component profiles 457, for each component monitored by a component monitor 121. The railway component profiles 457 may include action profiles 458, which may correspond to the maintenance actions disclosed herein. The railway component profiles 457 may include categories 459, such as reference image and characteristic data arranged, utilized, and refined via machine learning to facilitate the recognition, characterization, and categorization of railway components disclosed herein. The railway component profiles 457 may include rules 460 for handling the thresholds, operator selections, inconsistencies, nonconformities, errors, operational modes, and/or the like disclosed herein.

The railway component profiles 457 may include any suitable data that may be captured to indicate, infer, and/or determine component identification; component usage, component operational metrics, and corresponding patterns; component history and actions taken with respect to the component; component locations, speeds, and location histories; corresponding temporal factors and contexts; and/or the like. Further, one or more of the railway component profiles 457 may be included in or may be mapped to railway maintenance assembly 105 profiles for particular railway maintenance assemblies 105. Such machine profiles may include similar data on a machine basis. Accordingly, the system may learn and arrange machine signature, real-time operational metrics and patterns (which may include, for example, output metrics and efficiency metrics-currently, on particular days, months, years, etc.), and/the like for each assembly 105.

Still further, one or more of the machine profiles may be included or may be mapped to gang profiles for sets of railway maintenance assemblies 105 designated to cooperate as a gang. A gang of railway maintenance assemblies 105 may be referenced herein as a subset of machines, a subset of resources, and/or a subset of railway maintenance assemblies 105. Such gang profiles may include data similar to the component profiles and machine profiles, but on a gang basis. This may allow for analysis and surfacing of information on all pieces of equipment in a gang. Thus, for example, overall output and efficiency metrics for a gang (e.g., real-time, on particular days, months, years, etc.) may be determined and made accessible through the user interfaces.

In various embodiments, the railway component profiles 457 may be implemented in various ways. For example, one or more data processing systems may save the profile data. One or more relational or object-oriented databases, or flat files on one or more computers or networked storage devices, may retain the profile data. In some embodiments, a centralized system stores the profile data; alternatively, a distributed/cloud system, network-based system, such as being implemented with a peer-to-peer network, or Internet, may retain the profile data. The various aspects of the profiles data repositories 457 may be stored separately or collected and selectively stored into one repository.

The controller 421 may include a matching engine 438. The matching engine 438 may be configured to perform any one or combination of features directed to matching or otherwise correlating information—and, in some embodiments, implementing machine learning—about components, action data, location data, temporal data, and/or the like. The captured data may be aggregated, selected/filtered, and transformed into refined profiles 457. In some embodiments, the monitoring engine 436 and/or the matching engine 438 may facilitate one or more learning/training modes. Some embodiments may perform image analysis of image data captured with cameras on one or more components of the railway assemblies 105 and/or other associated devices to determine one or more image baselines for railway assembly 105 components. Captured railway image data may be correlated to reference images using any suitable railway component traits for correlation. The matching engine 438 may receive from the monitoring engine 436 data corresponding to the component monitor input 402, the data corresponding to one or more components of the assemblies 105.

The matching engine 438 may identify attributes of the one or more components based at least in part on the sensor data and the component information 457, and match the one or more components to one or more categories from a category information repository 459. The component information 457 may include information stored for particular railway maintenance assemblies of the system 100. By way of example, the component information 457 may include device profiles for particular railway maintenance assembly components, which profiles may include device identifiers, corresponding location identifiers, model information for the railway maintenance assembly components, history information for the railway maintenance assembly components such as install instance time and historical operations metrics data, expected life balance, predicted end of life, and/or the like. Captured component reporting data may be correlated to component information 457 using any one or combination of device identifiers, corresponding location identifiers, model information for the railway maintenance assembly components, and/or the like. The matching engine 438 may be configured to match particular component data to component information 457 saved for railway maintenance assemblies 105 of the system 100. For example, the matching engine 438 may link particular component monitor input 402 to one or more device profiles with stored in the component information 457 to identify a known components or a new component and update or create a corresponding device profile.

The matching engine 438 may be configured to match particular component information captured via the monitoring engine 436 to one or more categories from a set of categories 459. Any suitable category may be employed to facilitate device management features in accordance various embodiments. By way of example, category information may include categories and corresponding specifications to qualify for particular categories such as new device, functional, component use, heavy use, early life stage, mid-life stage, end-of-life stage, end-of-life imminent, non-functional, over-voltage exposure, under-voltage exposure, overpressure conditions, over-vibration conditions, overheated situation, cold temperature mismatch situation, operator misuse indications (e.g., when an operator uses equipment in a manner that causes the equipment to undergo extreme vibration and wear), and/or the like. In some embodiments, the rules 460 may include specifications for matching a set of indications of components states and characteristics to a set of one or more categories. In some embodiments, the rules 460 may include specifications for matching a set of one or more categories to a set of one or more maintenance actions.

In some embodiments, sensors 330 may detect ambient temperature differences to infer when the railway maintenance assembly 105 component is operational and when it is not. Further, the sensor data may be used to determine baseline temperature values (e.g., ranges of temperatures) for normal operations of the railway maintenance assembly 105 component. The baseline values may be used to detect deviations therefrom to infer when the railway maintenance assembly 105 component is operating in an overheated condition. Thus, the sensor data may detect ambient temperatures to facilitate embodiments disclosed herein that identify cold temperature conditions (e.g., outdoor temperatures, which may be used to detect if a particular railway maintenance assembly 105 component is suitably rated for the colder ambient temperatures) and/or hot temperature conditions. Other embodiments are possible with respect to other types of sensor data, such as that disclosed herein. For example, in some embodiments, sensors 330 may detect sounds and the matching engine 438 create and develop audio profiles for the railway maintenance assembly 105 components, e.g., based at least in part on volumes, direction, and/or other sound characteristics of the detected sounds. Similarly, in some embodiments, sensors 330 may detect vibratory motions generated, and the matching engine 438 may create and develop audio profiles for the railway maintenance assembly 105 components, e.g., based at least in part on intensity, direction, and/or other vibration characteristics of the vibratory motions generated.

Certain embodiments may generate thresholds by learning the normal operating states of the railway maintenance assembly 105 components. The monitoring engine 436 and/or the matching engine 438 may generate, develop, and/or otherwise use particularized component profiles 457 for each railway maintenance assembly 105 component that may include baseline detected sensor data attributed to the particular component. Subsequent detected sensor data for the component may be used, in conjunction with previously detected sensor data, to determine changes between the baseline readings and the subsequent readings. Differences between the readings may be used to develop the develop the profiles 457 and filter for deviations and aberrations with respect to the baselines.

For example, the matching engine 438 may correlate detected sensor data with an operator to arrange operator metrics that are indicative of the operator's performance when operating one or more railway maintenance assemblies 105. The operator metrics may include performance metrics such as speed, efficiency, accuracy metrics/error rates/history, and/or the like. For example, real-time sensor data may be used by the control system 401 to identify and measure hits versus misses in pulling or driving spikes in tie plate holes, how many attempts are needed to perform various operations, misuse of equipment such that the equipment undergoes extreme stress, correctly identifying versus misidentifying spike driving instance targets (e.g., identifying a spike hole via the user interface in a position where there is no spike hole detected, overlooks a spike hole by not selecting the spike hole via the user interface for extraction, or selects an obstructed spike hole or already fastened hole for spike driving instance), measurements of hand-eye coordination, and/or the like metrics. The operator metrics for a given operator may be qualified and mapped categories that are indicative of the operator skill levels, proficiencies, deficiencies, solutions, strength values, and/or the like. As another example, the matching engine 438 may determine that, regardless of the type, model, and/or rating of railway maintenance assembly 105 component used by a particular operator, railway maintenance assembly 105 components consistently underperform with respect to rated lifespans. Hence, the matching engine 438 may identify a potential operator deficiency. The matching engine 438 may corroborate or countervail such identification when the matching engine 438 detects over-voltage exposure, under-voltage exposure, over-pressure conditions, over-vibration conditions, overheated situation, cold temperature mismatch situation, operator misuse indications, and/or the like. Such operator metrics and categorizations may be stored in operator profiles which may be saved in one or more action profile repositories 458 or another repository 446.

Any suitable power usage and/or operational condition metrics may be derived to indicate power usage and/or operational condition determinations associated with any one or combination of operational modes. This may allow for the surfacing of power usage and/or operational condition determination information to an end user on a per-railway maintenance assembly 105 component basis and/or on an aggregated basis. Power usage and/or operational condition determination information may be processed for any suitable time period. By monitoring the normal component operational metrics over time, certain embodiments may be configured to provide a warning via the interface and/or the notifications disclosed herein when the operational metrics are steadily changing over a period of time. For example, the controller 421 may determine that there is an impending component failure and then may present a warning. An impending component failure state, for example, could be detected if the railway maintenance assembly 105 component starts to deviate from baseline operational metrics suddenly or over time. The controller 421 may determine other states, as well. Comparisons current and past usage and/or operational condition determination information may be surfaced to an end-user interface on a per-railway maintenance assembly 105 component basis and/or on an aggregated basis. Indications of operational condition determinations may include operational condition scores, operational condition bars, timetable information from the timetables, bar graphs, numerical indicators, textual descriptions, and/or any other suitable graphical indications.

For example, having captured data, the monitoring engine 436 may implement one or more device determination processes. The one or more individual device determination processes may include one or more metric analysis processes to make an operational condition determination of an individual railway maintenance assembly 105 component. Data corresponding to component monitor input 402 may be collected, selected/filtered, and processed to yield a railway maintenance assembly 105 component operational condition score. Some embodiments may qualify an individual railway maintenance assembly 105 component according to a gradated operational condition determination scale. Any suitable operational condition determination scale may be used in various embodiments. In some embodiments, an operational condition determination scale could entail a categorization scheme 459, with categories such as the examples disclosed above. In some embodiments, the operational condition determination scale may entail a railway maintenance assembly 105 component operational condition scoring system. The individual railway maintenance assembly 105 component operational condition scores may be correlated to the category scheme in some embodiments, such that certain scores correspond to certain categories. Some embodiments may score a railway maintenance assembly 105 component with a numerical expression, for example, a railway maintenance assembly 105 component operational condition score.

By way of example, one scale could include a range of railway maintenance assembly 105 component operational condition scores from 0 to 100, or from 0 to 1,000, with the high end of the scale indicating greater device operational condition. Some embodiments may use methods of statistical analysis to derive a railway maintenance assembly 105 component operational condition score. A score may be determined based at least in part on comparing recorded device usage to a life expectancy specified (e.g., in time values and/or operating cycles) for the device. With recorded device usage and the life expectancy, the operational condition controller 421 may calculate an expected life balance for the railway maintenance assembly 105 component and assign a corresponding score to the railway maintenance assembly 105 component.

A device profile for a particular railway maintenance assembly 105 component may include component specifications for the railway maintenance assembly 105 component (e.g., a life expectancy specification, model information, component type, component rated values, and/or the like). The component specifications may, in some cases, be system-determined. In some embodiments, the component monitor 120 and/or controllers 170, 175, and/or 190 may be preset by, say a manufacturer and/or service provider, with the one or more component specifications. In some embodiments, the railway maintenance assembly 105 component may include an operational condition monitor 120 that is self-aware such that the railway maintenance assembly 105 component stores its component specifications. The component specifications may be communicated from the component monitor 120 to the controller 421. In some embodiments, the controller 421 may pull that information from the component monitor 120.

In addition or in alternative, the controller 421 and/or the component monitor 120 may pull component specifications for particular models from remote data sources. For example, the controller 421 may search the data sources with one or more queries made via one or more networks. In some cases, the queries may be directed to source systems of the railway maintenance assembly 105 components. In some cases, the queries may be directed to an aggregator of railway maintenance assembly 105 component information, for example, a service provider associated with the controller 421 and/or the component monitor 120. In some cases, specification information may be gathered from a source system with each replacement order made by the controller 421 and/or the component monitor 120, and components specifications may be recognized by the controller 421 and/or the component monitor 120 from the specification information provided by the source system.

In some cases, user input 404 may specify component specifications. A user could have the option to define and/or select one or more component specifications via controllers 170, 175, and/or 190. In other cases, the component specifications for a given railway maintenance assembly 105 component may not be immediately obtainable by the controllers 170, 175, and/or 190. In such cases, the controllers 170, 175, and/or 190 may estimate component specifications. The controller 421 may monitor the operational characteristics of particular railway maintenance assembly 105 components—for example, the power draw of the railway maintenance assembly 105 component. Some embodiments may allow for matching unknown components with other components. For example, it may be determined whether one or more of the operational characteristics of an unknown component match operational characteristics of another already recognized component. The one or more characteristics can be compared with those of another, already recognized component, and, if the one or more characteristics matched within a tolerance threshold (say, a tolerance of plus or minus 1%, 5%, or any other suitable tolerance), the unknown component can be determined to match with the component specifications (and/or category) of the second component. Then, the component can be mapped to the component specifications (and/or category) of the already recognized component.

A score may be determined based at least in part on comparing recorded device usage to a life expectancy specified (e.g., in time values and/or cycles) for the railway maintenance assembly 105 component. With an operational condition score determined, categorizations may be made based on the score. By way of example without limitation, a score correlated to a 75-100% band may be categorized as early life stage; a score correlated to a 50-75% band may be categorized as a mid-life stage; a score correlated to a 25-50% band may be categorized as an end-of-life stage; a score below a 50% minimum threshold may be categorized as an end-of-life imminent stage; and score of zero may correspond to a non-functional or absent railway maintenance assembly 105 component. Other categorizations may be used in various embodiments.

Additionally, in some embodiments, a score may be adjusted by the controller 421 taking into account other detected attributes of a particular railway maintenance assembly 105 component. For example, if an over-voltage condition, an over-pressure condition, an over-vibration condition, an overheated condition, and/or the like is detected and is determined to satisfy one or more thresholds, the score may be decreased to account for the shortened lifespan that the one or more conditions may cause. Responsive to such conditions being detected, certain embodiments may also send notifications of the conditions to a controller 170, 175, and/or 190, an end-user device (e.g., a mobile device), a user account (e.g., an email account, a messaging ID, a phone number, etc.) which is user-specified, and/or the like. Further, the notification disclosed herein may include live reports for each railway maintenance assembly 105 and/or component operating in the field, with such reports indicating any one or combination of the types of reporting information gathered by component monitors 121 and/or created/developed by the controller 421, such as the operational metrics, operator metrics, categorizations, and/or the like map to identifiers of assemblies 105, components, and/or operators.

In various embodiments, the matching engine 438 may generate, develop, and/or otherwise use device profiles 457 based at least in part on input 402 over time. The matching engine 438 may include a reasoning module to make logical inferences from a set of the detected and differentiated data to infer one or more patterns of operational performance for particular railway maintenance assembly components in various locations. A pattern-based reasoner could be employed to use various statistical techniques in analyzing the data in order to make inferences based on the analysis. A transitive reasoner may be employed to infer relationships from a set of relationships related to arranged data. For instance, the matching engine 438 may compare detected lifespans of certain railway maintenance assembly 105 components to rated life expectancies for the railway maintenance assembly 105 components to identify consistencies between actual lifespans and rated life expectancies, inconsistences between actual lifespans and rated life expectancies, actual tolerances where actual lifespans are within (or not within) a certain tolerance with respect to rated life expectancies, and/or the like.

The monitoring engine 436 and/or the matching engine 438 may monitor location data for individual assemblies 105. With such location detection, the matching engine 438 may identify proximities of assemblies 105 with respect to one another such that the matching engine 438 may identify which assemblies 105 are associated in particular gangs. Further, the matching engine 438 may detect changes in locations for particular assemblies 105, which may include detecting changes in proximities with respect to other machines. Based on such detected changes, the matching engine 438 may identify when particular assemblies 105 move outside of particular distance thresholds. For example, relative distance with respect to one or more other assemblies 105 and/or absolute distance with respect to one or more reference points, such as distance based on GPS coordinates, mileposts/mile markers, may be input into control system 401 as particular distance thresholds. Such distance thresholds may be specified for a particular time duration (e.g., daily). These limits may correspond to safety limits and control set for each day. Oftentimes, a gang is limited to a particular section of a railway 108 for particular time in order to control traffic and maintain safety. The real time locations of railway maintenance assemblies 105 can therefore be monitored and surfaced in real-time via one or more of the operator interfaces disclosed herein (such as shown on a map display of one of the interfaces 600, 650. Further, when such distance limits are exceeded, the controller 421 may transmit a notification to one or more end-user devices previously associated with the system 100. In addition or in alternative, notifications may be presented at a controller 170, 175, and/or 190. In various embodiments, the notifications may take the form of email notifications, push notifications, text message notifications, pop-up windows, modal windows, and/or the like which may be sent to the controller 170, 175, and/or 190 and/or an account linked with the system 100. In some embodiments, the notification to the one or more end-user devices may include an action-performance duration which specifies a time boundary value in which the corresponding corrective action (e.g., moving out-of-bounds railway maintenance assemblies 105 back in bounds) is to be performed.

Also based on such detected changes, the matching engine 438 may identify gang changes, where assemblies 105 are removed from an identified gang and/or are placed in an identified gang. The controller 421 may assign each gang a unique ID. Based on user adjustment input via the interface, the controller 421 may allow for the unique ID to be user modified. When the controller 421 detects a movement of a machine 105 from one gang to another gang, the controller 421 may send a notification to alert the user to the change and to confirm or override, with one or more user-selectable interface elements, automatic reassignment of the machine 105 to the new gang and its corresponding gang ID. Because particular gangs may be structured differently, the controller 421 may update the gang profiles to reflect the gang changes. For example, the controller 421 may update parameters for the original gang and the new gang (e.g., max capacities; total number of machines and components; different types of machines, components, and functions; etc.).

The matching engine 438 may determine patterns for individual locations, characteristics of locations, and operators. For example, the matching engine 438 may determine average separation distances between assemblies 105 in a gang during the day, fluctuations, and how relates to output metrics for the gang. Similarly, the matching engine 438 may track output metrics as a function of lineal feet of rail (e.g., for a rail gang of assemblies 105) or miles of rail (e.g., for a tie gang of assemblies 105). The controller 421 may surface information indicative of the patterns via a user interface and/or notifications as disclosed above. Likewise, the controller 421 may send alerts regarding anomalies with respect to patterns (e.g., when particular assemblies 105 move outside of particular distance thresholds, and/or when particular assemblies 105 in a gang move out of mutual proximity beyond a particular proximity distance threshold).

As another example, the matching engine 438 may determine railway maintenance assembly 105 components in a given location or type of location (e.g., locations have certain characteristic corresponding to railway curves, declines, etc.) have only a 80-90% actual life span when used in that location or type of location. The matching engine 438 may determine that that life span deficiency is independent of (or dependent on) the type, model, and/or rating of railway maintenance assembly components used. Thus, the matching engine 438 may identify areas having additional factors that affect component life spans and corresponding component operational condition scores. Accordingly, one or more maintenance actions may be initiated as a function of the detected additional factors and decreased predicted lifespans, so that such maintenance actions may be taken at a stage that is earlier than would be typical for the components. Again, responsive to such conditions being detected, certain embodiments may also surface information indicative of the patterns via a user interface and/or notifications as disclosed above.

The gang metrics may include lead-in time and lead-out time, which may correspond time needed for transitioning assemblies 105 to locations where the assemblies actually begin to operate on the railway (e.g., the assembly 105 components begin to function to remove spikes, adjust railway components, driving spikes, etc.). The gang metrics may include chronicling operations and idleness sequences of individual railway maintenance assemblies 105 with respect to other assemblies 105 in a gang. Because the railway maintenance assemblies 105 of a gang are railbound and operating in sequence, one assembly 105 may not be able to operate to perform its tasks until one or more previous assemblies 105 have completed their tasks. Thus, in some cases, assemblies 105 may be idle while waiting on other assemblies 105 to complete operations. The chronicling operations and idleness sequences of machines in a gang may facilitate determination of one or more causes of idleness, identifying one or more weak links in the gang, identifying bottlenecks, identifying machines utilized toward top capacity, identifying machines utilized at low capacity, identifying output and operations windows (e.g., identifying 4-hour output for a 6-hour operations window), and/or the like.

The operational metrics derived by the matching engine 438 may take into account that a machine's capacity to produce is different depending on environment and gang type. Accordingly, the operational metrics may be a function of such factors. For example, the gang type may factor in differently to affect the method of determining output metrics. Likewise, the gang type may factor in differently to affect the method of determining operational condition determinations of railway maintenance assembly 105 components as well. A rail gang, for example, may typically only perform operations on one side of rail at a time, and, hence, only one side of the equipment may be used at a time. By contrast, in a tie gang, both sides of equipment may be used at the same time, which results in higher wear and tear on the equipment of the assemblies 105 in the tie gang (e.g., pumps pumping more oil times per hour, double wear for using both sides, etc.). Thus, the matching engine 438 may distinguish operations cycles of one side of equipment of a machine 105 from operations cycles of the other side of equipment of the machine 105.

The operational metrics may include overall equipment effectiveness (OEE) metrics. The overall equipment effectiveness may be defined as the ratio of actual production to expected or planned production. Overall equipment effectiveness may be expressed as a percentage where 100% represents an ideal production rate for a given railway maintenance assembly 105. Overall equipment effectiveness may be a summary metric which captures the net effect of utilization, equipment breakage, operations interruptions, equipment and operator efficiencies. Overall equipment effectiveness may be a key performance indicator for overall output of a single railway maintenance assembly 105 within that time period. For operations equipment, production may be measured in railway ties per hour, and overall equipment effectiveness may be calculated per railway maintenance assembly 105 as the ratio of recorded production to a maximal capacity to produce that the system determines as historically established by way of monitoring and pattern recognition. For example: OEE %=(ties completed this hour)/(machine maximum capacity).

The matching engine 438 may use hourly OEE % to calculate aggregate summary statistics for longer periods of time (multiple time values, day, month, etc.) and/or aggregates for various sizes of groups of equipment 105. Historical production capacity may be derived from prior observation data gathered by the system with respect to each machine 105 type. The matching engine 438 may use any suitable algorithm and/or statistical analysis to directly calculate the maximal capacity from a machine's historical data gathered by the system and stored in the machine 105 profile or a database of representative data for a machine 105 type.

The controller 421 may increment a tie counter based on the logical signals collected from the railway maintenance assembly 105 with the sensor-based data 406 monitored by the monitoring engine 436. The matching engine 438 may use pattern recognition to confirm when the railway maintenance assembly 105 has completed its operations over one railway tie and is moving to index over the next railway tie, as well as to ignore instances of repetitive operations motions over a single railway tie that could be falsely interpreted as additional tie counts. As disclosed herein, some examples of these logical signals may include assembly 105 propel motions and timing, and assembly 105 workhead motions. The matching engine 438 may compute and report the OEE % on an hourly basis every hour the assembly 105 is running. To enhance accuracy, the matching engine 438 may selectively identify and track, based on the input 402, idle times, transit times to operations sites, and/or waiting times for operations authorization which all depress the calculated OEE %, and may selectively eliminate such times and/or other activity metrics from the computation of the OEE %.

The operational metrics may include production variance metrics. Production variance may be a high-level key performance indicator for a gang of railway maintenance assemblies 105. Production variance may be a daily summary metric (and/or summary metric over a different time period) calculated from the difference in lead-in time and lead-out time. Lead-in time may correspond to the time elapsed from the first spike pulled for that day (or other time period) to the first spike driven for that day (or other time period). Lead-out time may correspond to the time elapsed from the last spike pulled for that day (or other time period) to the last spike driven for that day (or other time period). For example: production variance=[time (first spike driven)−time (first spike pulled)]−[time (last spike driven)−time (last spike pulled)].

Ideally, the line of railway maintenance assemblies 105 moves at a consistent rate and at maximal capacity. Production variance may quantify the consistency of the entire gang's production over a particular time period. Positive variance may indicate that the gang processed operations more efficiently over the time period—for example, as the day progressed. Negative variance may indicate lost efficiency over the time period. A single large production variance might be caused by a disruption such as equipment breakdown or changing operations conditions. A pattern in variance might emerge from asymmetrical operations-loading along the gang (overproduction or underproduction) and might be used as a basis for a change in the gang that may be facilitated by one or more system actions 450.

The controller 421 may include an action engine 420 which may be configured to cause one or more control actions 450. In some embodiments, the action engine 420 may analyze input 402 monitored by the monitoring engine 436, determinations of the matching engine 438, and/or information stored in the one or more repositories 457 to make maintenance action determinations, which may include the controller 421 mapping one or more action types as actionable regarding one or more railway maintenance assembly 105 components.

The controller 421 may identify an alteration condition regarding one or more railway maintenance assembly 105 components, such as a change in operations that satisfies one or more thresholds. Such changes may include an increase in detected usage time values and/or cycles such that the accumulated usage/operating time values and/or cycles for one or more railway maintenance assembly 105 components satisfies one or more thresholds. As another example, such changes may include a change in operational status (e.g., a railway maintenance assembly 105 component is no longer detected as functional). Likewise, such changes may include a deviation in detected sensor data for any of the types of sensor data disclosed herein with respect to monitoring operational metrics and/or operator metrics corresponding to railway maintenance assemblies 105 and/or components, where the deviation satisfies one or more threshold values. These changes may result in a corresponding change in one or more operational condition scores and/or operational categories. The controller 421 may identify one or more actions 450 corresponding to the identified one or more action types. Based at least in part on one or more maintenance action determinations, the action engine 420 may cause activation of one or more system actions 450 that correspond to one or more determined maintenance actions.

In various embodiments, one or more system actions 450 may facilitate or be at least partially autonomous maintenance actions. The one or more system actions 450 may include notifications. For example, the controller 421 may transmit a notification to one or more end-user devices previously associated with the system 100. In addition or in alternative, notifications may be presented at a controller 170, 175, and/or 190. As another example, the controller 421 may transmit updates of usage/operating metrics, other metrics, indications of detected conditions, and/or the like to the one or more end-user devices. In various embodiments, the notifications may take the form of email notifications, push notifications, text message notifications, pop-up windows, modal windows, and/or the like which may be sent to the controller 170, 175, and/or 190 and/or an account linked with the system 100. In some embodiments, the notification to the one or more end-user devices may include an action-performance duration which specifies a time boundary value in which the corresponding action is to be performed. The one or more system actions 450 may further facilitate the one or more end-user devices to perform a corresponding maintenance action, such as place an order for one or more replacements with a resource-controlling system via one or more networks. To facilitate the action performance, the notification may include a user-selectable option to specify ordering one or more replacements of railway maintenance assembly components with a resource-controlling system, such as a source system that may be one of the sources available via one or more networks. In some cases, the user-selectable option may include a URL specific to the replacement resource available from the resource-controlling system.

As yet another example, the one or more system actions 450 may include ordering actions. The controller 421 may place an order for one or more replacements with a resource-controlling system via one or more networks. As disclosed above, with certain embodiments, the communications from one or more component monitors 120 may include various commands in various embodiments. For example, in some embodiments, a command may correspond to a request to order one or more replacements for the railway maintenance assembly 105 component after the railway maintenance assembly 105 has analyzed its data recordings with respect to one or more operational thresholds and determined that there is (or will be within a certain time frame) a need for a replacement. The request to order may be directed to a controller 170, 175, and/or 190 in some embodiments. The controller 170, 175, and/or 190 may in turn transmit a notification to one or more end-user devices previously associated with the system 100 and/or place an order for one or more replacements with a resource-controlling system via one or more networks. With other embodiments, the request to order may be directed to a resource-controlling system via one or more networks, such that the component monitor 120 directly places a replacement order. In some embodiments, after an initial instance of a user confirming an order of a particular component, the controller 421 may learn from the instance and thereafter automatically place orders for additional replacements for the particular component when the system-determined needs arise. Likewise, with other initial learning instances with respect to other components, the controller 421 may progressively automatically perform the ordering processes for the assemblies 105.

Disclosed embodiments may further provide for one or more system actions 450 that include intelligent timetable management. A timetable monitor may be included in the action engine 420 in some embodiments and, in other embodiments, may be separate from the action engine 420. The timetable monitor may update one or more timetables in an action data store 458, which may be included in the device information repository 457 in some embodiments but, in other embodiments, may be separate. In some embodiments, the timetable monitor may monitor electronic communications, received via the one or more interfaces, from one or more component monitors 120, the controller 170, 175, and/or 190, and/or one or more remote resource-controlling systems. The timetable monitor may identify updates to timetables of railway maintenance assemblies 105 components and/or replacement orders. The timetables of railway maintenance assemblies 105 components may indicate determinations of usage, expected life balance, predicted end of life, and/or the like. The timetables of replacement orders may indicate lead time for replacement orders, buffer time for provisioning after order placement, buffer time for restoring a railway maintenance assembly 105 component (rather than assuming immediate restoration), and/or the like. The timetable monitor may update the timetables based at least partially on historically monitored actions.

Disclosed embodiments may further provide for one or more system actions 450 that include replacement availability tracking. The controller 421 may track quantities of replacements versus replacements used. For example, with embodiments where either the component monitor 120 or the controller 170, 175, and/or 190 directly places a replacement order, the quantity of replacement components ordered may be tracked in the timetable data store. The tracked quantity of replacement components ordered may be added by the timetable monitor to a current availability record upon reception of a delivery notification or after an estimated delivery time has passed. Further, used, end-of-life, or non-functional components may be logged. Instances of replacements of the used, end-of-life, or non-functional components may be detected. Such instances may be logged, and the current availability record may be updated to decrement an estimated quantity of available replacements.

In various embodiments, the one or more information repositories 457 may be implemented in various ways. For example, one or more data processing systems may store information. One or more relational or object-oriented databases, or flat files on one or more computers or networked storage devices, may store information. In some embodiments, a centralized system stores information; alternatively, a distributed/cloud system, network-based system, such as being implemented with a peer-to-peer network, or Internet, may store information. The information repositories 457, which may include category information repository 459, rules repository 460, component profiles repository 457, and timetable information action profiles repository 458 may retain any suitable information to facilitate certain features disclosed herein and may be separate repositories or collected, filtered and selectively stored into one repository. By way of example, the one or more information repositories 457 may store user information that may include any one or combination of user account information, contact information (such as linked email account information, telephone information, etc.), notification preferences (such as whether the user has accepted email notifications, push notifications, text message notifications, etc. as means of relaying notifications), user account information with a resource-controlling system, railway maintenance assembly 105 component information, and/or the like.

As disclosed herein, the controller 421 may generate a user interface for an operator to view and control various aspects of the system 100 via user-selectable options of the user interface. Via the user interface, the controller 421 may provide for a railway maintenance assembly 105 emulator, which may emulate each particular railway maintenance assembly 105 and/or component to surface the operational metrics, usage/operating time values, operational condition determinations, states, alerts, categories, scores, gang metrics, and/or the like metrics and characterizations of particular railway maintenance assemblies 105 and/or components disclosed herein. Such features may be extended to not only railway maintenance assemblies 105 and/or components, but also gangs. The emulator may provide visualizations and interfaces that allow for accurate presentation of such metrics and characterizations of each railway maintenance assembly 105, assembly 105 component, and/or gang. The emulations may be updated in real time, substantially real time, or upon detected state changes in railway component states and/or operations. For example, the emulator may provide live views of the railway maintenance assemblies 105 and/or components that accurately represent the states of the railway maintenance assemblies 105 and/or components in real time.

The system actions 450 may include compliance actions such as collecting and processing regulatory requirements and client-specific requirements pertaining to maintenance actions, adapting to changing compliance requirements, and providing compliance protocols, specifications of interface elements, programs, and/or the like. Such protocols, specifications of interface elements, and programs may be augmented with other system actions 450 disclosed above pursuant to the sensor-based monitoring, usage/operating time determinations, component operational condition determinations, and/or the like. Some embodiments of the control system 401 may provide for a compliance tool subsystem. The analytics for the compliance tool subsystem may be implemented with any one or combination of embodiments disclosed herein. In various embodiments, the compliance tool subsystem may aggregate and process regulatory requirements and client-specific requirements pertaining to maintenance actions that should be performed with respect to the system 100. The regulatory requirements and client-specific requirements may, for example, be specified with an FRA logbook, a client-specific logbook, and/or the like. The compliance tool subsystem may be adaptive to changing compliance requirements of particular clients, administrative agencies, and/or the like.

To facilitate that, various embodiments of the control system 401 may be configured to receive, process, and transform an initialization document received via an interface, in order to create interactive, adaptive specifications of interface elements specifying compliance requirements and tasks (e.g., for an operator to complete), such as checking fuel levels, checking oil levels, checking hoses, lubing parts, tasks for the start of the dating, tasks for the end of the day, tasks for any suitable time period, etc. In various embodiments, an initialization document may be pre-loaded and/or directly transferred to the control system 401 (e.g., via a storage medium) in addition to or in lieu of transferring data via a network. The monitoring engine 436 could handle processing, extracting, formatting, and/or storing data in information repositories 446, including data for initialization document portions. The assembled data may then be analyzed to determine one or more attributes of the initialization document portions.

In various embodiments, the initialization document may correspond to user input in a setup spreadsheet that may specify tasks, task types, sequences of tasks, start times, finish times, frequencies, etc. The initialization document may correspond to one or more spreadsheets, such as a workbook, which may, for example, be downloaded to the control system 401 and processed to create configuration data for compliance protocols, specifications of interface elements, programs, and/or the like which may be exposed to an operator via the user interface to ensure conformance with the compliance requirements. In some embodiments, the control system 401 may create one or more configuration files or documents with the configuration data to facilitate compliance protocols, specifications of interface elements, programs, and/or the like.

The compliance tool may be configured to process the compliance specification documents to perform keyword recognition and analysis in order to create the compliance protocols, specifications of interface elements, programs, and/or the like. To facilitate the compliance tool subsystem, the control system 401 may include one or more aggregation and/or transformation engines 437. In some embodiments, the matching engine 438 may include one or more aggregation and transformation engines 437 that may transform, translate, or otherwise adjust the data collected with the initialization document. The matching engine 438 may consolidate, filter out redundant and/or irrelevant data, and transform conditions, specifications, and requirements of initialization documents into organized, categorized, and qualified content, specifications of interface elements, programs, and/or decision trees. The aggregation/transformation engine 437 may include logic for implementing program features in various embodiments. The aggregation/transformation engines 437 may be configured to transform, translate, covert, and/or otherwise adjust the data from a first format to a second format using one or more conversion rules, which may be user-defined, heuristic, and/or machine-learned.

The aggregation/transformation engines 437 may be configured to read and analyze the content of the initialization document to semantically identify artifacts (e.g., keywords, phrases, field identifiers, field values, and the like) in the content and associated metadata that may provide meaning and/or give context to the other data. In some embodiments, the semantic scanning may include filtering out words (e.g., articles, such as "a" and "the"), phrases, and the like. In some embodiments, the aggregation/transformation engines 437 may be configured to arrange keyword specifications, for example, in an ontology. In some embodiments, the aggregation/transformation engines 437 may include an ontology reasoner or semantic reasoning module to make logical inferences from a set of facts in the ontology. Accordingly, the aggregation/transformation engines 437 may correspond to a reasoning engine configured to effect one or more processing and transformation features described herein. In some embodiments, the aggregation/transformation engines 437 may include logic to implement and/or otherwise facilitate any classification, categorization, correlation, mapping, characterizations, scoring, organizing, and/or the like features discussed herein.

The aggregation/transformation engines 437 may, for example, be or include a classification engine configured to classify initialization document portions into at least one category of a set of categories that represent classifications of disability-related initialization document based at least in part on one or more sets of attributes defined for classifying initialization documents. In various embodiments, the attributes may correspond to any one or combination of keywords, characterizations, initialization document identifiers (e.g., numerical and descriptive sectional headings and subheadings), jurisdiction identifiers, source identifiers (e.g., for the source of initialization document portions acquired), initialization document hierarchical indications (e.g., chapter, section, subsection, etc.), and/or the like corresponding to classification bases disclosed herein. For example, information with respect to a particular initialization document portion may be analyzed in order to identify one or more initialization document attributes, and the one or more initialization document attributes may be matched to attributes defined for certain categories. The aggregation/transformation engines 437 can identify attributes of the initialization document portion and match the initialization document portion to one or more categories based on category information saved in a repository 446, each category representing classifications of initialization document portions sharing common attributes. In some embodiments, one or more taxonomies that map keywords of particular initialization document portions to particular categories may be used in correlating initialization document portions with one or more categories. Accordingly, certain embodiments may employ keyword analysis of the initialization document portions and map the initialization document portions to one or more categories based at least in part on the mapping and keywords recognized.

To facilitate the compliance tool subsystem, the control system 401 may include a build engine 439. The build engine 439 may build one or more sets of data, content, specifications of interface elements, programs, decision trees, and/or files particularized to specified compliance requirements and based at least in part on the processing and recognition of the initialization document. The build engine 439 may particularize composites that, in turn, may form prioritized protocols. The prioritized protocols may include a prioritized action program that is generated based on identified compliance requirements. The build engine 439 may generate a guidance program corresponding to the prioritized action program. The program may include any one or combination of a checklist, a graphical tree, a textual tree, a series of prompts configured to walk an end user through a decision tree, a flowchart, an instructional narrative, and/or the like with user-selectable options, data fields, and uploading features to facilitate remediation of the non-compliance.

The control system 401 may include a guidance engine 441 configured to expose a guidance program and/or the like via one or more interfaces of the controllers 170, 175, and/or 190 to facilitate performance of compliance tasks. Based on the guidance program, the guidance engine 441 may request user confirmation of compliance task completion. The program may include any one or combination of a graphical checklist, decision tree, a textual tree, a series of prompts configured to walk an end user through a checklist, a tree, a flowchart, an instructional narrative, and/or the like with user-selectable options, data fields, and uploading features to facilitate gathering of assembly 105 characteristics, indications of compliance task completion for particular assembly 105 components, and/or the like. The guidance program can allow for confirmation of the last known state of the components, the compliance of the components, and task completion through a number of options for user selection, user information input, and data capture. The indications of compliance task completion for particular assembly 105 components may include indications of compliance statuses for the component, a type of component, a location of component, structural characteristics of the component, whether the component is compliant with respect to each requirement, indications of how the component is compliant, deficient, within tolerance, and/or acceptable with respect to each requirement, and/or the like. In some embodiments, the guidance program may provide initialization document snippets, explanations, such as a Wiki or any suitable explanation, describing the compliance requirements.

In some examples, the guidance engine 441 may provide via the user interface specifications of interface elements for any suitable time period (e.g., daily) and/or for particular processes so that managers and mechanics can quickly see tasks have or have not been completed for the time period, who has completed or not completed the tasks, see defects, see if the defects have been resolved, and are like. Each checklist may be designated with a user ID and operator operations with respect to the specifications of interface elements may be tracked on an individual operator basis. The controller 421 may confirm operator indications of certain task completions based at least in part on sensor-based input 406. For example, the sensor-based input 406 may indicate component status for a status indicator corresponding to the particular component, component replacement, changes in functionality of component (e.g., changes from nonfunctional to functional), remediation of deviations and aberrations of sensor-based data for the component with respect to baseline values, and/or the like. When the controller 421 detects a discrepancy between an operator confirmation of task completion and the sensor-based input 406, the controller 421 may send alerts regarding the discrepancy to the controllers 170, 175, and/or 190 or another user device (an administrator/manager device), requesting user confirmation of compliance task completion with a user-selectable interface option. In some embodiments, the guidance engine 441 may not clear the task from the program until the requested user confirmation is received.

The programs, specifications of interface elements, etc. may be adaptive to facilitate differentiation of the importance of each task, and corresponding differentiation in presenting each task to the user in various ways. The interface could visually change portions of a checklist, for example, so that relatively heavily weighted tasks are visually flagged for the particular user's attention to add emphasis by way of content positioning (e.g., moving the task to the top of the list) and window positioning (e.g., bringing the window to the front), modal windows corresponding to the tasks, graphical characteristics that distinguish the tasks from other tasks, and the like. For example, a relatively heavily weighted task may be one which the operator neglected to complete by a certain time limit (e.g., inspections relevant to operational time values, beginning of the day, by the end of the day, etc.). As another example, a relatively heavily weighted task may be a task pertaining to addressing a railway maintenance assembly 105 component failure state (or other category/state) that is more serious than other component states detected for various components of the system 100. In various embodiments, the tasks on a checklist may be recorded respective weights based at least in part on one or combination of operational condition determinations, operational condition scores, deviations of sensor-based data from baselines, and corresponding categories disclosed herein (e.g., new device, functional, component use, heavy use, early life stage, mid-life stage, end-of-life stage, end-of-life imminent, non-functional, over-voltage exposure, under-voltage exposure, over-pressure conditions, over-vibration conditions, overheated situation, cold temperature mismatch situation, operator misuse indications, etc.).

Figure 5:
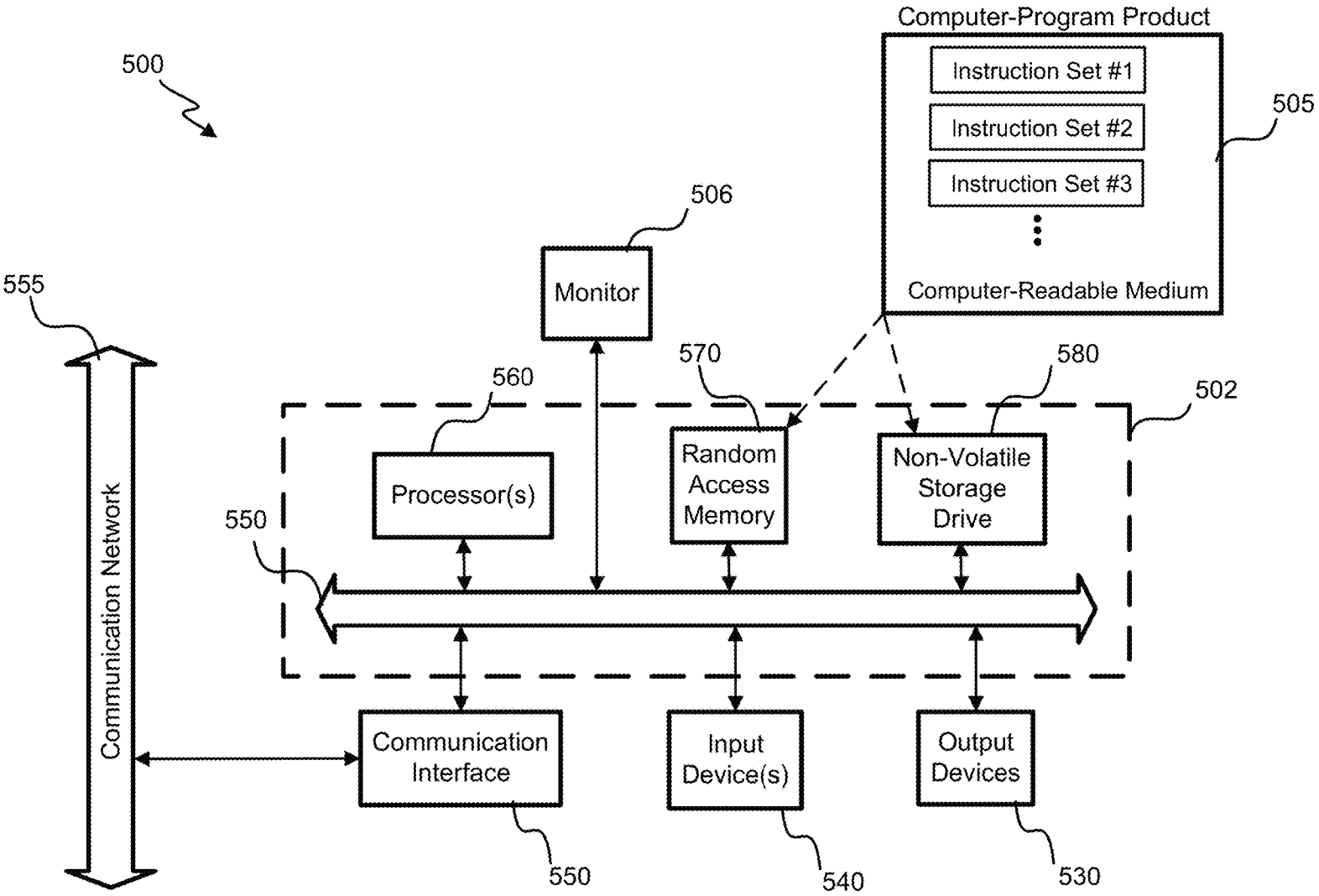
FIG. 5 is a diagram of an embodiment of a special-purpose computer system, in accordance with disclosed embodiments of the present disclosure.

With reference to FIG. 5, an embodiment of a special-purpose computer system 500 is shown. The above methods may be implemented by computer-program products that direct a computer system to perform the actions of the above-described methods and operations. In some embodiments, the special-purpose computer system 500 may implement the subsystem 400. In some embodiments, the computer system 500 may correspond at least in part to one or more of the controllers 170, 175, and/or 190. In some embodiments, the special-purpose computer system 500 may be included in a control system 401 that could, for example, be included in an operator station. Each such computer-program may comprise sets of instructions (codes) embodied on a computer-readable medium that directs the processor of a computer system to perform corresponding actions. The instructions may be configured to run in sequential order, or in parallel (such as under different processing threads), or in a combination thereof. Merely by way of example, one or more procedures described with respect to the method(s) discussed herein might be implemented as code and/or instructions executable by a computer (and/or a processor within a computer); in an aspect, then, such code and/or instructions can be used to configure and/or adapt a general purpose computer (or other device) to perform one or more operations in accordance with the described methods, transforming the computer into the special-purpose computer system 500.

As discussed further herein, according to a set of embodiments, some or all of the procedures of such methods are performed by the computer system 500 in response to processor-execution of one or more sequences of one or more instructions (which might be incorporated into the operating system and/or other code, such as an application program) contained in the operating memory. Such instructions may be read into the operating memory from another computer-readable medium, such as one or more of the non-transitory storage device(s). Merely by way of example, execution of the sequences of instructions contained in the operating memory might cause the processor(s) to perform one or more procedures of the methods described herein.

Special-purpose computer system 500 may include a computer 502, a monitor 506 coupled to computer 502, one or more additional user output devices 530 (optional) coupled to computer 502, one or more user input devices 540 (e.g., joystick, keyboard, mouse, track ball, touch screen buttons, switches, control handles, and/or the like) coupled to computer 502, a communications interface 550 coupled to computer 502, a computer-program 505 stored in a tangible computer-readable memory in computer 502. Computer-program 505 directs system 500 to perform the above-described methods. Computer 502 may include one or more processors 560 that communicate with a number of peripheral devices via a bus subsystem 590. These peripheral devices may include user output device(s) 530, user input device(s) 540, communications interface 550, and a storage subsystem, such as random-access memory (RAM) 570 and non-volatile storage drive 580 (e.g., disk drive, optical drive, solid state drive), which are forms of tangible computer-readable memory.

Computer-program 505 may be stored in non-volatile storage drive 580 or another computer-readable medium accessible to computer 502 and loaded into memory 570. Each processor 560 may comprise a microprocessor, such as a microprocessor from Intel® or Advanced Micro Devices, Inc.®, or the like. To support computer-program 505, the computer 502 runs an operating system that handles the communications of 505 with the above-disclosed components, as well as the communications between the above-disclosed components in support of the computer-program 505. Exemplary operating systems include Windows® or the like from Microsoft® Corporation, Solaris® from Oracle®, LINUX, UNIX, and the like. The processors 560 may include one or more special-purpose processors such as digital signal processing chips, graphics acceleration processors, video decoders, image processors, and/or the like.

User input devices 540 include all possible types of devices and mechanisms to input information to computer system 502. These may include a keyboard, a keypad, a mouse, a scanner, buttons, control handles, switches, a digital drawing pad, a touch screen incorporated into the display, audio input devices such as voice recognition systems, microphones, and other types of input devices. In various embodiments, user input devices 540 may be embodied as a computer mouse, a trackball, a track pad, a joystick, buttons, control handles, switches, wireless remote, a drawing tablet, or a voice command system. User input devices 540 typically allow a user to select objects, icons, text and the like that appear on the monitor 506 via a command such as a click of a button or the like. User output devices 530 include all possible types of devices and mechanisms to output information from computer 502. These may include a display (e.g., monitor 506), printers, non-visual displays such as audio output devices, etc. Some embodiments may not have a separate monitor 506, but may have monitors integrated with input devices and/or output devices, such as mobile devices, touchscreen devices, etc.

Communications interface 550 provides an interface to other communication networks 595 and devices and may serve as an interface to receive data from and transmit data to other systems, WANs and/or the Internet 518. Embodiments of communications interface 550 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 550 may be coupled to a computer network, to a FireWire® bus, or the like. In other embodiments, communications interface 550 may be physically integrated on the motherboard of computer 502, and/or may be a software program, or the like. In further examples, the communications interface 550 may be part of a communications subsystem, which can include without limitation a modem, a network card (wireless or wired), an infrared communication device, a wireless communication device, and/or a chipset (such as a Bluetooth™ device, BLE, an 802.11 device, an 802.15.4 device, a Wi-Fi device, a WiMAX device, cellular communication device, etc.), and/or the like. The communications subsystem may permit data to be exchanged with a network (such as the network described below, to name one example), other computer systems, and/or any other devices described herein.

RAM 570 and non-volatile storage drive 580 are examples of tangible computer-readable media configured to store data such as computer-program embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 570 and non-volatile storage drive 580 may be configured to store the basic programming and data constructs that provide the functionality of various embodiments of the present invention, as described above. The above are examples of one or more non-transitory storage devices that may be utilized by the system 500. Such storage devices may be configured to implement any appropriate data stores, including without limitation, various file systems, database structures, and/or the like.

Software instruction sets that provide the functionality of the present invention may be stored in RAM 570 and non-volatile storage drive 580. These instruction sets or code may be executed by the processor(s) 560. RAM 570 and non-volatile storage drive 580 may also provide a repository to store data and data structures used in accordance with the present invention. RAM 570 and non-volatile storage drive 580 may include a number of memories including a main random-access memory (RAM) to store instructions and data during program execution and a read-only memory (ROM) in which fixed instructions are stored. RAM 570 and non-volatile storage drive 580 may include a file storage subsystem providing persistent (non-volatile) storage of program and/or data files. RAM 570 and non-volatile storage drive 580 may also include removable storage systems, such as removable flash memory.

Bus subsystem 590 provides a mechanism to allow the various components and subsystems of computer 502 communicate with each other as intended. Although bus subsystem 590 is shown schematically as a single bus, alternative embodiments of the bus subsystem may utilize multiple buses or communication paths within the computer 502.

The above methods may be implemented by computer-program products that direct a computer system to control the actions of the above-described methods and components. Each such computer-program may comprise sets of instructions (codes) embodied on a computer-readable medium that directs the processor of a computer system to cause corresponding actions. The instructions may be configured to run in sequential order, or in parallel (such as under different processing threads), or in a combination thereof. Special-purpose computer systems disclosed herein include a computer-program product(s) stored in tangible computer-readable memory that directs the systems to perform the above-described methods. The systems include one or more processors that communicate with a number of peripheral devices via a bus subsystem. These peripheral devices may include user output device(s), user input device(s), communications interface(s), and a storage subsystem, such as random-access memory (RAM) and non-volatile storage drive (e.g., disk drive, optical drive, solid state drive), which are forms of tangible computer-readable memory.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, hydraulic, pneumatic, and/or electric control connections, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs) or programmable logic controllers (PLCs), field programmable gate arrays (FPGAs), image processors, controllers, micro-controllers, microprocessors, other electronic units designed to perform the functions described above, and/or a combination thereof.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine-readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the terms "storage medium," "storage media," "computer-readable medium," "computer-readable media," "processor-readable medium," "processor-readable media," and variations of the term may represent one or more devices for storing data, including read only memory (ROM), random access memory (RAM), magnetic RAM, core memory, magnetic disk storage mediums, optical storage mediums, flash memory devices and/or other machine readable mediums for storing information. The terms, computer-readable media, processor-readable media, and variations of the term, include, but are not limited to portable or fixed storage devices, optical storage devices, wireless channels and various other mediums capable of storing, containing or carrying instruction(s) and/or data.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

While the principles of the disclosure have been described above in connection with specific apparatuses and methods, it is to be clearly understood that this description is made only by way of example and not as limitation on the scope of the disclosure. Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered. Furthermore, while the figures depicting mechanical parts of the embodiments are drawn to scale, it is to be clearly understood as only by way of example and not as limiting the scope of the disclosure.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed is:

1. A system comprising:

one or more processing devices and memory communicatively coupled with and readable by the one or more processing devices, the memory comprising processor-readable instructions which, when executed by the one or more processing devices, cause the system to perform operations comprising:

monitoring one or more conditions of at least a portion of a railway maintenance assembly;

based at least in part on the monitoring, storing monitoring data corresponding to operations of the railway maintenance assembly;

determining an operational condition of a railway workhead component of the railway maintenance assembly based at least in part on the monitoring data;

identifying a maintenance action to be performed within a time boundary based at least in part on the operational condition; and responsive to the identifying the maintenance action, facilitating performance of the maintenance action within the time boundary at least in part by generating interface elements that specify an order to replace the railway workhead component and causing placement of the order with a resource-controlling system to obtain a replacement for the railway workhead component.

2. The system as recited in claim 1, wherein the facilitating the performance of the maintenance action within the time boundary comprises causing one or more notifications corresponding to the maintenance action via one or more interfaces.

3. The system as recited in claim 1, the operations further comprising generating reporting data based at least in part on the monitoring data, wherein the facilitating the performance of the maintenance action within the time boundary comprises communicating a wireless communication to a remote device that is remote from the railway maintenance assembly, the wireless communication comprising the reporting data.

4. The system as recited in claim 1, wherein the storing the monitoring data corresponding to the operations of the railway maintenance assembly comprises updating one or more timetables stored in a data store with updates mapped to the railway maintenance assembly, the railway workhead component, and/or replacement orders.

5. The system as recited in claim 4, wherein the updates indicate determinations of usage, expected life balance, and/or predicted end of life with respect to the railway workhead component.

6. The system as recited in claim 1, the operations further comprising generating adaptive interface elements that indicate one or more maintenance actions based at least in part on the monitoring data.

7. One or more non-transitory, machine-readable media comprising machine-readable instructions, which, when executed by one or more processing devices, causes a system to perform operations to facilitate monitoring and control of a railway maintenance assembly, the operations comprising:

monitoring one or more conditions of at least a portion of a railway maintenance assembly;

based at least in part on the monitoring, storing monitoring data corresponding to operations of the railway maintenance assembly;

determining an operational condition of a railway workhead component of the railway maintenance assembly based at least in part on the monitoring data;

identifying a maintenance action to be performed within a time boundary based at least in part on the operational condition; and responsive to the identifying the maintenance action, facilitating performance of the maintenance action within the time boundary at least in part by generating interface elements that specify an order to replace the railway workhead component and causing placement of the order with a resource-controlling system to obtain a replacement for the railway workhead component.

8. The one or more non-transitory, machine-readable media as recited in claim 7, wherein the facilitating the performance of the maintenance action within the time boundary comprises causing one or more notifications corresponding to the maintenance action via one or more interfaces.

9. The one or more non-transitory, machine-readable media as recited in claim 7, the operations further comprising generating reporting data based at least in part on the monitoring data, wherein the facilitating the performance of the maintenance action within the time boundary comprises communicating a wireless communication to a remote device that is remote from the railway maintenance assembly, the wireless communication comprising the reporting data.

10. The one or more non-transitory, machine-readable media as recited in claim 9, wherein the storing the monitoring data corresponding to the operations of the railway maintenance assembly comprises updating one or more timetables stored in a data store with updates mapped to the railway maintenance assembly, the railway workhead component, and/or replacement orders.

11. The one or more non-transitory, machine-readable media as recited in claim 10, wherein the updates indicate determinations of usage, expected life balance, and/or predicted end of life with respect to the railway workhead component.

12. The one or more non-transitory, machine-readable media as recited in claim 7, the operations further comprising generating adaptive interface elements that indicate one or more maintenance actions based at least in part on the monitoring data.

13. A method comprising:

monitoring one or more conditions of at least a portion of a railway maintenance assembly;

based at least in part on the monitoring, storing monitoring data corresponding to operations of the railway maintenance assembly;

determining an operational condition of a railway workhead component of the railway maintenance assembly based at least in part on the monitoring data;

identifying a maintenance action to be performed within a time boundary based at least in part on the operational condition; and responsive to the identifying the maintenance action, facilitating performance of the maintenance action within the time boundary at least in part by generating interface elements that specify an order to replace the railway workhead component and causing placement of the order with a resource-controlling system to obtain a replacement for the railway workhead component.

14. The method as recited in claim 13, wherein the facilitating the performance of the maintenance action within the time boundary comprises causing one or more notifications corresponding to the maintenance action via one or more interfaces.

15. The method as recited in claim 13, further comprising generating reporting data based at least in part on the monitoring data, wherein the facilitating the performance of the maintenance action within the time boundary comprises communicating a wireless communication to a remote device that is remote from the railway maintenance assembly, the wireless communication comprising the reporting data.

16. The method as recited in claim 13, wherein the storing the monitoring data corresponding to the operations of the railway maintenance assembly comprises updating one or more timetables stored in a data store with updates mapped to the railway maintenance assembly, the railway workhead component, and/or replacement orders.

17. The method as recited in claim 16, wherein the updates indicate determinations of usage, expected life balance, and/or predicted end of life with respect to the railway workhead component.

* * * * *